US009528359B2

(12) United States Patent
Castrogiovanni et al.

(10) Patent No.: US 9,528,359 B2
(45) Date of Patent: Dec. 27, 2016

(54) DOWNHOLE STEAM GENERATOR AND METHOD OF USE

(71) Applicant: World Energy Systems Incorporated, Fort Worth, TX (US)

(72) Inventors: Anthony Gus Castrogiovanni, Manorville, NY (US); Randall Todd Voland, Hampton, VA (US); Charles H. Ware, Palm Harbor, FL (US); Blair A. Folsom, Santa Ana, CA (US); M. Cullen Johnson, Odessa, TX (US)

(73) Assignee: WORLD ENERGY SYSTEMS INCORPORATED, Fort Worth, TX (US)

( * ) Notice: Subject to any disclaimer, the term of this patent is extended or adjusted under 35 U.S.C. 154(b) by 354 days.

(21) Appl. No.: 14/137,299

(22) Filed: Dec. 20, 2013

(65) Prior Publication Data

US 2014/0209310 A1 Jul. 31, 2014

Related U.S. Application Data

(63) Continuation-in-part of application No. 13/042,075, filed on Mar. 7, 2011, now Pat. No. 9,613,316.
(Continued)

(51) Int. Cl.
*E21B 43/243* (2006.01)
*E21B 36/02* (2006.01)
(Continued)

(52) U.S. Cl.
CPC ..... *E21B 43/243* (2013.01); *E21B 36/02* (2013.01); *E21B 43/2406* (2013.01); *F22B 1/22* (2013.01); *F22B 1/26* (2013.01)

(58) Field of Classification Search
CPC .... E21B 43/243; E21B 43/2406; E21B 36/02; F22B 1/26; F22B 1/22
See application file for complete search history.

(56) References Cited

U.S. PATENT DOCUMENTS 1,948,940 A * 2/1934 Noack ..... F22B 1/22 122/24
3,055,427 A * 9/1962 Pryor ..... E21B 36/02 166/260
(Continued)

FOREIGN PATENT DOCUMENTS

CN 101067372 A 11/2007

OTHER PUBLICATIONS

Dictionary definition of "pilot burner", accessed Jun. 2, 2016 via www.thefreedictionary.com.*
(Continued)

*Primary Examiner* — Blake Michener
(74) *Attorney, Agent, or Firm* — Patterson & Sheridan, L.L.P.

(57) ABSTRACT

A downhole steam generation system may include a burner head assembly, a liner assembly, a vaporization sleeve, and a support sleeve. The burner head assembly may include a sudden expansion region with one or more injectors. The liner assembly may include a water-cooled body having one or more water injection arrangements. The system may be optimized to assist in the recovery of hydrocarbons from different types of reservoirs. A method of recovering hydrocarbons may include supplying one or more fluids to the system, combusting a fuel and an oxidant to generate a combustion product, injecting a fluid into the combustion product to generate an exhaust gas, injecting the exhaust gas into a reservoir, and recovering hydrocarbons from the reservoir.

19 Claims, 44 Drawing Sheets

Related U.S. Application Data

(60) Provisional application No. 61/311,619, filed on Mar. 8, 2010, provisional application No. 61/436,472, filed on Jan. 26, 2011.

(51) Int. Cl.

| | |
|---|---|
| ***F22B 1/22*** | (2006.01) |
| ***E21B 43/24*** | (2006.01) |
| ***F22B 1/26*** | (2006.01) |

(56) References Cited

U.S. PATENT DOCUMENTS 3,074,469 A 1/1963 Babbitt et al.
3,315,745 A 4/1967 Rees, Jr.
3,456,721 A 7/1969 Smith
3,700,035 A 10/1972 Lange
3,980,137 A 9/1976 Gray
3,982,591 A 9/1976 Hamrick et al.
3,982,592 A 9/1976 Hamrick et al.
4,024,912 A 5/1977 Hamrick et al.
4,050,515 A 9/1977 Hamrick et al.
4,053,015 A * 10/1977 Hamrick ..... E21B 36/02 166/302
4,077,469 A 3/1978 Hamrick et al.
4,078,613 A 3/1978 Hamrick et al.
4,118,925 A 10/1978 Sperry et al.
4,159,743 A 7/1979 Rose et al.
4,199,024 A 4/1980 Rose et al.
4,244,684 A 1/1981 Sperry et al.
4,336,839 A 6/1982 Wagner et al.
4,366,860 A 1/1983 Donaldson et al.
4,380,267 A 4/1983 Fox
4,382,771 A * 5/1983 Carr ..... F01K 21/047 431/10
4,385,661 A 5/1983 Fox
4,397,356 A * 8/1983 Retallick ..... E21B 36/02 122/31.1
4,411,618 A 10/1983 Donaldson et al.
4,421,163 A 12/1983 Tuttle
4,442,898 A 4/1984 Wyatt
4,456,068 A 6/1984 Burrill, Jr. et al.
4,459,101 A 7/1984 Doherty
4,463,803 A 8/1984 Wyatt
4,475,883 A 10/1984 Schirmer et al.
4,498,531 A 2/1985 Vrolyk
4,498,542 A 2/1985 Eisenhawer et al.
4,558,743 A 12/1985 Ryan et al.
4,597,441 A 7/1986 Ware et al.
4,604,988 A 8/1986 Rao
4,648,835 A 3/1987 Eisenhawer et al.
4,678,039 A 7/1987 Rivas et al.
4,682,471 A 7/1987 Wagner
4,691,771 A 9/1987 Ware et al.
4,706,751 A 11/1987 Gondouin
4,765,406 A 8/1988 Frohling et al.
4,785,748 A 11/1988 Sujata et al.
4,860,827 A 8/1989 Lee et al.
4,861,263 A 8/1989 Schirmer
4,865,130 A 9/1989 Ware et al.
4,930,454 A 6/1990 Latty et al.
5,055,030 A 10/1991 Schirmer
5,163,511 A 11/1992 Amundson et al.
5,412,981 A 5/1995 Myers et al.
5,488,990 A 2/1996 Wadleigh et al.
5,623,576 A 4/1997 Deans
5,802,854 A * 9/1998 Maeda ..... F23R 3/346 60/39.821
5,832,999 A 11/1998 Ellwood
5,862,858 A 1/1999 Wellington et al.
5,899,269 A 5/1999 Wellington et al.
6,016,867 A 1/2000 Gregoli et al.
6,016,868 A 1/2000 Gregoli et al.
6,019,172 A 2/2000 Wellington et al.
6,269,882 B1 8/2001 Wellington et al.
6,328,104 B1 12/2001 Graue
6,358,040 B1 3/2002 Pfefferle et al.
6,394,791 B2 5/2002 Smith et al.
6,752,623 B2 6/2004 Smith et al.
6,973,968 B2 12/2005 Pfefferle
7,090,013 B2 8/2006 Wellington
7,114,566 B2 10/2006 Vinegar et al.
7,341,102 B2 3/2008 Kresnyak et al.
7,343,971 B2 3/2008 Pfefferle
7,497,253 B2 3/2009 Retallick et al.
7,712,528 B2 5/2010 Langdon et al.
7,770,646 B2 8/2010 Klassen et al.
8,091,625 B2 1/2012 Ware et al.
8,387,692 B2 * 3/2013 Tilmont ..... E21B 36/02 166/272.3
8,613,316 B2 12/2013 Castrogiovanni et al.
8,662,176 B2 * 3/2014 McGuffin ..... E21B 43/243 166/302
8,950,471 B2 * 2/2015 McGuffin ..... E21B 43/243 166/57
9,388,976 B2 * 7/2016 Tilmont ..... E21B 36/02
2003/0175082 A1 9/2003 Liebert et al.
2005/0026094 A1 * 2/2005 Sanmiguel ..... F23C 99/006 431/1
2005/0080312 A1 * 4/2005 Reinhardt ..... B09C 1/06 588/312
2005/0239661 A1 10/2005 Pfefferle
2006/0024135 A1 * 2/2006 Reinhardt ..... B09C 1/06 405/128.85
2006/0042794 A1 3/2006 Pfefferle
2006/0142149 A1 6/2006 Ma et al.
2006/0162923 A1 7/2006 Ware
2006/0254956 A1 11/2006 Khan
2006/0289157 A1 12/2006 Rao
2007/0202452 A1 * 8/2007 Rao ..... E21B 43/2406 431/354
2007/0202453 A1 8/2007 Knoepfel
2008/0078552 A1 4/2008 Donnelly et al.
2008/0217008 A1 * 9/2008 Langdon ..... E21B 36/02 166/270
2009/0008088 A1 1/2009 Schultz et al.
2011/0036095 A1 2/2011 Krajicek
2011/0036575 A1 2/2011 Cavender et al.
2011/0127036 A1 6/2011 Tilmont et al.
2013/0140027 A1 * 6/2013 Tilmont ..... E21B 36/02 166/302
2013/0232876 A1 * 9/2013 Armstrong ..... F02M 21/0215 48/197 R
2013/0344448 A1 * 12/2013 Tilmont ..... E21B 36/02 431/258
2014/0034302 A1 * 2/2014 McGuffin ..... E21B 43/243 166/251.1
2014/0238680 A1 * 8/2014 Castrogiovanni ..... E21B 36/02 166/302

OTHER PUBLICATIONS

Chinese Office Action for Chinese Patent Applicaton No. 201180023206.0, dated Jul. 3, 2014.
Columbian Office Action for Columbian Patent Applicaton No. 12176881, dated Aug. 1, 2014.
V Graifer, et al., Bottom-hole Formation Zone Treatment Using Monofuel Thermolysis, SPE 138077, 2010 Russian Oil & Gas Technical Conferenceand Exhibition held in Moscow, Russia on Oct. 26-Oct. 28, 2010, 3 Pages.
PCT Search Report and Written Opinion for International Application No. PCT/US2011/027398 dated Sep. 14, 2011.
Richard Puster, Marco Egoavil, Peyton Gregory and Davood Moslem ian, A Gas Turbine Combustor With a Double Step Combustor and a Captured Vortex Chamber, American Institute of Aeronautics and Astronautics, AIAA-2009-1251, 2009.
Canadian Office Action for Application No. 2,792,597 dated Jan. 2, 2014.

* cited by examiner

| | | | | |
|---|---|---|---|---|
| Packer ID = | 3.068 | inches | | |
| Combustor ID = | 3.5 | inches | | |
| Combustor Pressure ( psia ) | 2000 | 1500 | 750 | 300 |
| H2O flow rate ( b/d ) | 1500 | 1500 | 1500 | 1500 |
| DHSG Exit Temp ( F ) | 634.4 | 583.0 | 484.9 | 397.7 |
| % H2O as Vapor | 81.3% | 81.6% | 80.6% | 82.5% |
| O2 concentration in final exhaust ( mol% ) | 3.1% | 3.5% | 4.0% | 2.0% |
| Air Inlet Velocity | 26.32 | 35.17 | 71.16 | 158.99 |
| Number of fuel injection holes | 8.00 | 8.00 | 24.00 | 24.00 |
| Fuel Injection Velocity ( ft/s ) | 323.8 | 427.1 | 283.5 | 622.1 |
| Fuel Injection Mach No. | 0.2 | 0.3 | 0.2 | 0.4 |
| Non-critical Fuel Injector Pressure Drop ( psi ) | 144.44 | 184.15 | 38.16 | 70.34 |
| Pressure drop % | 7% | 11% | 5% | 19% |
| Combustor Velocity ( ft/s ) | 65.16 | 84.91 | 162.77 | 676.29 |
| Flame Temp ( F ) | 4141 | 4045 | 3846 | 3577 |
| Packer Velocity ( ft/s ) | 46.96 | 59.95 | 109.18 | 228.77 |
| Packer Pressure Drop ( psi ) | 1.19 | 1.52 | 2.81 | 5.26 |
| Packer Velocity to Erosion Velocity Ratio | 0.39 | 0.44 | 0.60 | 0.82 |

FIG. 17

| | | | | |
|---|---|---|---|---|
| Packer ID = | 2.441 | inches | | |
| Combustor ID = | 3.5 | inches | | |
| Combustor Pressure ( psia ) | 2000 | 1500 | 750 | 300 |
| H2O flow rate ( b/d ) | 1500 | 1500 | 1500 | 1500 |
| DHSG Exit Temp ( F ) | 634.4 | 583.0 | 484.9 | 397.7 |
| % H2O as Vapor | 81.3% | 81.6% | 80.6% | 82.5% |
| O2 concentration in final exhaust ( mol% ) | 3.1% | 3.5% | 4.0% | 2.0% |
| Air Inlet Velocity | 26.32 | 35.17 | 71.16 | 158.99 |
| Number of fuel injection holes | 8.00 | 8.00 | 24.00 | 24.00 |
| Fuel Injection Velocity ( ft/s ) | 323.8 | 427.1 | 283.5 | 622.1 |
| Fuel Injection Mach No. | 0.2 | 0.3 | 0.2 | 0.4 |
| Non-critical Fuel Injector Pressure Drop ( psi ) | 144.44 | 184.15 | 38.16 | 70.34 |
| Pressure drop % | 7% | 11% | 5% | 19% |
| Combustor Velocity ( ft/s ) | 65.16 | 84.91 | 162.77 | 676.29 |
| Flame Temp ( F ) | 4141 | 4045 | 3846 | 3577 |
| Packer Velocity ( ft/s ) | 74.18 | 94.70 | 172.47 | 361.38 |
| Packer Pressure Drop ( psi ) | 3.74 | 4.78 | 8.80 | 16.49 |
| Packer Velocity to Erosion Velocity Ratio | 0.61 | 0.69 | 0.94 | 1.29 |

FIG. 18

| | | | | |
|---|---|---|---|---|
| Packer ID = | 3.068 | inches | | |
| Combustor ID = | 3.5 | inches | | |
| Combustor Pressure ( psia ) | 2000 | 1500 | 750 | 300 |
| H2O flow rate ( b/d ) | 375 | 375 | 375 | 375 |
| DHSG Exit Temp ( F ) | 634.4 | 583.0 | 484.9 | 397.7 |
| % H2O as Vapor | 81.3% | 81.6% | 80.6% | 82.5% |
| O2 concentration in final exhaust ( mol% ) | 3.1% | 3.5% | 4.0% | 2.0% |
| Air Inlet Velocity | 6.58 | 8.79 | 17.79 | 39.75 |
| Number of fuel injection holes | 8.00 | 8.00 | 8.00 | 24.00 |
| Fuel Injection Velocity ( ft/s ) | 81.0 | 106.8 | 212.6 | 155.5 |
| Non-critical Fuel Injector Pressure Drop ( psi ) | 9.03 | 11.51 | 21.47 | 4.40 |
| Pressure drop % | 0.4% | 0.8% | 2.8% | 1.4% |
| Combustor Velocity ( ft/s ) | 16.29 | 21.23 | 40.69 | 169.07 |
| Flame Temp ( F ) | 4141 | 4045 | 3846 | 3577 |
| Packer Velocity ( ft/s ) | 11.74 | 14.99 | 27.29 | 57.19 |
| Packer Pressure Drop ( psi ) | 0.07 | 0.10 | 0.18 | 0.33 |
| Packer Velocity to Erosion Velocity Ratio | 0.10 | 0.11 | 0.15 | 0.20 |

FIG. 19

| | | | | |
|---|---|---|---|---|
| Packer ID = | 2.441 | inches | | |
| Combustor ID = | 3.5 | inches | | |
| Combustor Pressure ( psia ) | 2000 | 1500 | 750 | 300 |
| H2O flow rate ( b/d ) | 375 | 375 | 375 | 375 |
| DHSG Exit Temp ( F ) | 634.4 | 583.0 | 484.9 | 397.7 |
| % H2O as Vapor | 81.3% | 81.6% | 80.6% | 82.5% |
| O2 concentration in final exhaust ( mol% ) | 3.1% | 3.5% | 4.0% | 2.0% |
| Air Inlet Velocity | 6.58 | 8.79 | 17.79 | 39.75 |
| Number of fuel injection holes | 8.00 | 8.00 | 8.00 | 24.00 |
| Fuel Injection Velocity ( ft/s ) | 81.0 | 106.8 | 212.6 | 155.5 |
| Non-critical Fuel Injector Pressure Drop ( psi ) | 9.03 | 11.51 | 21.47 | 4.40 |
| Pressure drop % | 0.4% | 0.8% | 2.8% | 1.4% |
| Combustor Velocity ( ft/s ) | 16.29 | 21.23 | 40.69 | 169.07 |
| Flame Temp ( F ) | 4141 | 4045 | 3846 | 3577 |
| Packer Velocity ( ft/s ) | 18.55 | 23.67 | 43.12 | 90.35 |
| Packer Pressure Drop ( psi ) | 0.23 | 0.30 | 0.55 | 1.03 |
| Packer Velocity to Erosion Velocity Ratio | 0.15 | 0.17 | 0.24 | 0.32 |

FIG. 20

| CH4 | | | | Water | | | | Air | | | |
|---|---|---|---|---|---|---|---|---|---|---|---|
| | Umbilical Length | 2500 | ft | Umbilical Length | 2500 | ft | | Umbilical Length | 2500 | ft |
| | Fuel Line Dia | 1 | in | Water Line Dia | 1.5 | in | | Air Line Dia | 2 | in |
| | Fuel Line Dia | 0.083 | ft | Water Line Dia | 0.125 | ft | | Air Line Dia | 0.167 | ft |
| | Cross sectional area | 0.005 | ft^2 | Cross sectional area | 0.012 | ft^2 | | Cross sectional area | 0.022 | ft^2 |
| | Volume of line | 13.635 | ft^3 | Volume of line | 30.680 | ft^3 | | Volume of line | 54.542 | ft^3 |
| | | | | | | | | | | |
| | | | | | | | | | | |
| | Pressure at surface | 2035 | psia | Pressure at surface | 1116 | psia | | Pressure at surface | 2005 | psia |
| | temp at surface | 100 | F | temp at surface | 100 | F | | temp at surface | 100 | F |
| | density at surface | 5.421 | lb/ft^3 | density at surface | 62.4 | lb/ft^3 | | density at surface | 9.679 | lb/ft^3 |
| | density at bottom | 5.594 | lb/ft^3 | density at bottom | 62.4 | lb/ft^3 | | density at bottom | 10.140 | lb/ft^3 |
| | avg density | 5.508 | lb/ft^3 | avg density | 62.4 | lb/ft^3 | | avg density | 9.909 | lb/ft^3 |
| | mass in line | 75.1 | lb | mass in line | 1914 | lb | | mass in line | 528 | lb |
| | pressure head | 95.6 | psi | pressure head | 1083 | psi | | pressure head | 168 | psi |
| | mass flow | 0.32 | lb/s | mass flow | 5.37 | lb/s | | mass flow | 3.72 | lb/s |
| | velocity | 10.8 | ft/s | velocity | 7.0 | ft/s | | velocity | 17.6 | ft/s |
| | pressure drop | 30.51 | psi | pressure drop | 99.17 | psi | | pressure drop | 72.71 | psi |
| | | | | | | | | | | |
| | pressure at DHSG | 2100 | psi | pressure at DHSG | 2100 | psi | | pressure at DHSG | 2100 | psi |
| | error | 0% | | error | 0% | | | error | 0% | |
| | | | | | | | | | | |
| | Residence time | 232.14 | sec | Residence time | 356.67 | sec | | Residence time | 142.07 | sec |
| | Residence time | 3.87 | min | Residence time | 5.94 | min | | Residence time | 2.37 | min |
| | | | | | | | | | | |
| | 1/4 Flow Residence | 15.26 | min | 1/4 Flow Residence | 23.78 | min | | 1/4 Flow Residence | 9.18 | min |

FIG. 36

| Downhole System | EOR Injectants, volume per day at sandface: | | | | | |
|---|---|---|---|---|---|---|
| | $H_2O$ (bbl) (umbilical) | $H_2O$ (bbl) (combustion) | $CO_2$ (injected) (MSCF) | $CO_2$ (combustion) (MSCF) | $N_2$ (MSCF) | $O_2$ (MSCF) |
| Air Breather Stoichiometric | 1,348 | 152 | 0 | 555 | 4,443 | 0 |
| Rich Air (35/65) Stoichiometric | 1,350 | 150 | 0 | 551 | 2,112 | 34 |
| Rich Air w/ 5% Surplus $O_2$ | 1,345 | 155 | 0 | 573 | 3,617 | 802 |
| Oxy Rich (95/5) w/ $CO_2$ Recycle | 1,351 | 149 | 2,247 | 550 | 62 | 70 |
| Oxy Rich $CO_2$ Recycle w/ 5% Surplus $O_2$ | 1,349 | 151 | 2,417 | 557 | 98 | 744 |

FIG. 41A

| Downhole System | EOR Injectants, mol % in tailpipe stream: | | | | |
|---|---|---|---|---|---|
| | $H_2O$ | $CO_2$ (injected) | $CO_2$ (combustion) | $N_2$ | $O_2$ |
| Air Breather Stoichiometric | 68.87% | 0% | 3.46% | 27.67% | 0% |
| Rich Air (35/65) Stoichiometric | 80.38% | 0% | 4.01% | 15.36% | 0.25% |
| Rich Air w/ 5% Surplus $O_2$ | 68.89% | 0% | 3.57% | 22.54% | 5.00% |
| Oxy Rich (95/5) w/ $CO_2$ Recycle | 79.06% | 16.07% | 3.93% | 0.44% | 0.50% |
| Oxy Rich $CO_2$ Recycle w/ 5% Surplus $O_2$ | 74.34% | 16.25% | 3.75% | 0.66% | 5.00% |

FIG. 41B

| Downhole System | Tailpipe Injection Ratios, per bbl of steam delivered | | | | |
|---|---|---|---|---|---|
| | $H_2O$ (bbl) | $CO_2$ (injected) (MSCF) | $CO_2$ (combustion) (MSCF) | $N_2$ (MSCF) | $O_2$ (MSCF) |
| Air Breather Stoichiometric | 1.000 | 0.000 | 0.371 | 2.968 | 0.000 |
| Rich Air (35/65) Stoichiometric | 1.000 | 0.000 | 0.368 | 1.411 | 0.023 |
| Rich Air w/ 5% Surplus $O_2$ | 1.000 | 0.000 | 0.383 | 2.416 | 0.536 |
| Oxy Rich (95/5) w/ $CO_2$ Recycle | 1.000 | 1.501 | 0.367 | 0.041 | 0.047 |
| Oxy Rich $CO_2$ Recycle w/ 5% Surplus $O_2$ | 1.000 | 1.615 | 0.372 | 0.065 | 0.497 |

FIG. 41C

| Metrics: | OTSG Surface Steam | Downhole System: Rich Air (35/65) Stoichiometric | Downhole System: Rich Air w/ 5% Surplus $O_2$ | Downhole System: Oxy Rich (95/5) w/ 5% Surplus $O_2$ |
|---|---|---|---|---|
| Actual Steam Quality at Sandface (%) | 39% | 80% | 80% | 80% |
| Feedwater Demand at Surface (bbl/day) | 1005 | 1350 | 1350 | 1350 |
| Steam from Combustion (bbl/day) | 0 | 150 | 150 | 150 |
| Equivalent 80% Quality Steam at Sandface (bbl/day) | 750 | 1,500 | 1,500 | 1,500 |
| Steam Generated in situ from Surplus $O_2$ (bbl/day) | 0 | 40 | 1,010 | 990 |
| Total 80% Quality Steam in Reservoir | 750 | 1,500 | 2,510 | 2,490 |
| Fuel Gas per bbl equivalent 80% Quality Steam (MCF/bbl) | 0.64 | 0.37 | 0.38 | 0.37 |
| $CO_2$ per bbl equivalent 80% Quality Steanm (MCF/bbl) | 0 | 0.37 | 0.38 | 1.98 |
| $CO_2$ per bbl equivalent 80% Quality Steanm (MCF/bbl) generated in situ | 0 | 0.02 | 0.39 | 0.38 |
| Total $CO_2$ in Reservoir (MCF/Day) | 0 | 580 | 1,160 | 3,560 |
| $N_2$ per bbl equivalent 80% Quality Steam (MCF/bbl) | 0 | 1.41 | 2.41 | 0.07 |

FIG. 42

| | BTUs/bbl steam Delivered to Reservoir, Surface Steam vs. D.S. | | |
|---|---|---|---|
| | Method of Delivery: | | |
| Constituent: | Surface Steam | Rich Air (35/65) Stoichiometric | Oxy Rich (95/5) $CO_2$ Recycle w/ 5% Surplus $O_2$ |
| Steam | 347,004 | 369,866 | 371,506 |
| $CO_2$ | 0 | 4,590 | 24,256 |
| $N_2$ | 0 | 13,779 | 625 |
| $O_2$ (in situ combustion) | 0 | 10,889 | 235,446 |
| TOTAL | 347,004 | 399,124 | 631,833 |

FIG. 43A

| | MMBTUs/day Delivered to Reservoir, Surface Steam vs. D.S. | | |
|---|---|---|---|
| | Method of Delivery: | | |
| Constituent: | Surface Steam | Rich Air (35/65) Stoichiometric | Oxy Rich (95/5) $CO_2$ Recycle w/ 5% Surplus $O_2$ |
| Vapor | 298 | 239 | 258 |
| Liquid Water | 223 | 316 | 293 |
| $CO_2$ | 0 | 7 | 36 |
| $N_2$ | 0 | 21 | 1 |
| $O_2$ (in situ combustion) | 0 | 16 | 353 |
| TOTAL | 521 | 599 | 942 |

FIG. 43B

| | MMBTUs Delivered to Reservoir by Constituents, Per Day | | | | |
|---|---|---|---|---|---|
| Downhole System(D.S.) | Steam | $CO_2$ | $N_2$ | $O_2$ (in situ combustion) | TOTAL |
| Air Breather Stoichiometric | 557 | 7 | 42 | 0 | 606 |
| Rich Air (35/65) Stoichiometric | 555 | 7 | 21 | 16 | 599 |
| Rich Air w/ 5% Surplus $O_2$ | 557 | 36 | 36 | 381 | 1,009 |
| Oxy Rich (95/5) w/ $CO_2$ Recycle | 557 | 35 | 1 | 33 | 626 |
| Oxy Rich $CO_2$ Recycle w/ 5% Surplus $O_2$ | 557 | 36 | 1 | 353 | 948 |

FIG. 43C

DOWNHOLE STEAM GENERATOR AND METHOD OF USE

CROSS REFERENCE TO RELATED APPLICATIONS

This application is a continuation-in-part of U.S. patent application Ser. No. 13/042,075, filed Mar. 7, 2011, which claims benefit of U.S. Provisional Patent Application Ser. No. 61/311,619, filed Mar. 8, 2010, and U.S. Provisional Patent Application Ser. No. 61/436,472, filed Jan. 26, 2011, each of which are herein incorporated by reference in their entirety.

BACKGROUND OF THE INVENTION

1. Field of the Invention

Embodiments of the inventions relate to downhole steam generators.

2. Description of the Related Art

There are extensive viscous hydrocarbon reservoirs throughout the world. These reservoirs contain a very viscous hydrocarbon, often called "bitumen," "tar," "heavy oil," or "ultra heavy oil," (collectively referred to herein as "heavy oil") which typically has viscosities in the range from 100 to over 1,000,000 centipoise. The high viscosity makes it difficult and expensive to recover the hydrocarbon.

Each oil reservoir is unique and responds differently to the variety of methods employed to recover the hydrocarbons therein. Generally, heating the heavy oil in situ to lower the viscosity has been employed. Normally reservoirs as viscous as these would be produced with methods such as cyclic steam stimulation (CSS), steam drive (Drive), and steam assisted gravity drainage (SAGD), where steam is injected from the surface into the reservoir to heat the oil and reduce its viscosity enough for production. However, some of these viscous hydrocarbon reservoirs are located under cold tundra or permafrost layers that may extend as deep as 1800 feet. Steam cannot be injected though these layers because the heat could potentially expand the permafrost, causing wellbore stability issues and significant environmental problems with melting permafrost.

Additionally, the current methods of producing heavy oil reservoirs face other limitations. One such problem is wellbore heat loss of the steam, as the steam travels from the surface to the reservoir. This problem is worsened as the depth of the reservoir increases. Similarly, the quality of steam available for injection into the reservoir also decreases with increasing depth, and the steam quality available downhole at the point of injection is much lower than that generated at the surface. This situation lowers the energy efficiency of the oil recovery process.

To address the shortcomings of injecting steam from the surface, the use of downhole steam generators (DHSG) has been used. DHSGs provide the ability to heat steam downhole, prior to injection into the reservoir. DHSGs, however, also present numerous challenges, including excessive temperatures, corrosion issues, and combustion instabilities. These challenges often result in material failures and thermal instabilities and inefficiencies.

Therefore, there is a continuous need for new and improved downhole steam generation systems and methods of recovering heavy oil using downhole steam generation.

SUMMARY OF THE INVENTION

Embodiments of the invention relate to downhole steam generator systems. In one embodiment, a downhole steam generator (DHSG) includes a burner head, a combustion sleeve, a vaporization sleeve, and a support/protection sleeve. The burner head may have a sudden expansion region with one or more injectors. The combustion sleeve may be a water-cooled liner having one or more water injection arrangements. The DHSG may be configured to acoustically isolate the various fluid flow streams that are directed to the DHSG. The components of the DHSG may be optimized to assist in the recovery of hydrocarbons from different types of reservoirs.

BRIEF DESCRIPTION OF THE DRAWINGS

FIGS. 15-43 illustrates chart, graphs, and/or examples of various operational characteristics of embodiments of the system and their components.

DETAILED DESCRIPTION

Figure 1:
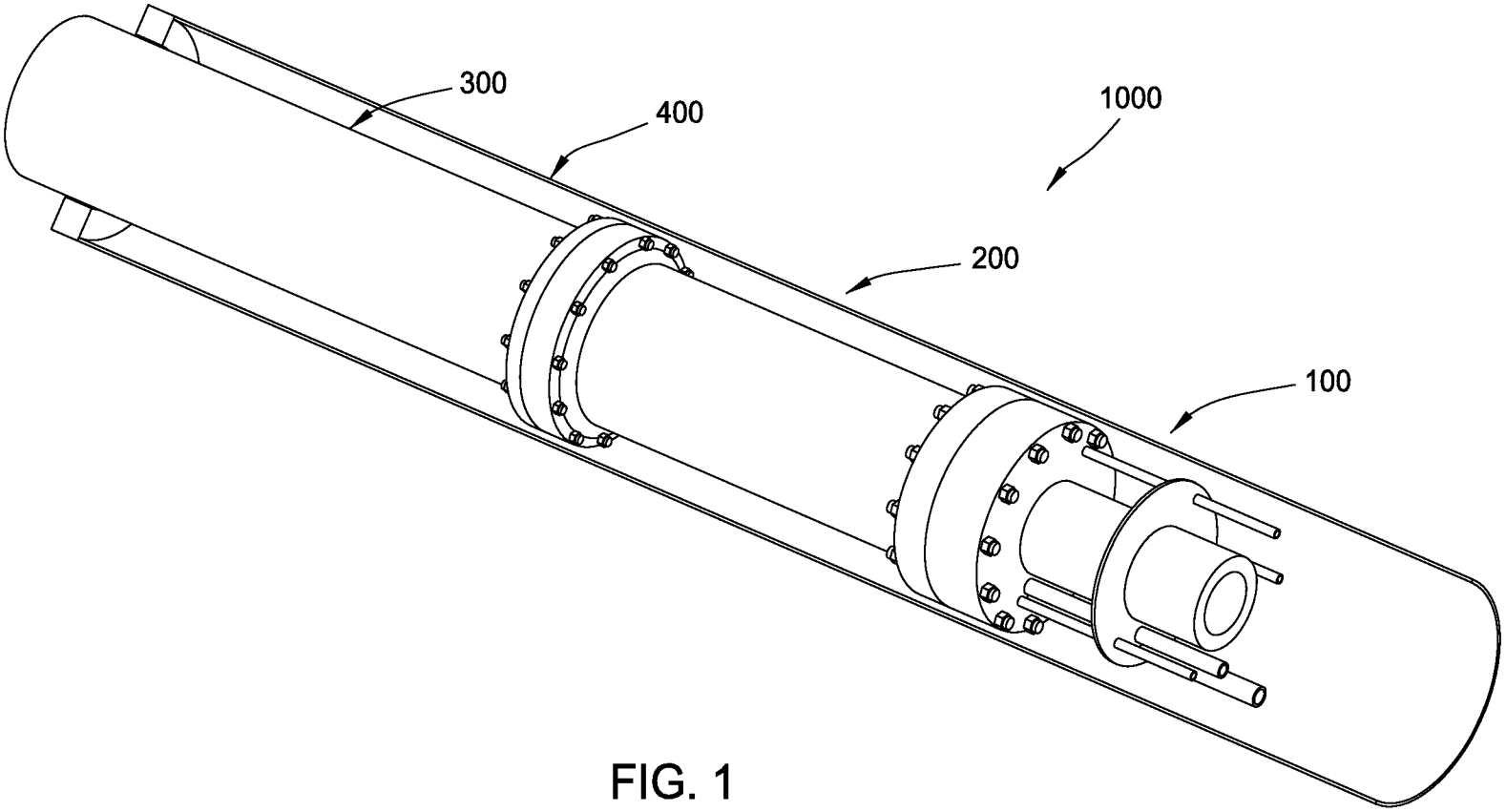
FIG. 1 illustrates a downhole steam generator system.
Figure 2:
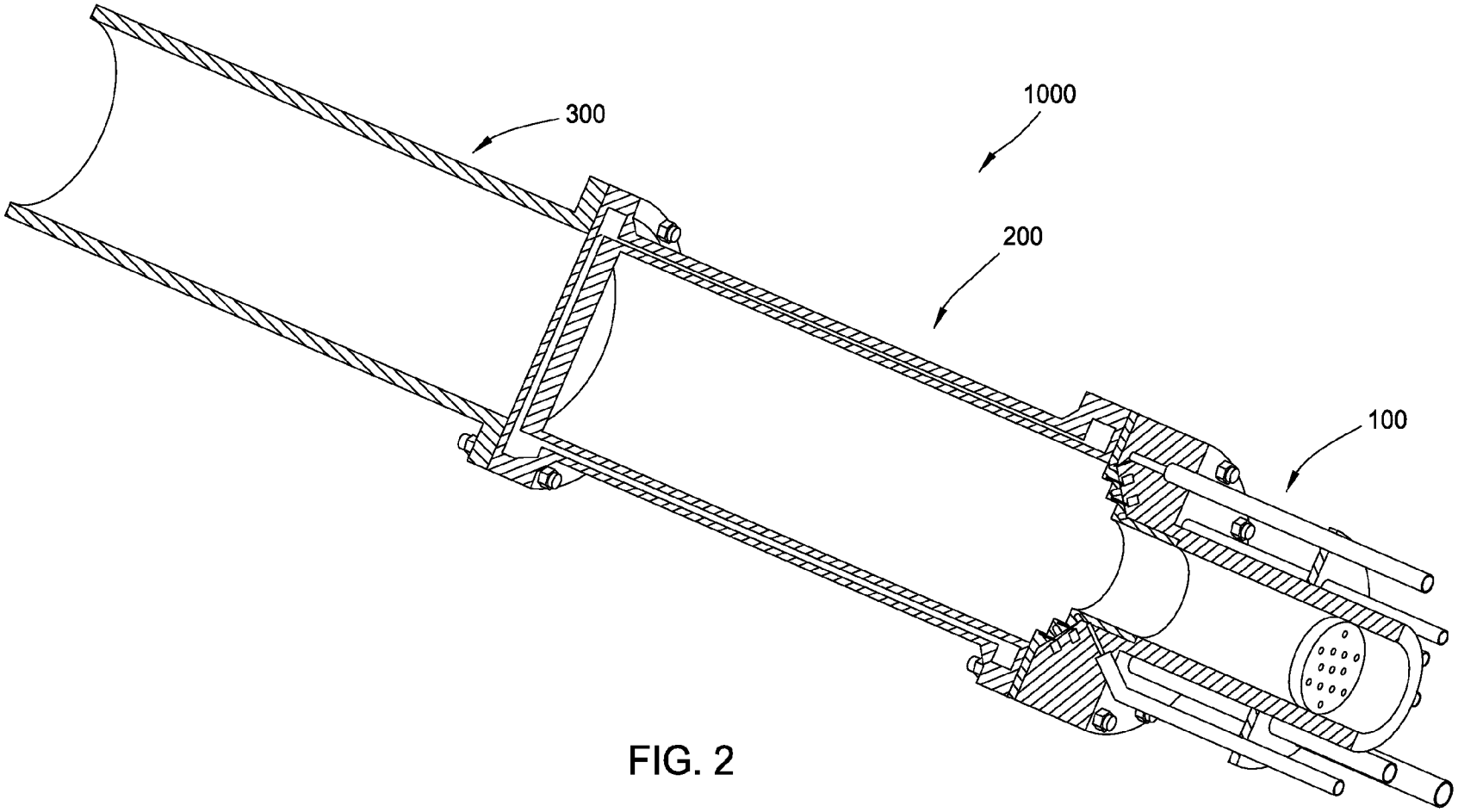
FIG. 2 illustrates a cross sectional view of the downhole steam generator system.

FIGS. 1 and 2 illustrate a downhole steam generation system 1000. Although described herein as a "steam" generation system, the system 1000 may be used to generate any type heated liquid, gas, or liquid-gas mixture. The system 1000 includes a burner head assembly 100, a liner assembly 200, a vaporization sleeve 300, and a support sleeve 400. Burner head assembly 100 is coupled to the upper end of liner assembly 200, and the vaporization sleeve 300 is coupled to the lower end of liner assembly 200. The support sleeve 400 is coupled to the vaporization sleeve 300 and may be operable to support and lower the system 1000 into a wellbore on a work string. The components may be coupled together by a bolt and flange connection, a threaded connection, a welded connection, or other connection mechanisms known in the art. One or more fuels, oxidants, coolants, diluents, solvents, and combinations thereof may be supplied to the system 1000 to generate a fluid mixture for injection into one or more hydrocarbon-bearing reservoirs. The system 1000 may be used to recover hydrocarbons from light oil, heavy oil, partially depleted, fully depleted, virgin, and tar-sand type reservoirs.

Figure 3:
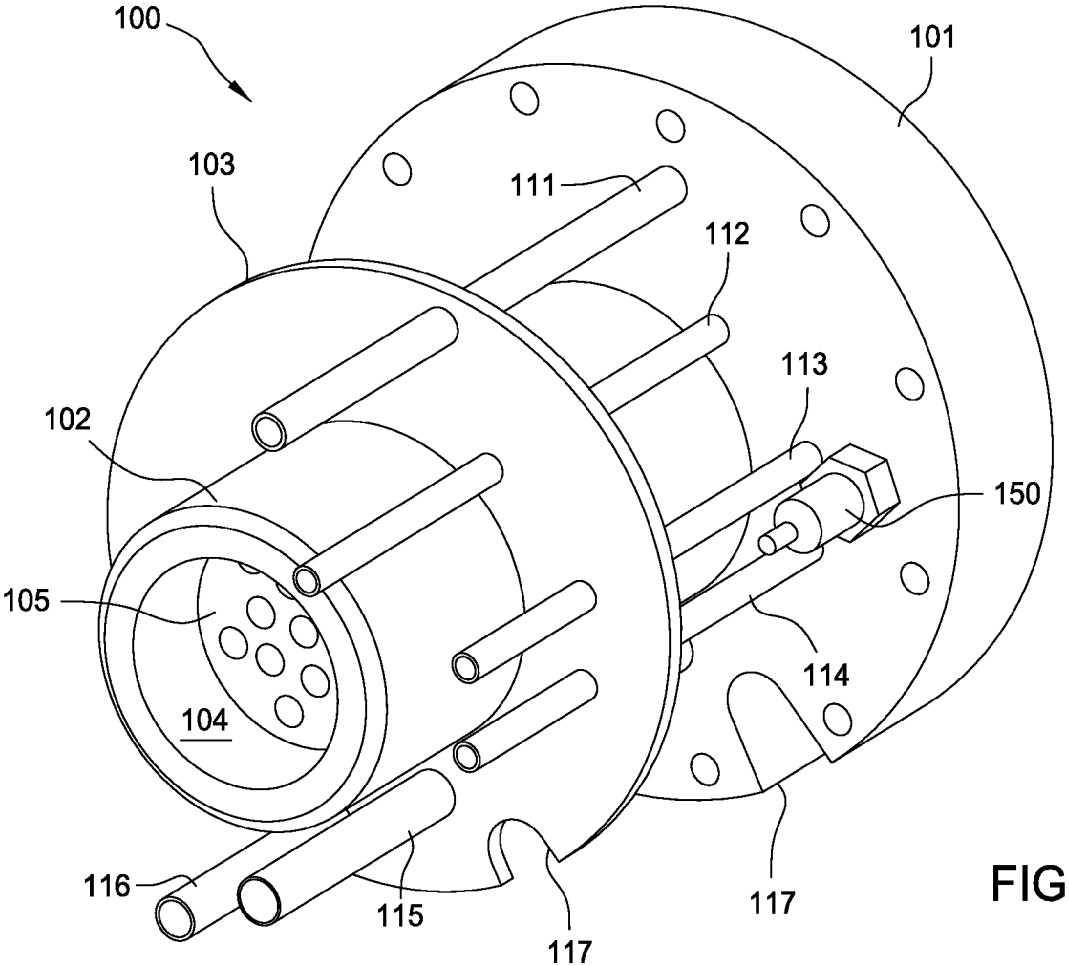
FIG. 3 illustrates a burner head assembly of the system.
Figure 4:
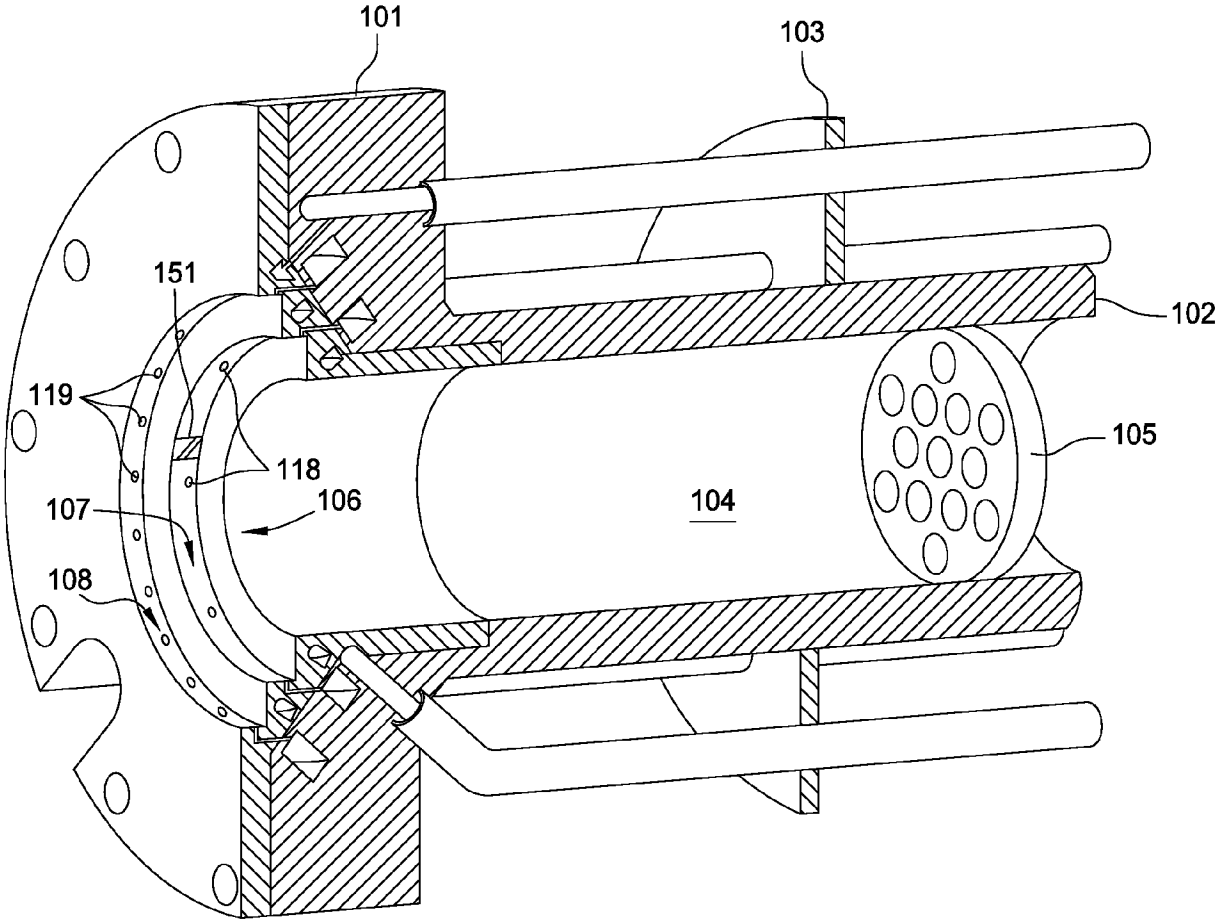
FIGS. 4, 5, and 6 illustrate cross sectional views of the burner head assembly.

FIGS. 3 and 4 illustrate the burner head assembly (combustor) 100. The burner head assembly 100 may be operable with an "attached flame" configuration, a "lifted flame" configuration, or some combination of the two configurations. An attached flame configuration generally results in hardware heating from convection and radiation, typically includes axisymmetric sudden expansion, v-gutters, trapped vortex cavities, and other geometrical arrangements, and is resistant to blow-off caused by high fluid velocities. An attached flame configuration may be preferable for use when a large range of operating parameters is required for the system 1000, when thermal losses from hot gas to the hardware are negligible or desired, and when cooling fluid is available. A lifted flame configuration generally results in hardware heating by radiation, and typically includes swirlers, cups, doublets/triplets, and other geometrical arrangements. A lifted flame configuration may be preferable for use when discrete design points across an operating envelope are required, where fuel injection velocity can be controlled by multiple manifolds or a variable geometry, where high temperature gas is a primary objective, and/or where cooling fluid is unavailable or limited.

The burner head assembly 100 includes a cylindrical body having a lower portion 101 and an upper portion 102. The lower portion 101 may be in the form of a flange for connection with the liner assembly 200. The upper portion 102 includes a central bore 104 for supplying fluid, such as an oxidant, to the system 1000. A damping plate 105, comprising a cylindrical body having one or more flow paths formed through the body, may be disposed in the central bore 104 to acoustically isolate fluid flow to the system 1000. One or more fluid lines 111-116 may be coupled to the burner head assembly 100 for supplying various fluids to the system 1000. A support ring 103 is coupled to both the upper portion 102 and the fluid lines 111-116 to structurally support the fluid lines during operation. An igniter 150 is coupled to the lower portion 101 to ignite the fluid mixtures supplied to the burner head assembly 100. One or more recesses or cutaways 117 may be provided in the support ring 103 and the lower portion 101 to support a fluid line that couples to the liner assembly 200 as further described below.

The central bore 104 intersects a sudden expansion region 106, which is formed along the inner surface of the lower portion 101. The sudden expansion region 106 may include one or more increases in the inner diameter of the lower portion 101 relative to the inner diameter of the central bore 104. Each increase in the inner diameter of the lower portion 101 is defined as an "injection step". As illustrated in FIG. 4, the burner head assembly 100 includes a first (inner) injection step 107 and a second (outer) injection step 108. The diameter of the first injection step 107 is greater than the diameter of the central bore 104, while the diameter of the second injection step 108 is greater than the first injection step 107. The sudden change in diameters at the exit of the central bore 104 creates a turbulent flow or trapped vortex, flame-holding region which enhances mixing of fluids in the sudden expansion region 106, which may provide a more complete combustion of the fluids. The sudden expansion region 106 may thus increase flame stability, control flame shape, increase combustion efficiency, and support emission control.

The first and second injection steps 107, 108 may each have one or more injectors (nozzles) 118, 119, respectively, that include fluid paths or channels formed through the lower portion 101 of the body of the burner head assembly 100. The injectors 118, 119 are configured to inject fluid, such as a fuel, into the burner head assembly 100 in a direction normal (and/or at an angle) to fluid flow through the central bore 104. The injection of fluid normal to the fluid flow through the central bore may also help produce a stable flame in the system 1000. Fluid from the injectors 118, 119 may be injected into the fluid flow through the central bore 104 at any other angle or combination of angles configured to enhance flame stability. The first injection step 107 may include eight injectors 118, and the second injection step 108 may include sixteen injectors 119. The number, size, shape, and injection angle of the injectors 118, 119 may vary depending on the operational requirements of the system 1000.

Figure 5:
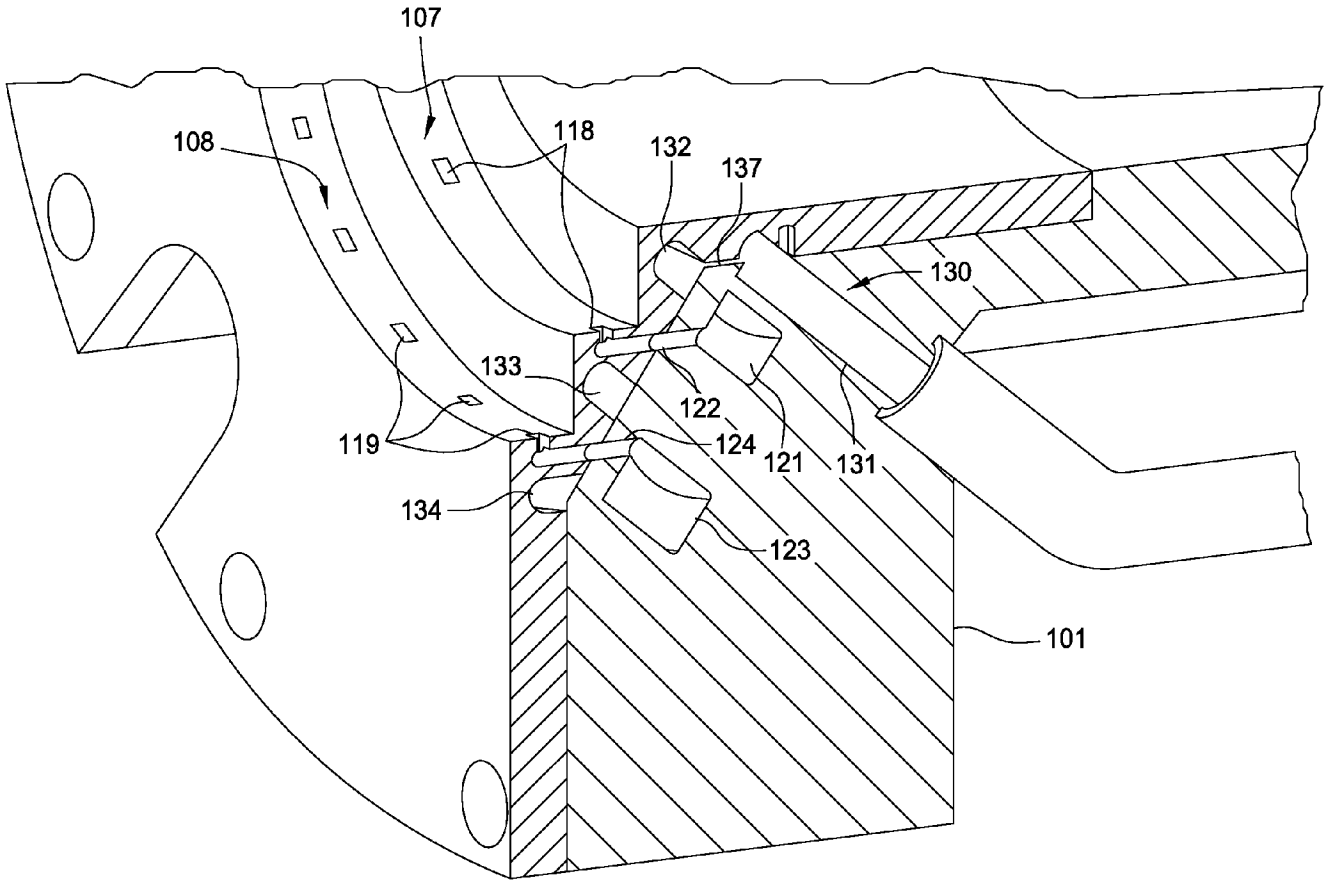
Figure 6:
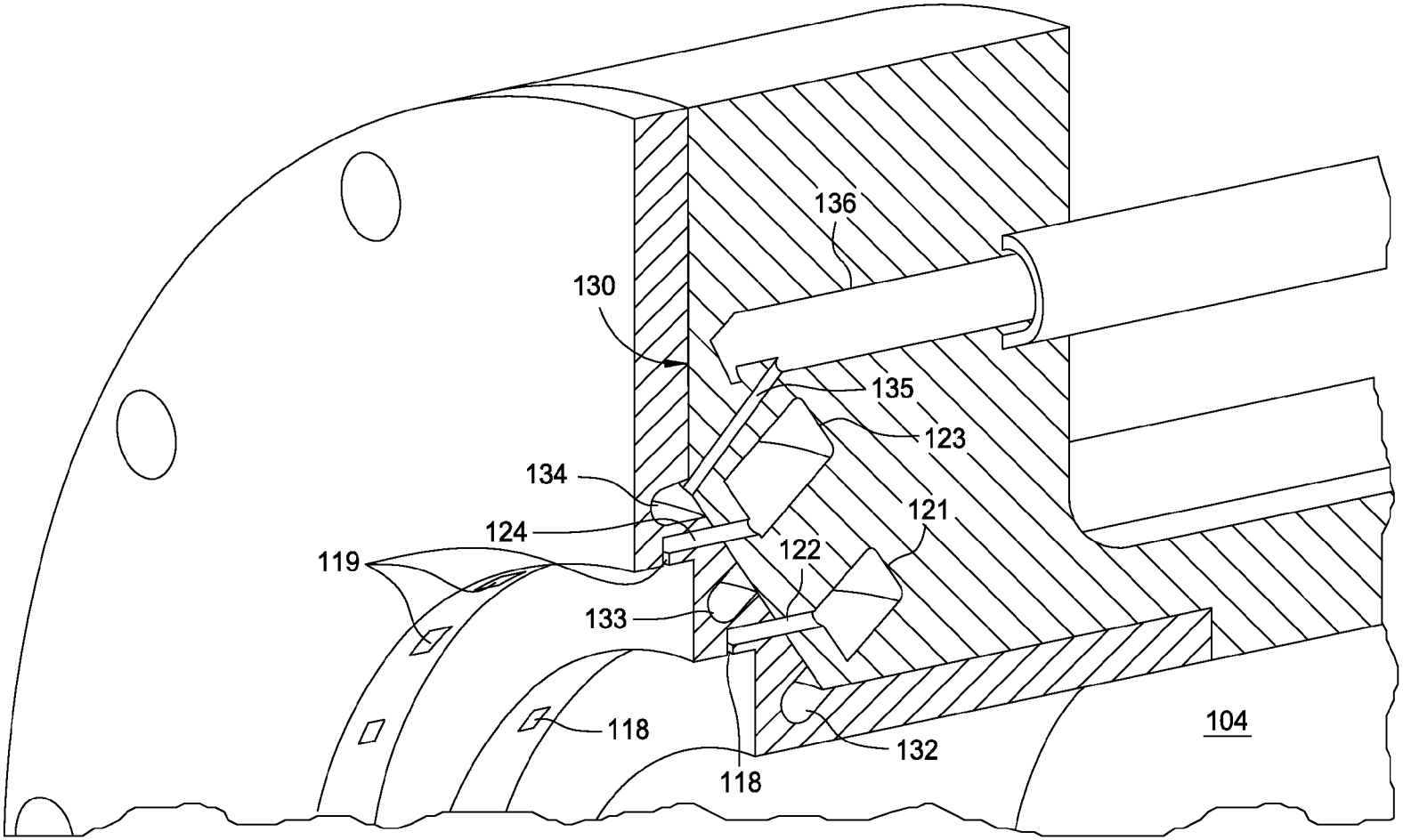

As illustrated in FIGS. 5 and 6, each injection step may also include a first injection manifold 121 and a second injection manifold 123. The first and second injection manifolds 121, 123 are in fluid communication with the injectors 118, 119, respectively. Each of the first and second injection manifolds 121, 123 may be in the form of a bore concentrically disposed through the body of the lower portion 101, between the inner diameter and the outer diameter of the lower portion 101. The first and second injection manifolds 121, 123 may direct fluid received from one or more of the fluid lines 111-116 (illustrated in FIG. 3) to each of the injectors 118, 119 by channels 122, 124 for injection into the sudden expansion region 106. A plurality of first and second injection manifolds 121, 123 may be provided to supply fluid to the injectors 118, 119. One or more additional injection manifolds may be provided to acoustically isolate fluid flow to the first and second injection manifolds 121, 123. All or portions of the burner head assembly 100 may be formed from or coated with a high temperature resistant or dispersion strengthened material, such as beryllium copper, monel, copper alloys, ceramics, etc.

The system 1000 may be configured so that the burner head assembly 100 can operate with fluid flow through the first injection step 107 only, the second injection step 108 only, or both the first and second injection steps 107, 108 simultaneously. During operation, flow through the first and/or second injection steps 107, 108 may be selectively adjusted in response to pressure, temperature, and/or flow rate changes of the system 1000 or based on the hydrocarbon-bearing reservoir characteristics, and/or to optimize flame shape, heat transfer, and combustion efficiency. The composition of fluids flowing through the first and second injection steps 107, 108 may also be selectively adjusted for the same reasons. A fluid (such as nitrogen or "reject" nitrogen provided from a pressure swing adsorption system) may be mixed with a fuel in various compositions and supplied through the burner head assembly 100 to control the operating parameters of the system 1000. Nitrogen, carbon dioxide, or other inert gases or diluents may be mixed with a fuel and supplied through the first and/or second injection steps 107, 108 to control pressure drop, flame temperature, flame stability, fluid flow rate, and/or acoustic noise developed within the system 1000, such as within the burner head assembly 100 and/or the liner assembly 200.

The system 1000 may have multiple injectors, such as injectors 118, 119 for injecting a fuel. The injectors may be selectively controlled for various operation sequences. The system 1000 may also have multiple injection steps, such as first and second injection steps 107, 108, that are operable alone or in combination with one or more of the other injection steps. Fluid flow through the injectors of each injection step may be adjusted, stopped, and/or started during operation of the system 1000. The injectors may provide a continuous operation over a range of fluid (fuel) flow rates. Discrete (steam) injection flow rates may be time-averaged to cover entire ranges of fluid flow rates.

An oxidant (oxidizer) may be supplied through the central bore 104 of the burner head assembly 100, and a fuel may be supplied through at least one of the first and second injection steps 107, 108 normal to the flow of the oxidant. The fuel and oxidant mixture may be ignited by the igniter 150 to generate a combustion flame and combustion products that are directed to the liner assembly 200. The combustion flame shape generated within the burner head assembly 100 and the liner assembly 200 may be tailored to control heat transfer to the walls of the burner head assembly 100 and the liner assembly 200 to avoid boiling of fluid and an entrained air release of bubbles.

As further illustrated in FIGS. 5 and 6, the burner head assembly 100 may include a cooling system 130 having an inlet 131 (illustrated in FIG. 5), an outlet 136 (illustrated in FIG. 6), and one or more fluid paths (passages) 132, 133, 134 in fluid communication with the inlet 131 and outlet 136. The cooling system 130 is configured to direct fluid, such as water, through the system 1000 to cool or control the temperature of burner head assembly 100 and in particular the first and second injection steps 107, 108. The fluid paths 132, 133, 134 may be concentrically formed through the body of the lower portion 101 and located next to the first and second injection steps 107, 108. Fluid may be supplied to the inlet 131 of the cooling system 130 by one of the fluid lines 111-116 (illustrated in FIG. 3), and directed to at least one of the fluid paths 132, 133, 134 via a channel 137 for example. The fluid may be circulated through the fluid paths 132, 133, 134 and directed to the outlet 136 via a channel 135 for example. The fluid may then be removed from the cooling system 130 by one of the fluid lines 111-116 that are in fluid communication with the outlet 136.

Fluid path 132 may be in direct fluid communication with fluid path 133 via a channel (similar to channel 137 for example), and fluid path 133 may be in direct fluid communication with fluid path 134 via a channel (also similar to channel 137 for example). Fluid may circulate through fluid path 132, then through fluid path 133, and finally through fluid path 134. Fluid may flow through fluid path 132 in a first direction, about at least one of the first and second injection steps 107, 108. Fluid may flow through fluid path 133 in a second direction (opposite the first direction), about at least one of the first and second injection steps 107, 108. Fluid may flow through fluid path 134 in the first direction, about at least one of the first and second injection steps 107, 108. In this manner, the fluid paths 132, 133, 134 may be arranged to alternately direct fluid flow through the burner head assembly 100 in a first direction about the first and second injection steps 107, 108, then in a second, opposite direction, and finally in a third direction similar to the first direction. Fluid supplied through the cooling system 130 may then be returned to the surface or may be directed to cool the liner assembly 200 as further described below. One or more of the fluid lines 111-116 (illustrated in FIG. 3) may be connected to the burner head assembly 100 to supply fluid to the cooling system 130. A portion of fluid flowing through the cooling system 130 may be injected from at least one of the fluid paths 132, 133, 134 into the sudden expansion region 106 and/or the liner assembly 200 to control flame temperature and/or enhance surface cooling of the burner head assembly 100 and/or the liner assembly 200.

Figure 7:
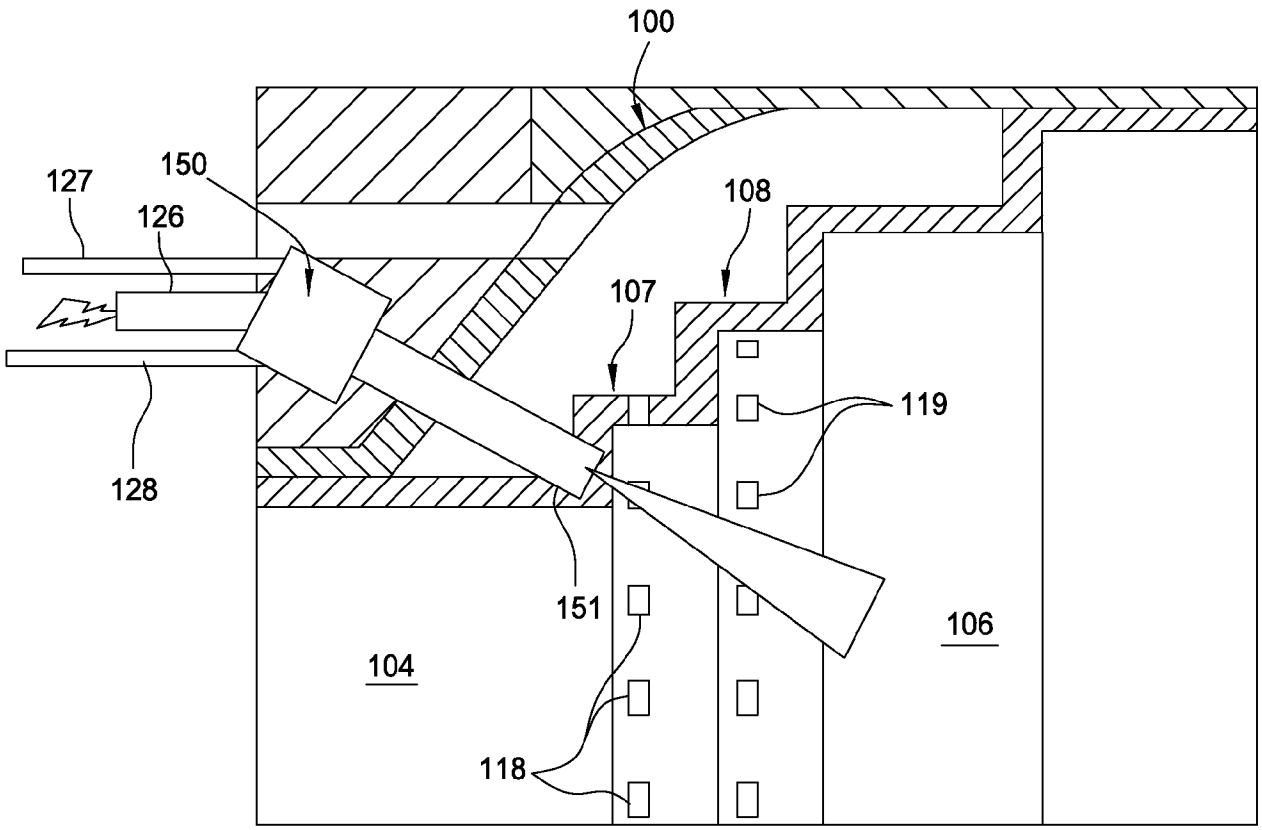
FIG. 7 illustrates an igniter for use with the system.

FIG. 7 illustrates the igniter 150. The igniter 150 is positioned next to the sudden expansion region 106 and configured to ignite the mixture of fluids supplied through the central bore 104 and the first and second injection steps 107, 108. An igniter port 151 may be disposed through the lower portion 101 of the burner head assembly 100 to support the igniter 150. The igniter 150 may include a glow plug through which a fuel 127 and an oxidizer 128 are directed (by fluid lines for example) and a power source 126 (such as an electrical line) is connected to initiate combustion within the system 1000. After ignition of the fluid mixture in the system 1000, the igniter 150 may be configured to permit continuous flow of the oxidizer 128 into the burner head assembly 100 to prevent back flow of hot combustion products or gases. The igniter 150 may be operated multiple times for multiple start-up and shut-down operations of the system 1000. Alternatively, the igniter 150 may include an igniter torch (methane/air/hot wire), a hydrogen/air torch, a hot wire, a glow plug, a spark plug, a methane/enriched air torch, and/or other similar ignition devices.

The system 1000 may be configured with one or more types of ignition arrangements. The system 1000 may include pyrophoric and detonation wave ignition methods. The system 1000 may include multiple igniters and ignition configurations. Gas flow may also be provided through one or more igniters, such as igniter 150, for cooling purposes. The burner head assembly 100 may have an integrated igniter, such as igniter 150, which is operable with the same oxidizer and fuel used for combustion in the system 1000.

The system 1000 may be operated using the igniter 150 separately as the burner mechanism, e.g. fuel and/or oxidant flowing through the igniter 150 alone, or simultaneously with fuel injected through the injectors 118, 119 and/or oxidant supplied through the central bore 104. In particular, the igniter 150 can be operated and supplied with reactants (e.g. fuel, oxidant, or both fuel and oxidant) flow rates that are less than a range of reactant flow rates typically flowed when flowing fuel through the injectors, such as injectors 118, 119, and flowing oxidant through the central bore 104 as further described herein, to generate 375-1500 bpd of steam and while maintaining stable combustion. In this "low flow" scenario, all or most of the fuel and/or oxidant are supplied to the igniter 150 through the fuel line 127 and/or the oxidizer line 128 (as illustrated in FIG. 7). Combustion of the fuel and oxidant may occur within or at least be initiated within the igniter 150, and all or most of the hot products of combustion (all or partially reacted) are injected into the sudden expansion region 106 and/or combustion chamber 210 via the igniter port 151. The fuel and oxidant may be supplied through the igniter 150 while no fluid is supplied or flowing through the injectors 118, 119 and/or the central bore 104. The fuel/oxidant mixture ratio can be adjusted to allow stoichiometric, fuel rich, or oxidant rich operation. Additional fluids, such as fuel, oxidant, water, etc., may flow through the various fluid passages of the system 1000, such as injectors 118, 119, central bore 104, fluid paths 206, etc., described herein during normal operation. This configuration assists in enabling stable operation at fuel/oxidant flow rates ranging from 0% to 10% of the fuel/oxidant flow rates used when operating the system 1000 at maximum flow through the injectors 118, 119 and the central bore 104 to generate at least the maximum 1500 bpd or more of steam, as further described herein. Thus the system 1000 may be used to generate 0-150 bpd of steam when operating in a "low flow" range and flowing fuel and oxidant through the igniter 150. This "low flow" capability may be desirable for initial steam injection for certain low permeability or virgin reservoirs, and/or to pre-condition reservoirs for later operation of the system 1000 at higher reactant flow rates.

Operation at an "intermediate flow" range of 10% to 25% of the fuel/oxidant flow rates used when operating the system 1000 at maximum flow through the injectors 118, 119 and the central bore 104 to generate at least the maximum steam, e.g. 1500 bpd or more of steam, is enabled by simultaneous operation of the igniter 150 (as described above) and the injection of fuel and/or oxidant through injectors, such as injectors 118, 119, and/or the central bore 104, respectively. In one example, operation of the igniter 150 in a fuel-rich mode (e.g. fuel with or without oxidant flowing through the igniter 150) may occur with oxidant flowing through the central bore 104 and without fuel flowing through the injectors 118, 119 such that the overall fuel/oxidant ratio is at the desired level. In another example, the igniter 150 may be operated in a fuel-lean mode (e.g. oxidant with or without fuel flowing through the igniter 150) with fuel flowing through the injectors 118, 119 and without oxidant flowing through the central bore 104. Thus the system 1000 may be used to generate 150-375 bpd of steam when operating in an "intermediate flow" range and flowing fuel and/or oxidant through the igniter 150 and/or through the injectors 118, 119 and/or the central bore 104.

When operating in the "low flow" and/or "intermediate flow" ranges, the injected water flow rate (including that used for cooling the system 1000) would correspondingly scale with the fuel and oxidant flow rates to generate the same quality of steam accounting for the water/steam produced as part of the reaction. A controller may be used to control the supply of fuel and/or oxidant to the igniter 150, and/or to the injectors 118, 119 and/or central bore 104. The controller may control one or more valves at the surface or downhole that open and close the supply of fuel and/or oxidant to the igniter 150 via the fuel and oxidizer lines 127, 128 (illustrated in FIG. 7). The same or another controller may control one or more valves at the surface or downhole that open and close the supply of fuel and/or oxidant to the injectors 118, 119, and/or the central bore 104 via one or more of the fluid lines 111-116 (illustrated in FIG. 3).

In one embodiment, the system 1000 may include two or more igniters 150 with igniter ports 151 positioned at different circumferential locations and positions relative to the central bore 104. The igniters 150 may be arranged symmetrically or non-symmetrically about the circumference of the central bore 104. The igniters 150 may be arranged such that the fuel and/or oxidant is injected at any angle relative to the longitudinal axis of the system 1000, including co-flow, counter-flow, and/or perpendicular to the flow through the system 1000. The angular position of each igniter 150 may be the same as or different than the angular position of at least one other igniter 150.

In one embodiment, a method of operation may include supplying fuel and oxidant through the igniter 150 via fuel and oxidizer lines 127, 128, respectively, and initiating combustion of the fuel and oxidant using the power source 126 of the igniter 150. The fuel and oxidant may be supplied through the igniter 150 while no fluid is supplied or flowing through the injectors 118, 119 and/or the central bore 104. The method may further include supplying the fuel and/or oxidant through the igniter 150 at a flow rate that is less than a range of flow rates used when supplying fuel and/or oxidant through the injectors 118, 119 and central bore 104 to generate 375-1500 bpd of steam, while still maintaining stable combustion. For example, the flow rates of the fuel and/or oxidant through the igniter 150 may range from 0% to 10%, 0% to 25%, or 10% to 25% of the maximum flow rates (as described herein) of the fuel and/or oxidant when flowing through the injectors 118, 119 and the central bore 104 to generate at least the maximum 1500 bpd or more of steam. The method may further comprise injecting the heated combustion products into the sudden expansion region 106 and/or the combustion chamber 210, and injecting one or more fluids, such as water, into the heated combustion products to generate steam and/or another heated fluid mixture. The method may further comprise injecting the steam, heated fluid mixture, and/or heated combustion products into a reservoir. The method may further comprise generating 0-150 bpd of steam when flowing fuel and oxidant through the igniter 150. The method may further comprise generating 150-375 bpd of steam when flowing fuel and/or oxidant through the igniter 150, and/or through the injectors 118, 119, and/or through the central bore 104.

Figure 8:
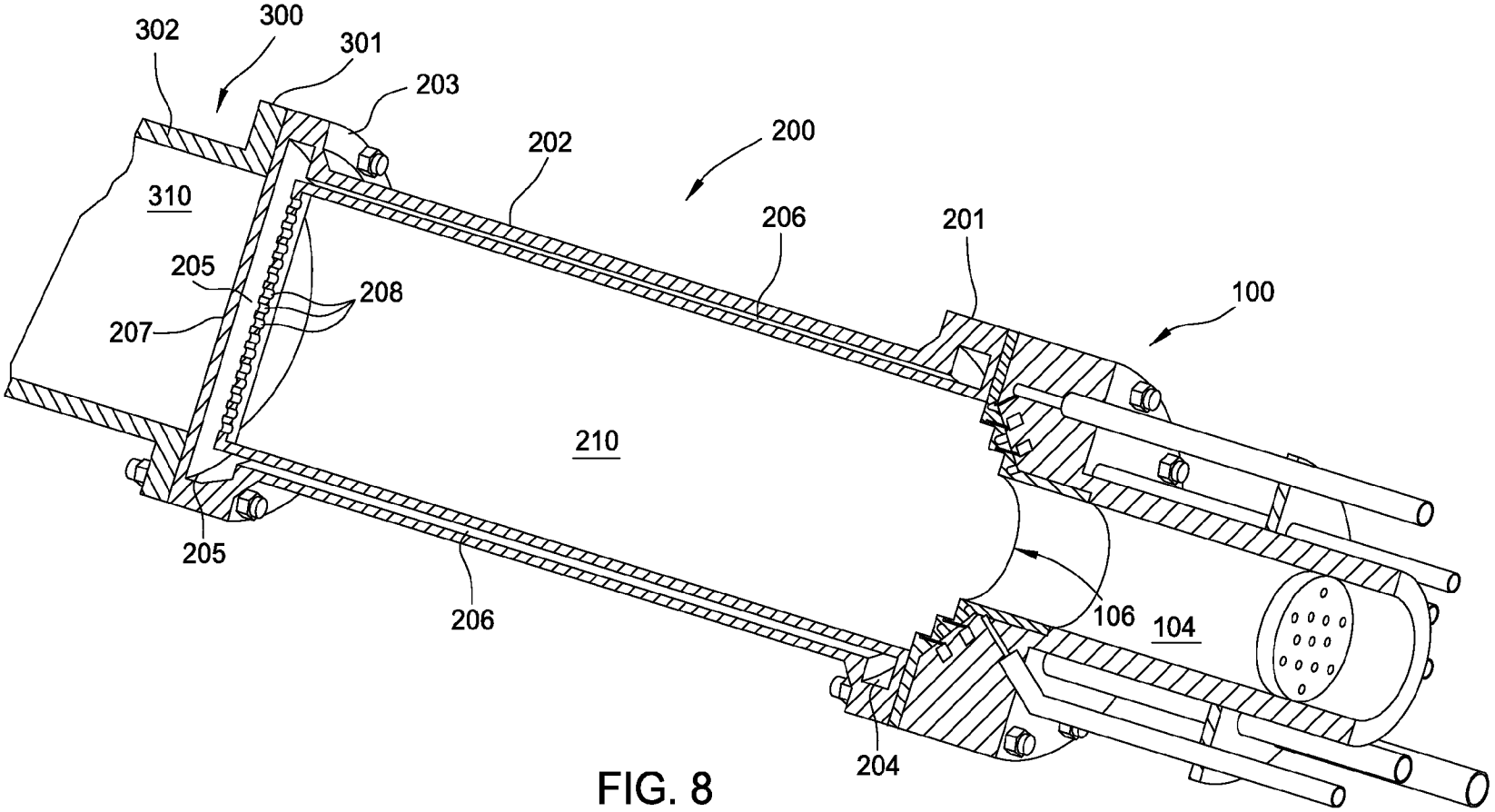
FIG. 8 illustrates a cross sectional view of a liner assembly of the system.

FIG. 8 illustrates the liner assembly 200 connected to the burner head assembly 100. The liner assembly 200 may comprise a tubular body having an upper portion 201, a middle portion 202, and a lower portion 203. The inner surface of the liner assembly 200 defines a combustion chamber 210. The upper and lower portions 201, 203 may be in the form of a flange for connection to the burner head assembly 100 and the vaporization sleeve 300, respectively. The upper and lower portions 201, 203 may include first (inlet) and second (outlet) manifolds 204, 205, respectively, that are in the form of a bore concentrically disposed through the body of the upper and lower portions 201, 203 between the inner diameter and the outer diameter of the upper and lower portions 101, 203. The first and second manifolds 204, 205 are in fluid communication with each other by one or more fluid paths 206 disposed through the body of the middle portion 202. Fluid, such as water, may be supplied to the first manifold 204 by one or more fluid lines (such as fluid lines 111-116 described above), and then directed through the fluid paths 206 to the second manifold 205. The fluid flow through the fluid paths 206 surrounding the combustion chamber 210 may be arranged to cool and maintain the combustion chamber 210 wall temperatures within an acceptable operating range. The first manifold 204 may be in fluid communication with and adapted to receive fluid from at least one of the fluid paths 132, 133, 134, the inlet 131 (illustrated in FIG. 5), and the outlet 136 (illustrated in FIG. 6) of the cooling system 130 of the burner head assembly 100 described above.

Figure 9:
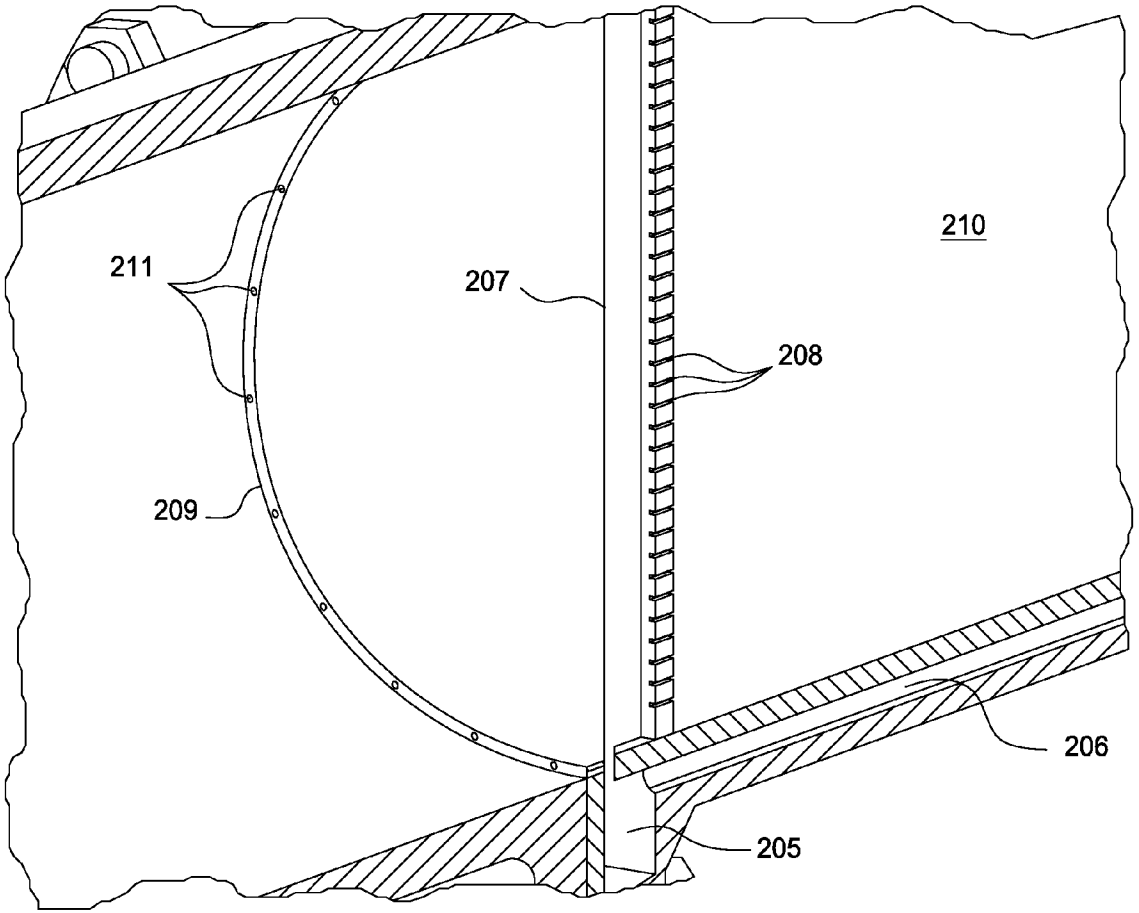
FIGS. 9-13 illustrate cross sectional views of a fluid injection strut and a fluid injection system.
Figure 10:
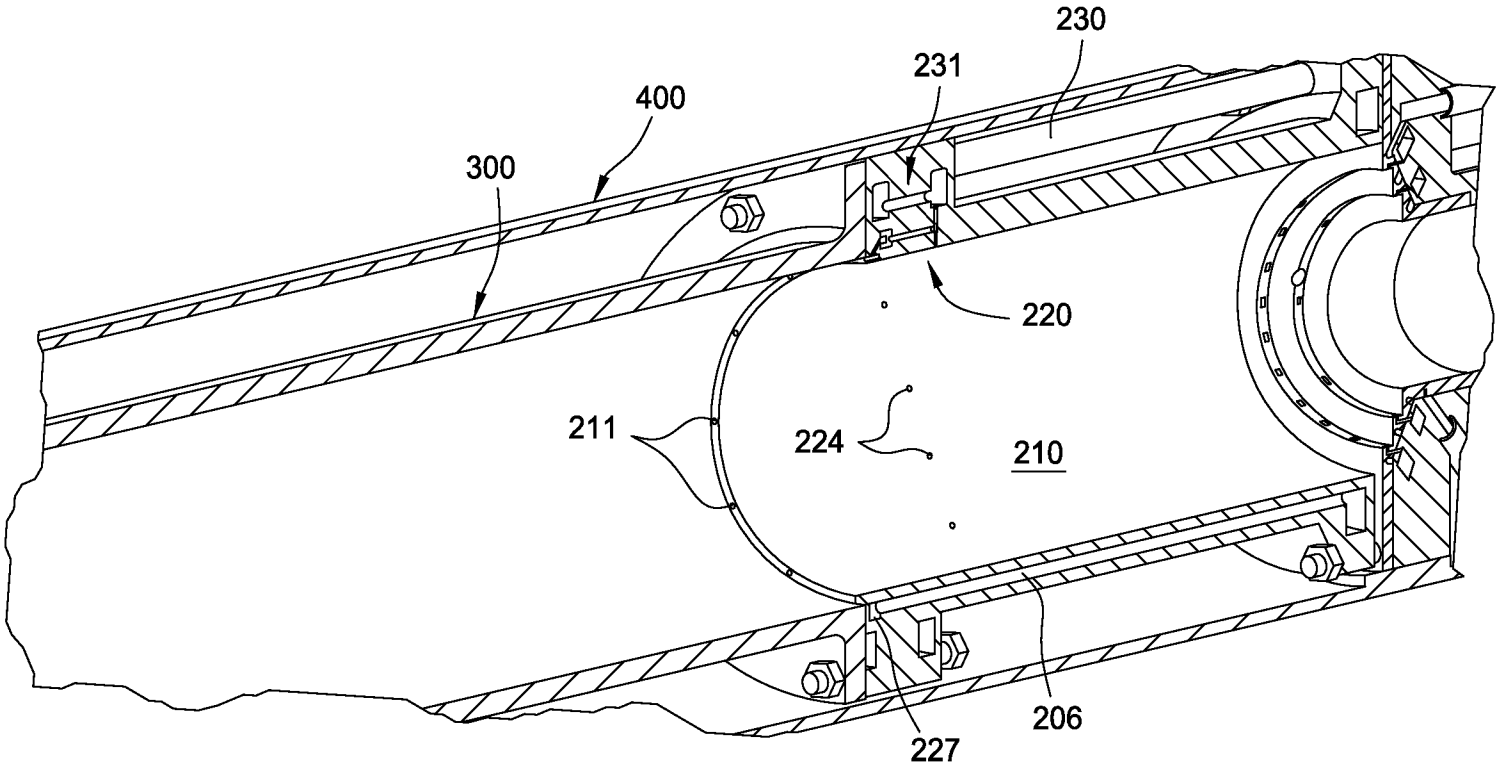
Figure 11:
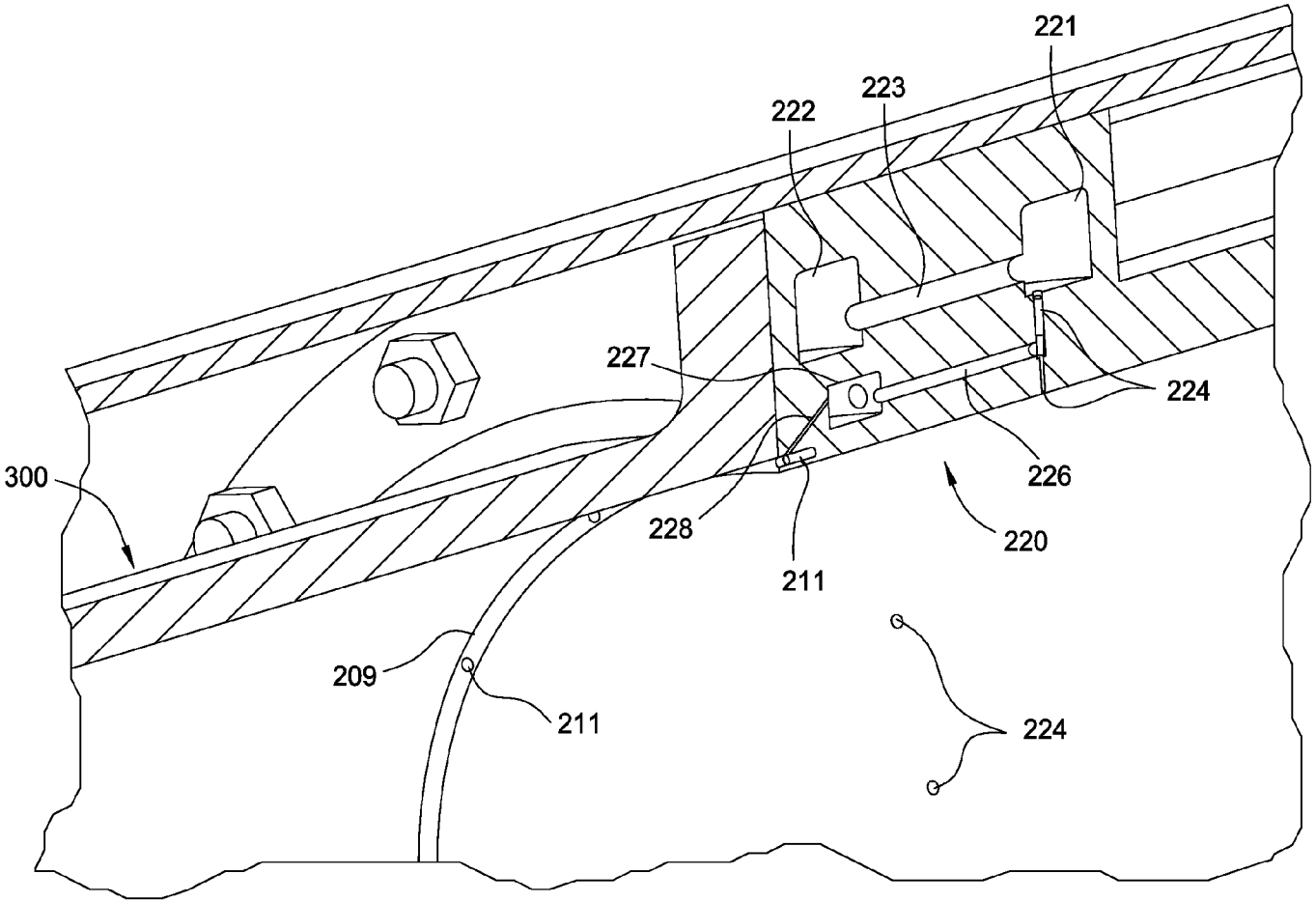
Figure 12:
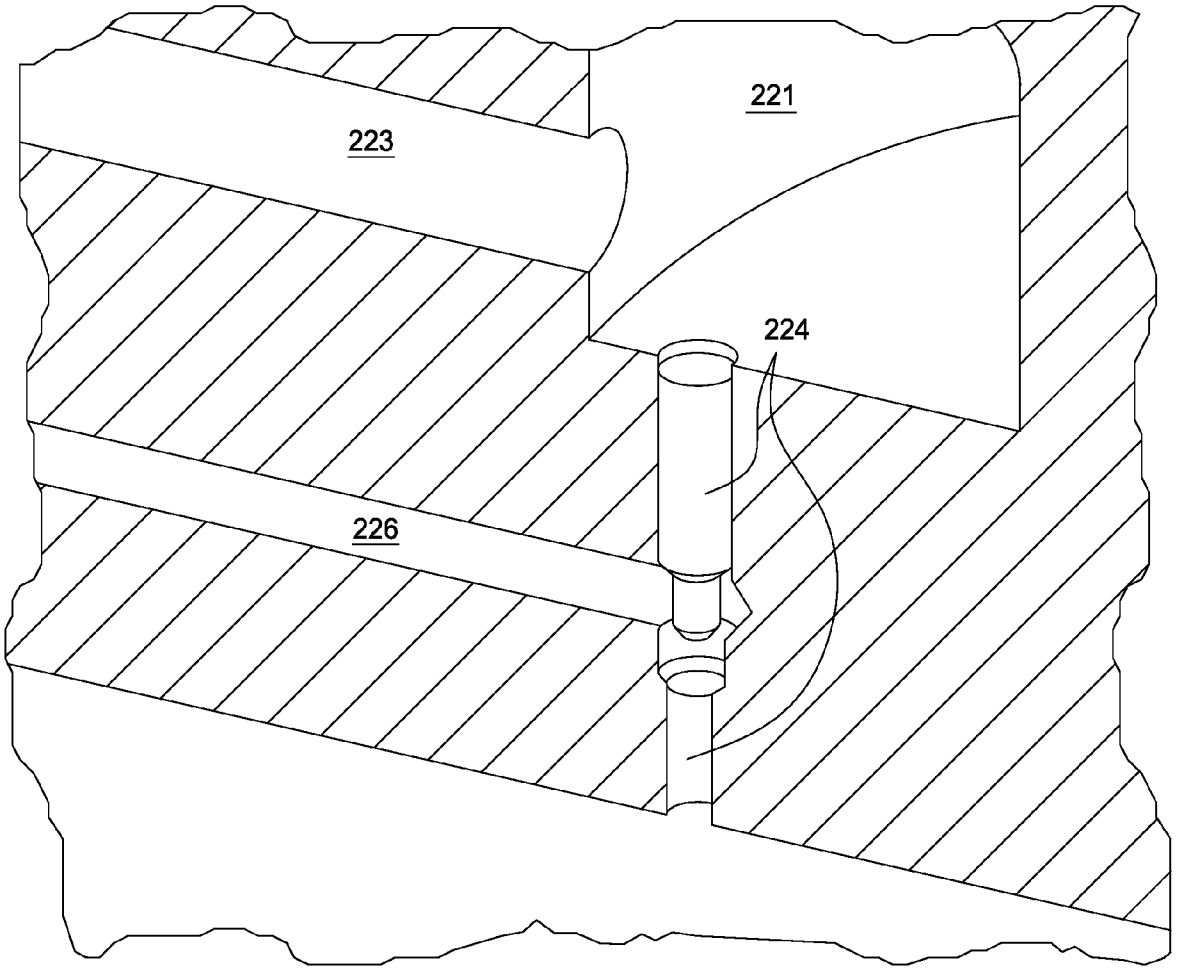
Figure 13:
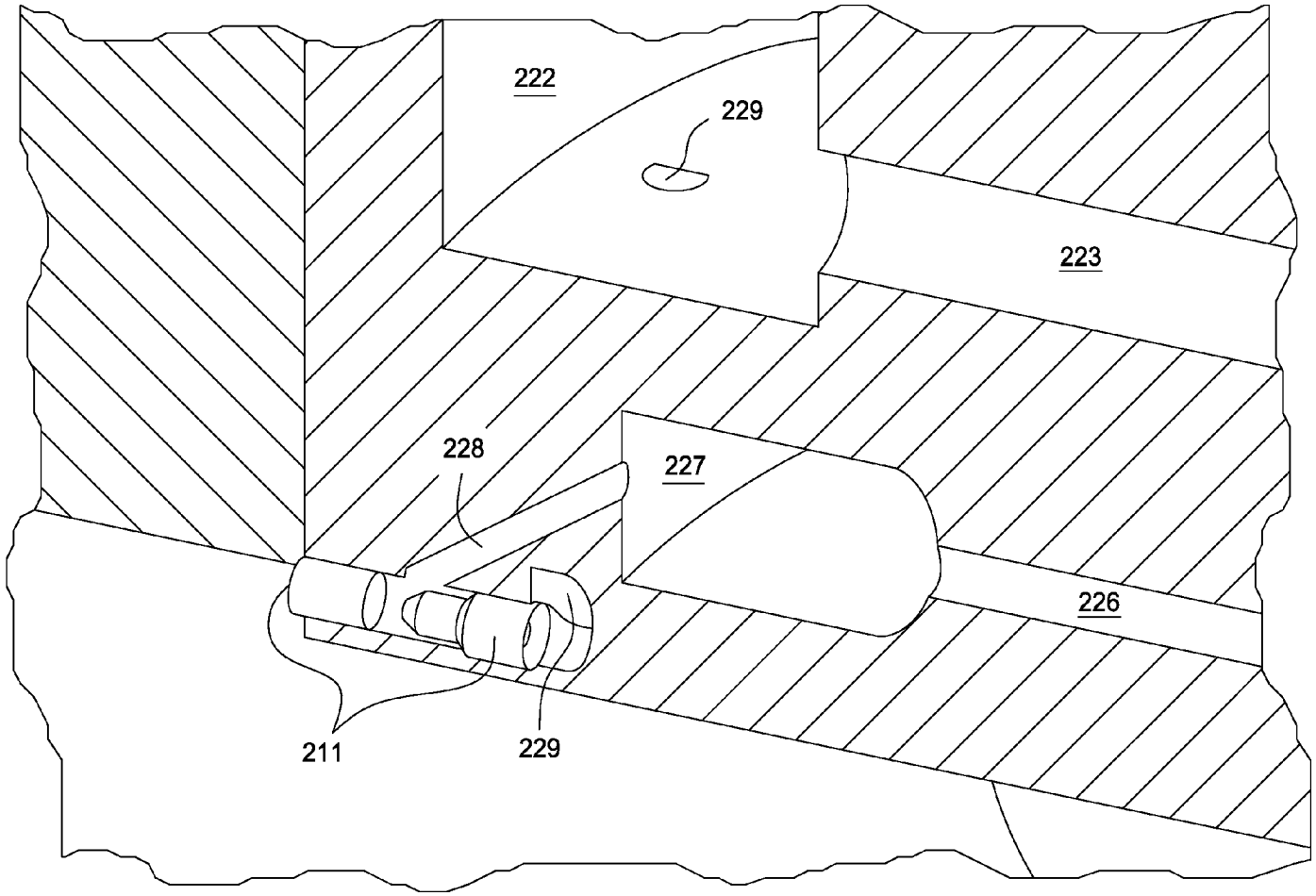

As illustrated in FIGS. 8 and 9, the liner assembly 200 may further include a fluid injection strut 207 or other structural member coupled to the body of the liner assembly 200 and having a plurality of injectors (nozzles) 208 that are in fluid communication with the second manifold 205 for injection of fluid in a direction upstream into the combustion chamber 210, downstream out of the combustion chamber 210, and/or normal to the combustion chamber 210 flow. The fluid may comprise water and/or other similar cooling fluids. The fluid injection strut 207 may be configured to inject atomized droplets of the fluid into heated combustion products generated in the combustion chamber 210 (by the burner head assembly 100) to evaporate the fluid droplets and thereby form a heated vapor, such as steam for example. The liner assembly 200 may be configured for direct injection of fluid, including atomized fluid droplets, into the combustion chamber 210 from at least one of the first and second manifolds 204, 205, the fluid paths 206, and the body or wall of the upper, lower, and/or middle portions. The direct injection of fluid may occur at one or more locations along the length of the liner assembly 200. The liner assembly 200 may be configured for direct injection of fluid from at least one of the first and second manifolds 204, 205, the fluid paths 206, and the body or wall of the upper, lower, and/or middle portions, in combination with the fluid injection strut 207. The liner assembly 200 may also include a fluid injection step 209 having a plurality of nozzles 211 to cool the initial portion of the vaporization sleeve 300 below the combustion chamber 210 by injecting a thin layer of fluid or a film of fluid across the inner surfaces of the vaporization sleeve 300.

The injection strut 207 may be located at various positions within the liner assembly 200 and may be shaped in various forms for fluid injection. The injection strut 207 may also be fashioned as an acoustic damper and configured to acoustically isolate fluid flow to the combustion chamber 210 (similar to the damping plate 105 in the burner head assembly 100). The body of the liner assembly 100 and/or the injection strut 207 may be in fluid communication with a source of pressurized gas, such as air supplied to the system 1000, to assist fluid flow through the liner assembly 200 and fluid injection through the injection strut 207. The system 1000 may be provided with additional cooling mechanisms to control the combustion chamber 210 temperature or flame temperature, such as direct coolant injection through the upper portion 201 of the liner assembly 200, transpiration or film cooling of the liner assembly 200 along its length, and/or ceramic coatings may be applied to reduce metal temperatures.

FIGS. 10-13 illustrate a fluid injection system 220 (such as a gas-assisted water injection system) of the liner assembly 200. The fluid injection system 200 may be used independent of or in combination with the fluid injection strut 207 described above. A fluid (feed) line 230 (such as fluid lines 111-116 illustrated in FIG. 3) may be coupled to the liner assembly 200 for supplying a fluid, such as a gas, to a gas manifold 231 disposed in the lower portion 203 of the body to assist in the injection of atomized fluid, such as water, into the combustion chamber 210. The fluid line 230 may extend directly from the surface or may be in fluid communication with one or more of the fluid lines 111-116 that supply an oxidant to the system 1000, so that the gas comprises a portion of the oxidant supplied to the system 1000. The gas manifold 231 may have an upper plenum 221 in communication with a lower plenum 222 by a fluid path 223. The upper plenum 221 may direct the gas into the combustion chamber 210 through nozzles 224, which forms an eductor pump to assist in atomization of the water. Water from the fluid paths 206 may flow into a water manifold 227 (such as second manifold 205 described above) and through a fluid path 226 into the gas stream formed by the nozzles 224. The water may then be injected into the combustion chamber 210 as atomized droplets in a direction normal to the flow of combustion products in the combustion chamber 210. The lower plenum 222 may direct the gas into the vaporization sleeve 300 via a fluid path 229 that communicates the gas to nozzles 211, which also forms an eductor pump to assist in atomization of the water. Water may flow from the water manifold 227 through a fluid path 228 into the gas stream formed by the nozzles 211 and be injected into the vaporization sleeve 300 in a direction parallel to the flow of the combustion products exiting the combustion chamber 210. The water droplets may be injected along the longitudinal length of the vaporization sleeve 300 inner wall to film cool the inner wall and to help control the temperature of the combustion products. The fluid injection system 220 thus forms a two-stage water injection arrangement that may be located within and/or relative to the body of the liner assembly 200 and the vaporization sleeve 300 in a number of ways to optimize fluid (water) injection into the system 1000.

The system 1000 may include a twin fluid atomizing nozzle arrangement that is configured to mix or combine a gas stream and a water stream in various ways to form an atomized droplet spray that is injected into the combustion chamber 210 and/or the vaporization sleeve 300. A fluid such as water may be supplied through the fluid (feed) line 230, alone or in combination with a gas, at a high pressure to the point that the water is vaporized upon injection into the combustion chamber 210. The high pressure water may be cavitated through an orifice as it is injected into the combustion chamber 210.

The system 1000 may be configured with one or more water injection arrangements, such as the injection strut 207 and/or the injection system 220, to inject water into the burner head assembly 100, the combustion chamber 210, and/or the vaporization sleeve 300. The system 1000 may include a water injection strut connected to the body of the liner assembly 200. Water injection into the combustion chamber 210 may be provided directly from the combustion chamber wall. Injection of the water may occur at one or more locations, such as the tail end and/or the head end of the combustion chamber 210. The system 1000 may include a gas-assisted water injection arrangement. The water injection arrangements may be tailored to provide surface/wall protection and to control evaporation length. Optimization of the water injection arrangements may provide wetting of the inner surfaces/walls, achieve vaporization to a design point in a limited length, and avoid quenching of combustion flame. Fluid droplets may be injected into the combustion chamber 210 (using the fluid injection strut 207 and/or the fluid injection system 220 for example) such that the fluid droplet sizes are within a range of about 20 microns to about 100 microns, about 100 microns to about 200-300 microns, about 200-300 microns to about 500-600 microns, and about 500-600 microns to about 800 microns or greater. About 30% of the fluid droplets may have a size of about 20 microns, about 45% of the fluid droplets may have a size of about 200 microns, and about 25% of the fluid droplets may have a size of about 800 microns.

The vaporization sleeve 300 comprises a cylindrical body having an upper portion 301 in the form of a flange for connection to the liner assembly 200, and a middle or lower portion 301 that defines a vaporization chamber 310. The fluids and combustion products from the liner assembly 200 may be directed into the upper end and out of the lower end of the vaporization chamber 310 for injection into a reservoir. The vaporization chamber 310 may be of sufficient length to allow for complete combustion and/or vaporization of the fuel, oxidant, water, steam, and/or other fluids injected into the combustion chamber 210 and/or the vaporization sleeve 300 prior to injection into a reservoir.

The support sleeve 400 comprises a cylindrical body that surrounds or houses the burner head assembly 100, the liner assembly 200, and the vaporization sleeve 300 for protection from the surrounding downhole environment. The support sleeve 400 may be configured to protect the components of the system 1000 from any loads generated by its connection to other downhole devices, such as packers or umbilical connections, etc. The support sleeve 400 may protect the system 1000 components from structural damage that may be caused by thermal expansion of the system 1000 itself or the other downhole devices. The support sleeve 400 (or exoskeleton) may be configured to transmit umbilical loads around the system 1000 to a packer or other sealing/anchoring element connected to the system 1000. The system 1000 may be configured to accommodate for thermal expansion of components that are part of, connected to, or located next to the system 1000. Finally, a variety of alternative fuel, oxidant, diluent, water, and/or gas injection methods may be employed with the system 1000.

Figure 14A:
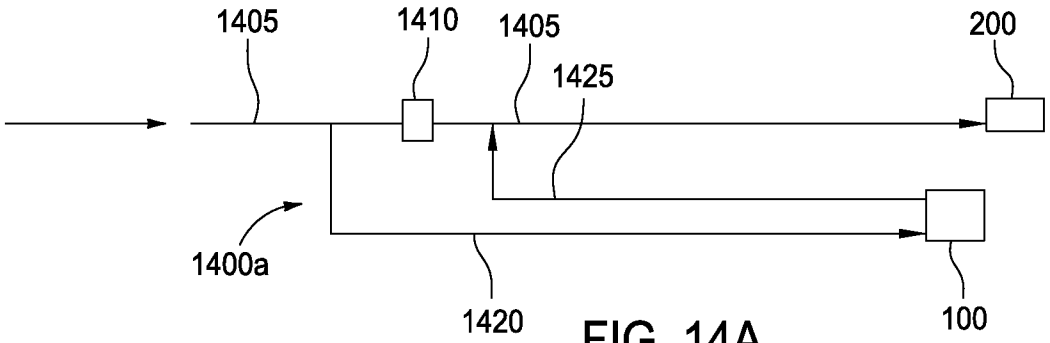
FIGS. 14A and 14B illustrate a fluid line assembly for use with the system.

FIG. 14A illustrates a fluid line assembly 1400A for supplying a fluid, such as water to the system 1000. The fluid line assembly 1400A includes a first fluid line 1405 and a second fluid line 1420 for directing a portion of the fluid in the fluid line 1405 to the cooling system 130 of the burner head assembly 100. The second fluid line 1420 is in communication with the inlet 131 of the cooling system 130. Downstream of the second fluid line 1420 is a pressure control device 1410, such as a fixed orifice, to balance the pressure drop in the first fluid line 1405. A third fluid line 1425 is in communication with the outlet 136 of the cooling system 130 and arranged to direct fluid back into the first fluid line 1405. The first fluid line 1405 may also supply fluid to the liner assembly 200, and in particular to the first manifold 204, the second manifold 205, the fluid injection strut 207, the fluid injection system 220, and/or directly into the combustion chamber 210 through a wall of the liner assembly 200. Multiple fluid lines can be used to provide fluid from the surface to the system 1000.

Figure 14B:
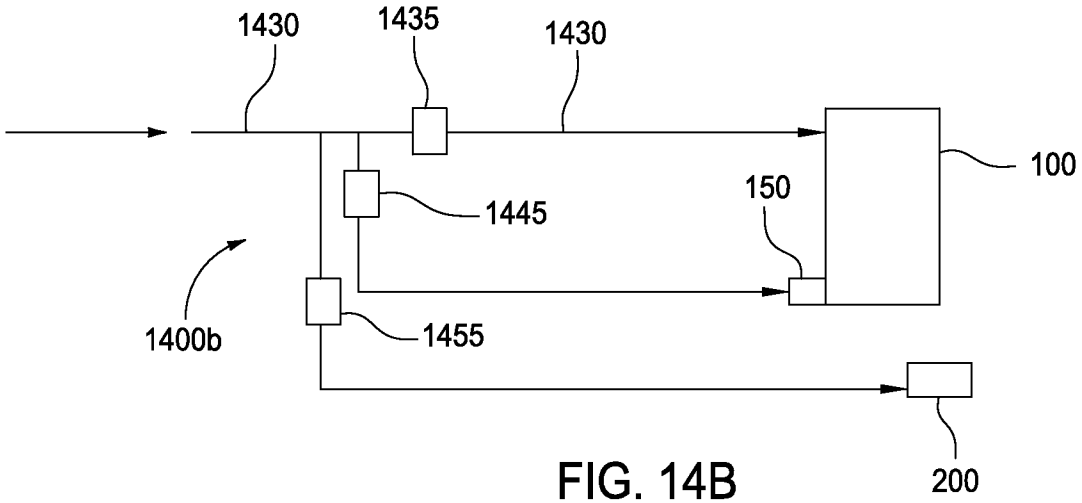

FIG. 14B illustrates a fluid line assembly 1400B for supplying a fluid, such as an oxidant (e.g. air or enriched air) to the system 1000. The fluid line assembly 1400B includes a first fluid line 1430 for supplying fluid to the central bore 104 of the burner head assembly 100. A second fluid line 1455 (such as fluid line 230 illustrated in FIG. 10) may direct a portion of the fluid in the fluid line 1430 to the fluid injection strut 207 and/or the fluid injection system 220 of the liner assembly 200. A third fluid line 1445 may also direct a portion of the fluid in the fluid line 1430 to the igniter 150 of the burner head assembly 100. One or more pressure control devices 1435, 1445, 1455, such as a fixed orifice, are coupled to the fluid lines to balance the pressure drop in the fluid lines to the system 1000. Multiple fluid lines can be used to provide fluid from the surface to the system 1000.

The system 1000 may be operated in a "flushing mode" to clean and prevent chemical, magnesium or calcium plugging of the various fluid (flow) paths in the system 1000 and/or the wellbore below the system 1000. One or more fluids may be supplied through the system 1000 to flush out or purge any material build up, such as coking, formed in the fluid lines, conduits, burner head assembly 100, liner assembly 200, vaporization sleeve 300, wellbore lining, and/or liner perforations.

The system 1000 may include one or more acoustic dampening features. The damping plate 105 may be located in the central bore 104 above or within the burner head assembly 100. A fluid (water) injection arrangement, such as the fluid (water) injection strut 207, may be used to acoustically isolate the combustion chamber 210 and the inner region of the vaporization sleeve 300. Nitrogen addition to the fuel may help maintain adequate pressure drop across the injectors 118, 119.

The fuel supplied to the system 1000 may be combined with one or more of the following gases: nitrogen, carbon dioxide, and gases that are non-reactive. The gas may be an inert gas. The addition of a non-reactive gas and/or inert gas with the fuel may increase flame stability when using either a "lifted flame" or "attached flame" design. The gas addition may also help maintain adequate pressure drops across the injectors 118, 119 and help maintain (fuel) injection velocity. As stated above, the gas addition may also mitigate the impact of combustion acoustics on the first and second (fuel) injection steps 107, 108 of the system 1000.

The oxidant supplied to the system 1000 may include one or more of the following gases: air, oxygen-enriched air, and oxygen mixed with an inert gas such as carbon dioxide. The system 1000 may be operable with a stoichiometric composition of oxygen or with a surplus of oxygen. The flame temperature of the system 1000 may be controlled via diluent injection. One or more diluents may be used to control flame temperature. The diluents may include water, excess oxygen, and inert gases including nitrogen, carbon dioxide, etc.

The burner head assembly 100 may be operable within an operating pressure range of about 300 psi to about 1500 psi, about 1800 psi, about 3000 psi, or greater. Water may be supplied to the system 1000 at a flow rate within a range of about 375 bpd (barrels per day) to about 1500 bpd or greater. The system 1000 may be operable to generate steam having a steam quality of about 0 percent to about 80 percent or up to 100 percent. The fuel supplied to the system 1000 may include natural gas, syngas, hydrogen, gasoline, diesel, kerosene, or other similar fuels. The oxidant supplied to the system 1000 may include air, enriched air (having about 35% oxygen), 95 percent pure oxygen, oxygen plus carbon dioxide, and/or oxygen plus other inert diluents. The exhaust gases injected into the reservoir using the system 1000 may include about 0.5 percent to about 5 percent excess oxygen. The system 1000 may be compatible with one or more packer devices of about 7 inch to about 7⅝ inch, to about 9⅝ inch sizes. The system 1000 may be dimensioned to fit within casing diameters of about 5½ inch, about 7 inch, about 7⅝ inch, and about 9⅝ inch sizes. The system 1000 may be about 8 feet in overall length. The system 1000 may be operable to generate about 1000 bpd, about 1500 bpd, and/or about 3000 bpd or greater of steam downhole. The system 1000 may be operable with a pressure turndown ratio of about 4:1, e.g. about 300 psi to about 1200 psi for example. The system 1000 may be operable with a flow rate turndown ratio of about 2:1, e.g. about 750 bpd to about 1500 bpd of steam for example. The system 1000 may include an operating life or maintenance period requirement of about 3 years or greater.

According to one method of operation, the system 1000 may be lowered into a first wellbore, such as an injection wellbore. The system 1000 may be secured in the wellbore by a securing device, such as a packer device. A fuel, an oxidant, and a fluid may be supplied to the system 1000 via one or more fluid lines and may be mixed within the burner head assembly 100. The oxidant is supplied through the central bore 104 into the sudden expansion region 106, and the fuel is injected into the sudden expansion region 106 via the injectors 118, 119 for mixture with the oxidant. The fuel and oxidant mixture may be ignited and combusted within the combustion chamber to generate one or more heated combustion products. Upon entering the sudden expansion region 106, the oxidant and/or fuel flow may form a vortex or turbulent flow that will enhance the mixing of the oxidant and fuel for a more complete combustion. The vortex or turbulent flow may also at least partially surround or enclose the combustion flame, which can assist in controlling or maintaining flame stability and size. The pressure, flow rate, and/or composition of the fuel and/or oxidant flow can be adjusted to control combustion. The fluid may be injected (in the form of atomized droplets for example) into the heated combustion products to form an exhaust gas. The fluid may include water, and the water may be vaporized by the heated combustion products to form steam in the exhaust gas. The fluid may include a gas, and the gas may be mixed and/or reacted with the heated combustion products to form the exhaust gas. The exhaust gas may be injected into a reservoir via the vaporization sleeve to heat, combust, upgrade, and/or reduce the viscosity of hydrocarbons within the reservoir. The hydrocarbons may then be recovered from a second wellbore, such as a production wellbore. The temperature and/or pressure within the reservoir may be controlled by controlling the injection of fluid and/or the production of fluid from the injection and/or production wellbores. For example, the injection rate of fluid into the reservoir may be greater than the production rate of fluid from the production wellbore. The system 1000 may be operable within any type of wellbore arrangements including one or more horizontal wells, multilateral wells, vertical wells, and/or inclined wells. The exhaust gas may comprise excess oxygen for in-situ combustion (oxidation) with the heated hydrocarbons in the reservoir. The combustion of the excess oxygen and the hydrocarbons may generate more heat within the reservoir to further heat the exhaust gas and the hydrocarbons in the reservoir, and/or to generate additional heated gas mixtures, such as with steam, within the reservoir.

Figure 15:
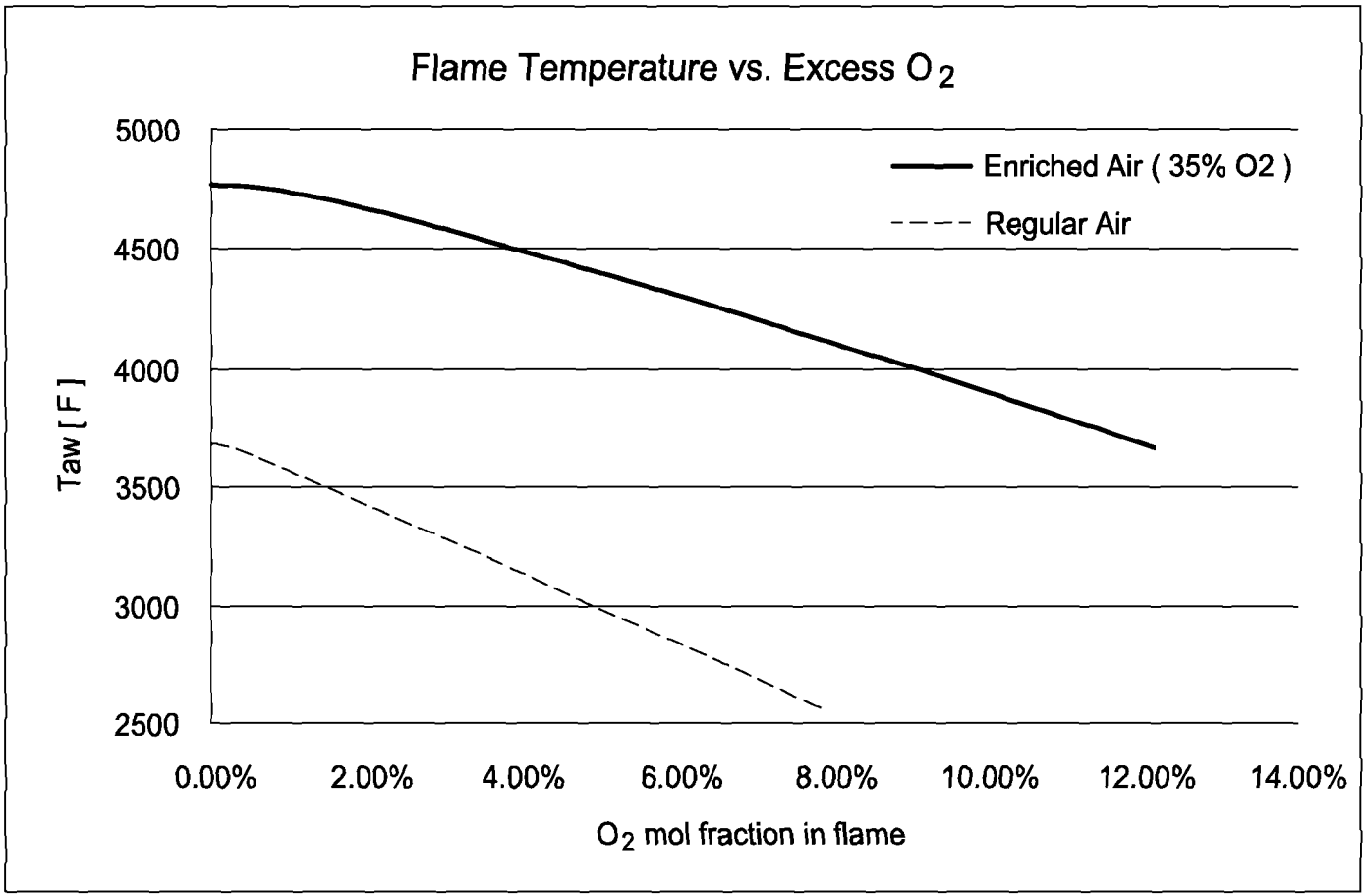

FIG. 15 shows a graph that illustrates adiabatic flame temperature (degrees Fahrenheit) versus excess oxygen (percent mole fraction in flame) during operation of the system 1000 using regular air and enriched air (having about 35 percent oxygen). As illustrated, the flame temperature decreases as the percentage of excess oxygen in the flame increases. As further illustrated, enriched air may be used to generate higher flame temperatures than regular air.

Figure 16:
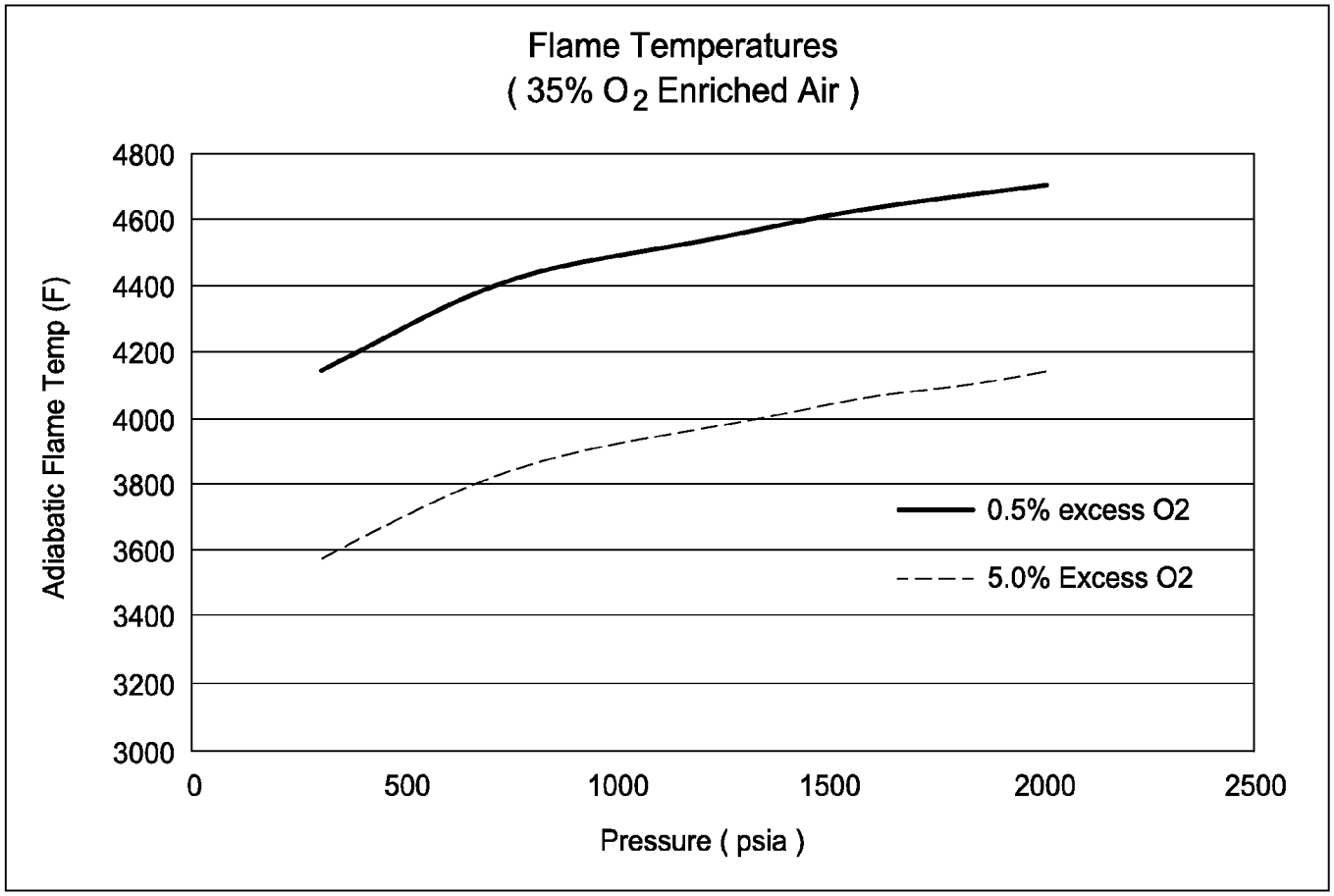

FIG. 16 shows a graph that illustrates adiabatic flame temperature (degrees Fahrenheit) versus pressure (psi) during operation of the system 1000 using enriched air (having about 35 percent oxygen) and a resultant flame content having about 0.5 percent excess oxygen and about 5.0 percent excess oxygen. As illustrated, the flame temperature increases as the pressure increases, and lesser amounts of excess oxygen in the combustion products increases flame temperatures.

FIGS. 17-20 illustrate examples of the operating characteristics of the system 1000 within various operational parameters, including the use of enriched air. FIGS. 17 and 19 illustrate examples of the system 1000 having a combustion chamber 210 (see FIG. 8) diameter of about 3.5 inches, and a 7 or 8⅝ inch thermal packer device having a packer inner diameter of about 3.068 inches. FIGS. 18 and 20 illustrate examples of the system 1000 having a combustion chamber 210 (see FIG. 8) diameter of about 3.5 inches, and a thermal packer device having a packer inner diameter of about 2.441 inches. The examples illustrate the system 1000, and in particular the burner head assembly 100 and/or combustion chamber 210, operating with a pressure at about 2000 psi, 1500 psi, 750 psi, and 300 psi. The examples further illustrate the system 1000 operating with a water (including steam) flow rate of 1500 bpd and 375 bpd.

Figure 21:
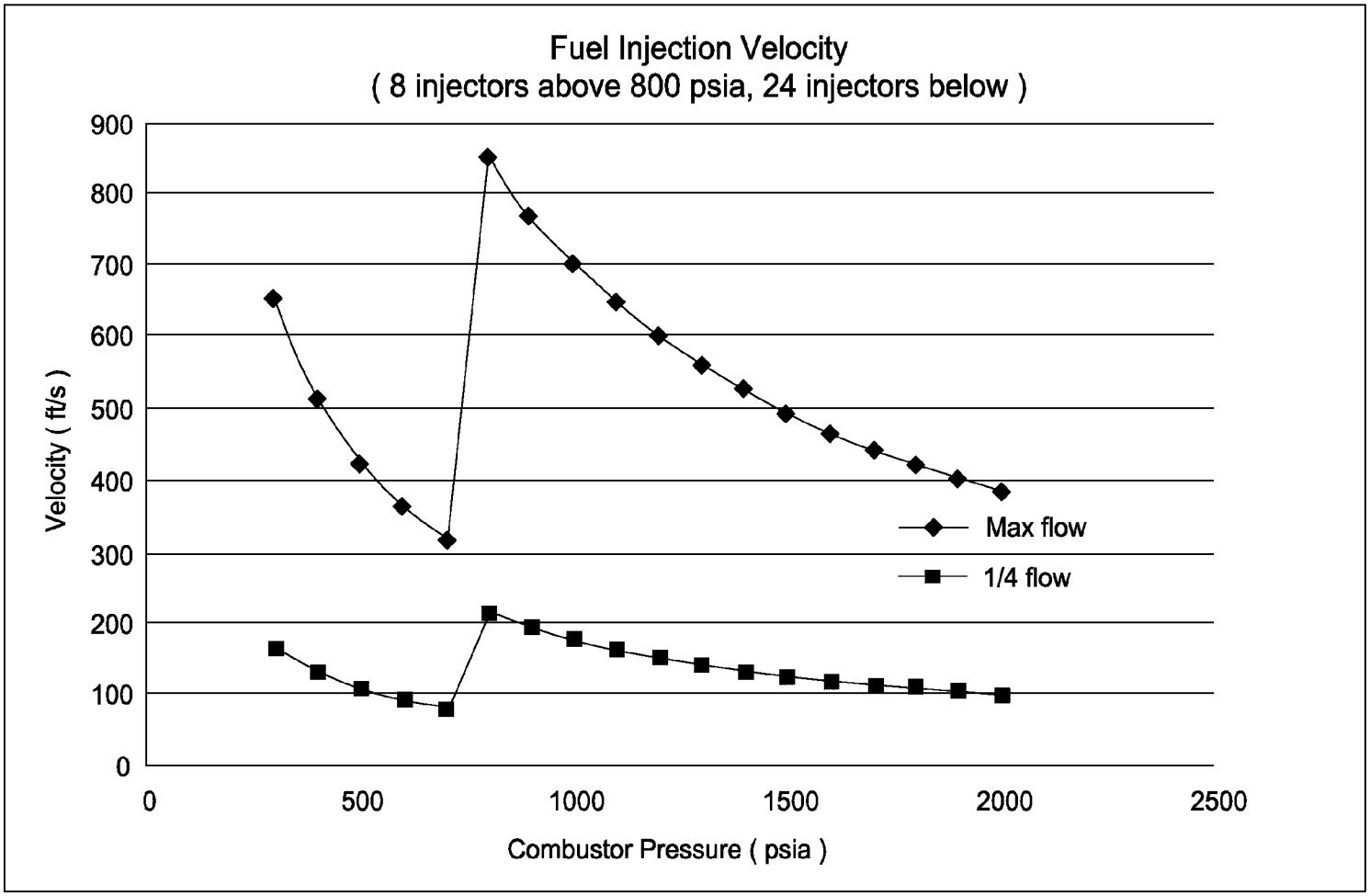

FIG. 21 shows a graph that illustrates fuel injection velocity (feet per second) versus pressure (psi) in the burner head assembly 100 and/or combustion chamber 210 during operation of the system 1000 at a maximum fuel injection flow rate (e.g. corresponding to that required to generate 1500 bpd of steam) and ¼ of the maximum fuel injection flow rate (e.g. corresponding to that required to generate 375 bpd of steam). In addition, at about 800 psi and below, 24 injectors (such as injectors 118, 119) were used to inject fuel into the system 1000, and above 800 psi, only 8 injectors (such as injectors 118) were used to inject fuel into the system 1000. As illustrated, the fuel injection velocity generally decreases as the pressure increases, and higher fuel injection velocities can be achieved at higher pressure with the use of only 8 injectors as compared to the use of 24 injectors.

Figures 22A, 22B:
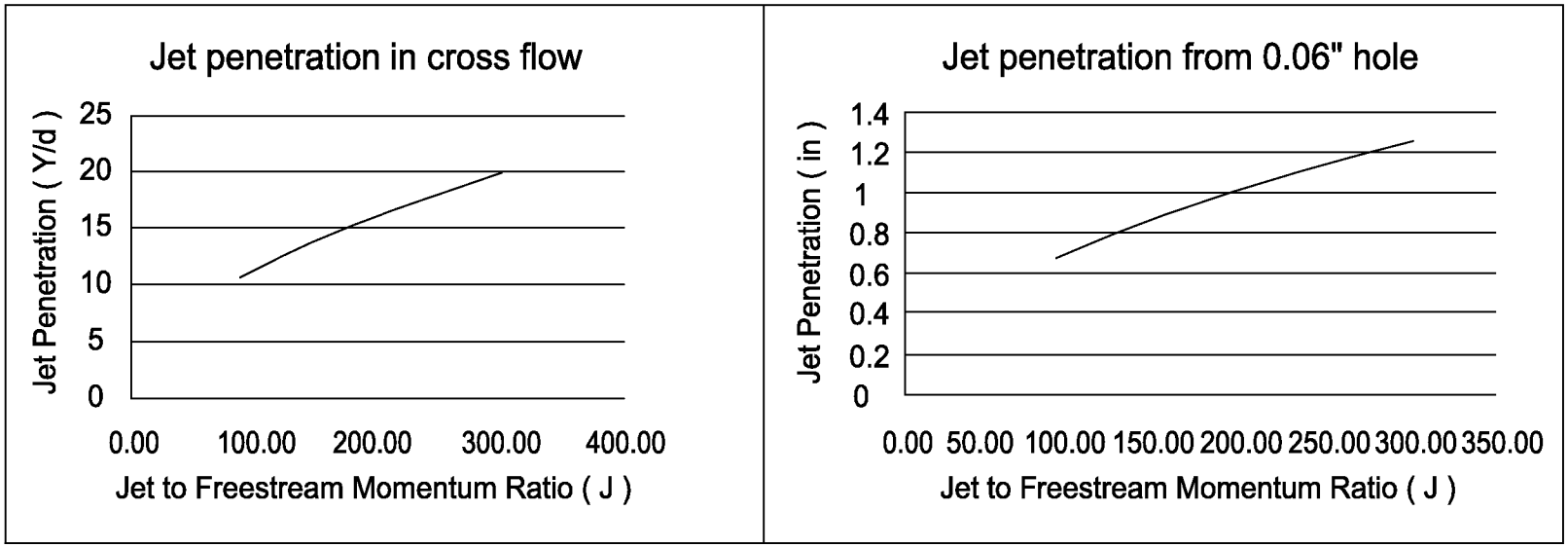

FIGS. 22A and 22B show graphs illustrating jet penetration in cross flow and from about a 0.06 inch injector (such as injectors 118, 119). Generally, jet penetration increases as the jet to free-stream momentum ratio increases.

Figure 23:
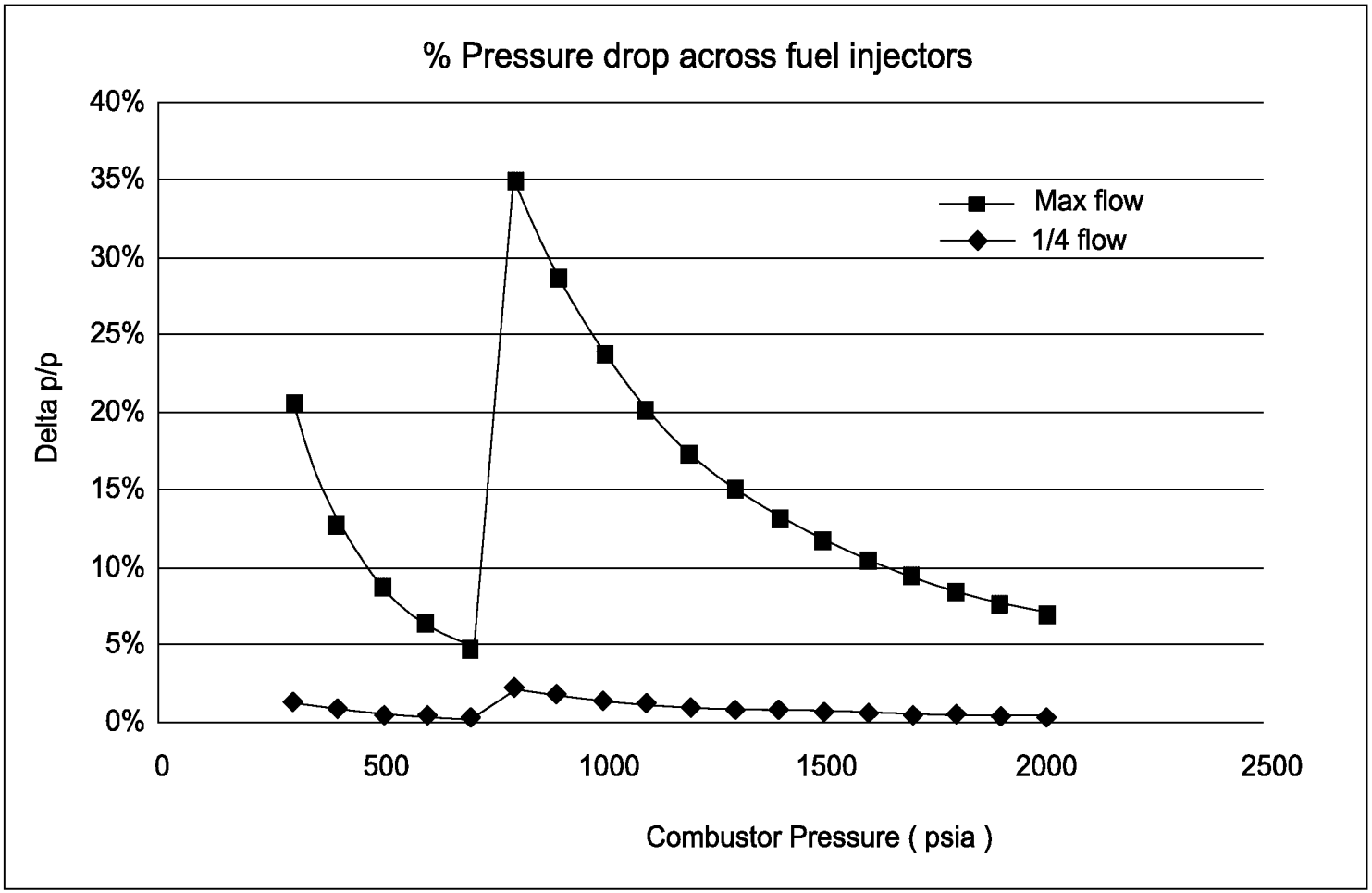

FIG. 23 shows a graph that illustrates percentage of pressure drop across the injections (such as injectors 118, 119) versus pressure (psi) in the burner head assembly 100 and/or combustion chamber 210 during operation of the system 1000 at a maximum fuel injection flow rate (e.g. corresponding to that required to generate 1500 bpd of steam) and ¼ of the maximum fuel injection flow rate (e.g. corresponding to that required to generate 375 bpd of steam). In addition, at about 800 psi and below, 24 injectors (such as injectors 118, 119) were used to inject fuel into the system 1000, and above 800 psi, only 8 injectors (such as injectors 118) were used to inject fuel into the system 1000. As illustrated, the percentage of pressure drop generally decreases as the pressure increases, and higher percentages of pressure drop occur with the use of only 8 injectors as compared to the use of 24 injectors.

Figure 24:
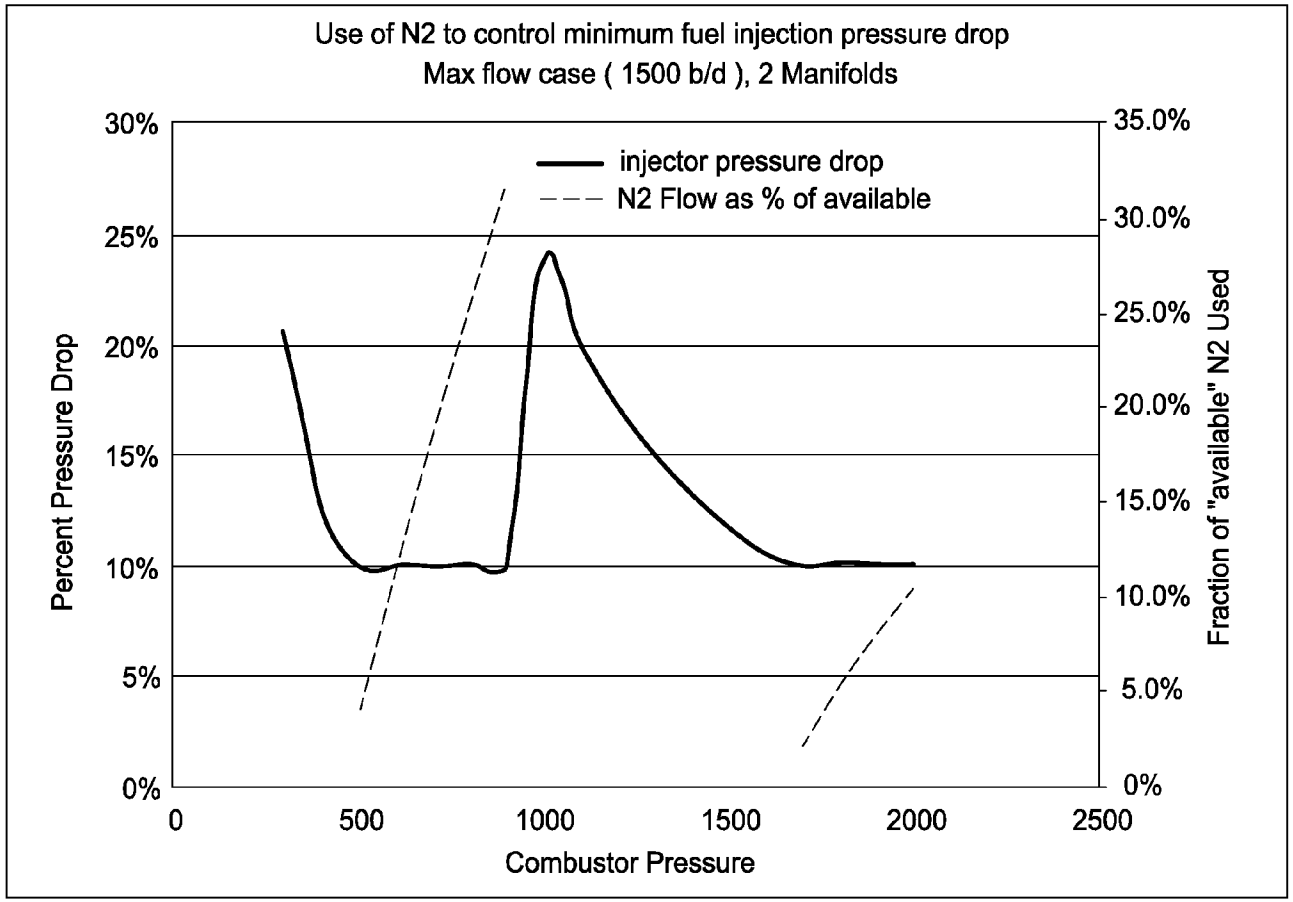
Figure 25:
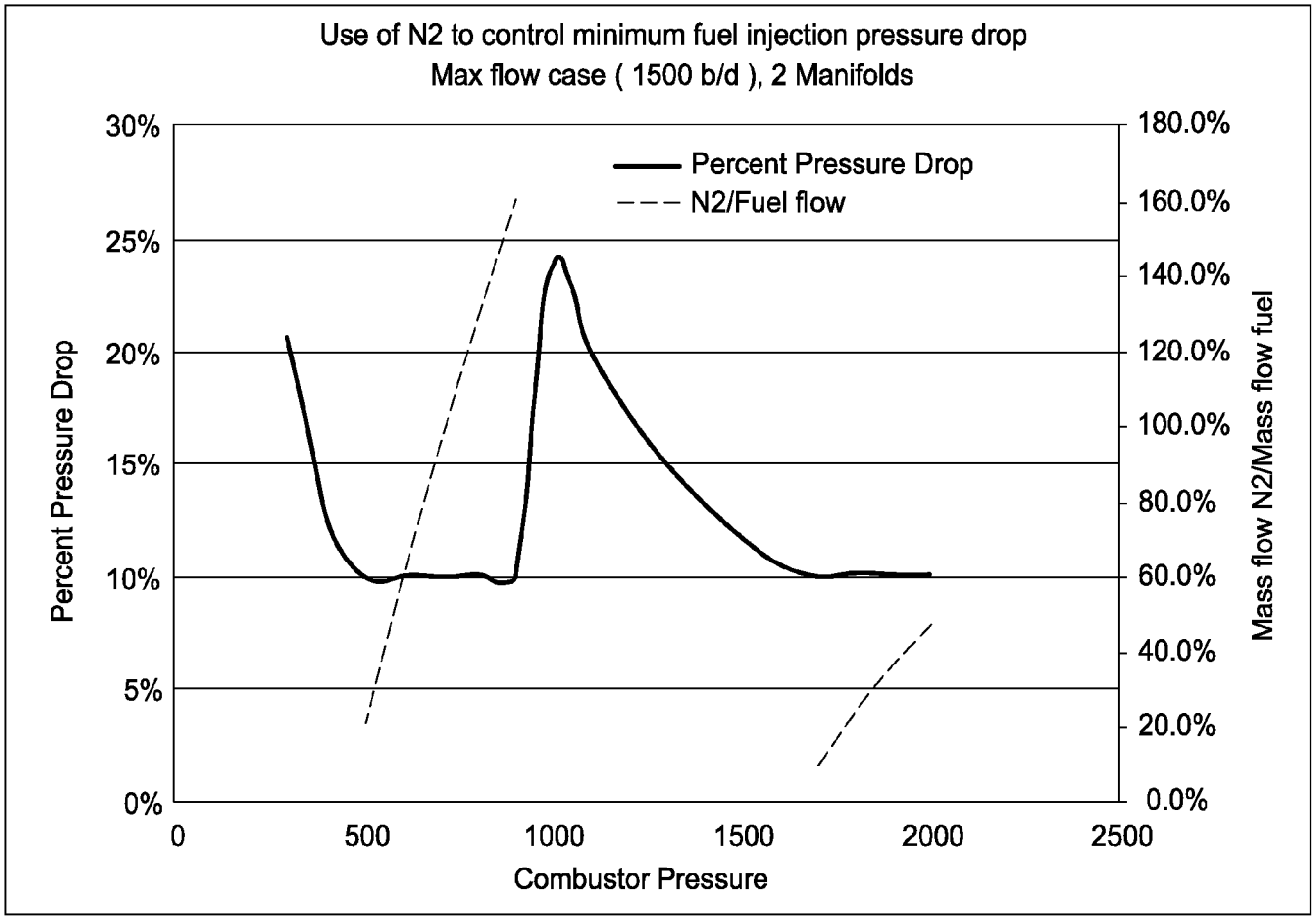

FIGS. 24-29 show graphs illustrating the effect of a diluent, specifically nitrogen, mixed with a fuel supplied to the system 1000 to control the fuel injection pressure drop. FIGS. 24 and 25 shows graphs that illustrate a percentage of pressure drop across the injections (such as injectors 118, 119) versus pressure (psi) in the burner head assembly 100 and/or combustion chamber 210 during operation of the system 1000 at a maximum fuel injection flow rate (e.g. corresponding to that required to generate 1500 bpd of steam) and using two injection manifolds (e.g. first and second injection steps 107, 108). As illustrated, the injector pressure drop is maintained above about 10 percent as the pressure increases from about 300 psi to above about 2000 psi. Also illustrated is that the percentage of the available nitrogen used, as well as the mass flow of nitrogen relative to the mass flow of the fuel, increase as the pressure increases.

Figure 26:
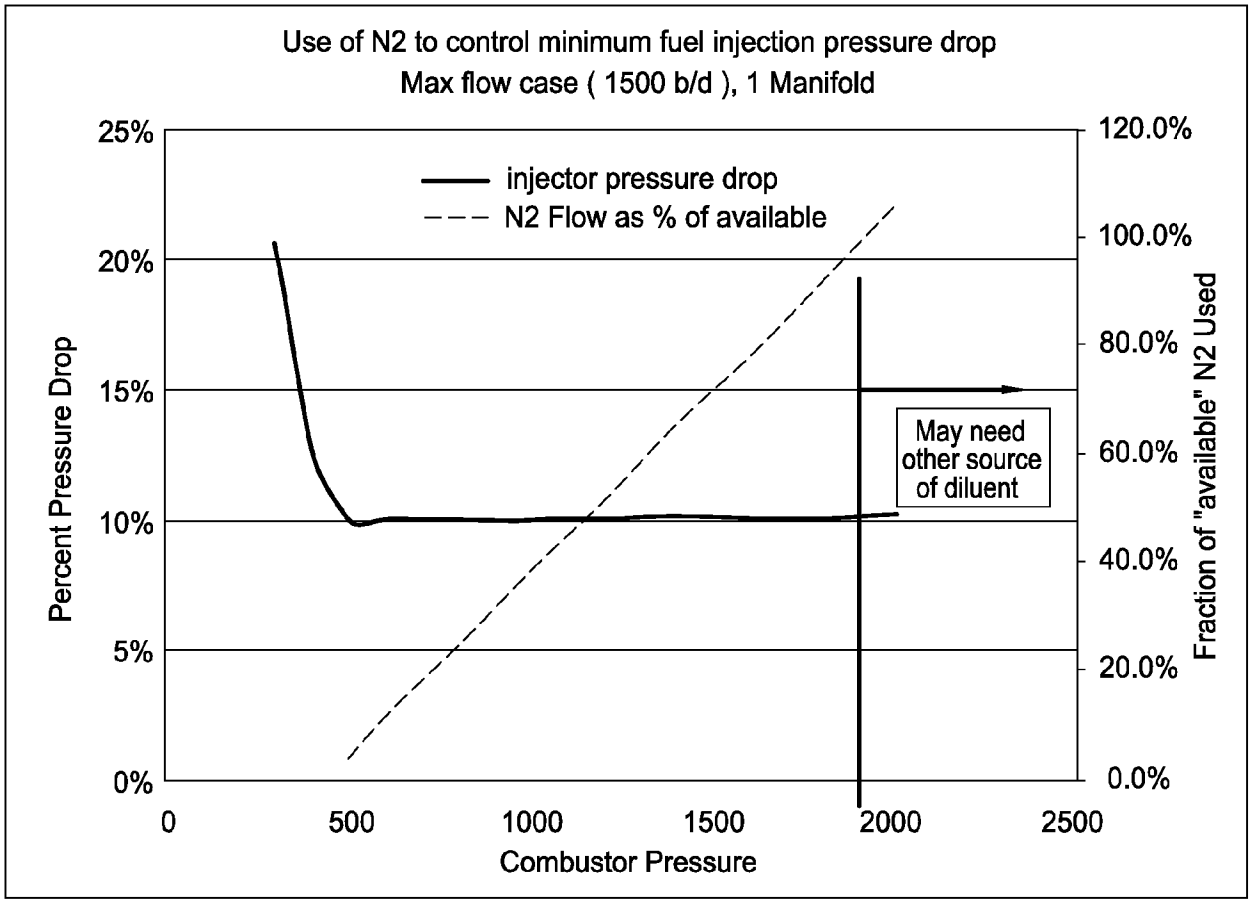
Figure 27:
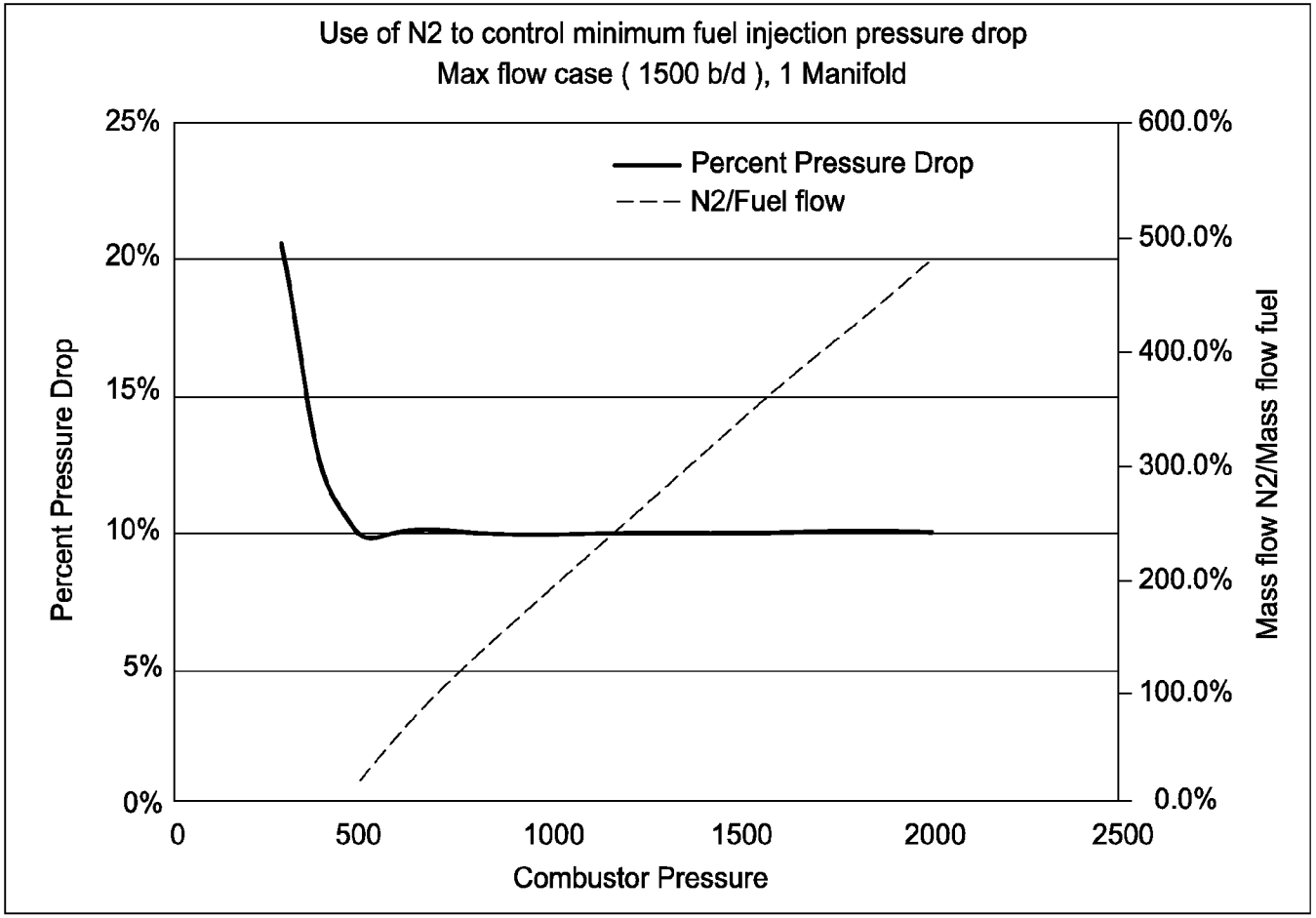

FIGS. 26 and 27 shows graphs that illustrate a percentage of pressure drop across the injections (such as injectors 118, 119) versus pressure (psi) in the burner head assembly 100 and/or combustion chamber 210 during operation of the system 1000 at a maximum fuel injection flow rate (e.g. corresponding to that required to generate 1500 bpd of steam) and using one injection manifold (e.g. first and/or second injection step 107, 108). As illustrated, the injector pressure drop is maintained above about 10 percent as the pressure increases from about 300 psi to above about 2000 psi. Also illustrated is that the percentage of the available nitrogen used, as well as the mass flow of nitrogen relative to the mass flow of the fuel, increase as the pressure increases. As noted in the graph, an additional source of diluent may be needed when the percentage of the available nitrogen used is at 100 percent.

Figure 28:
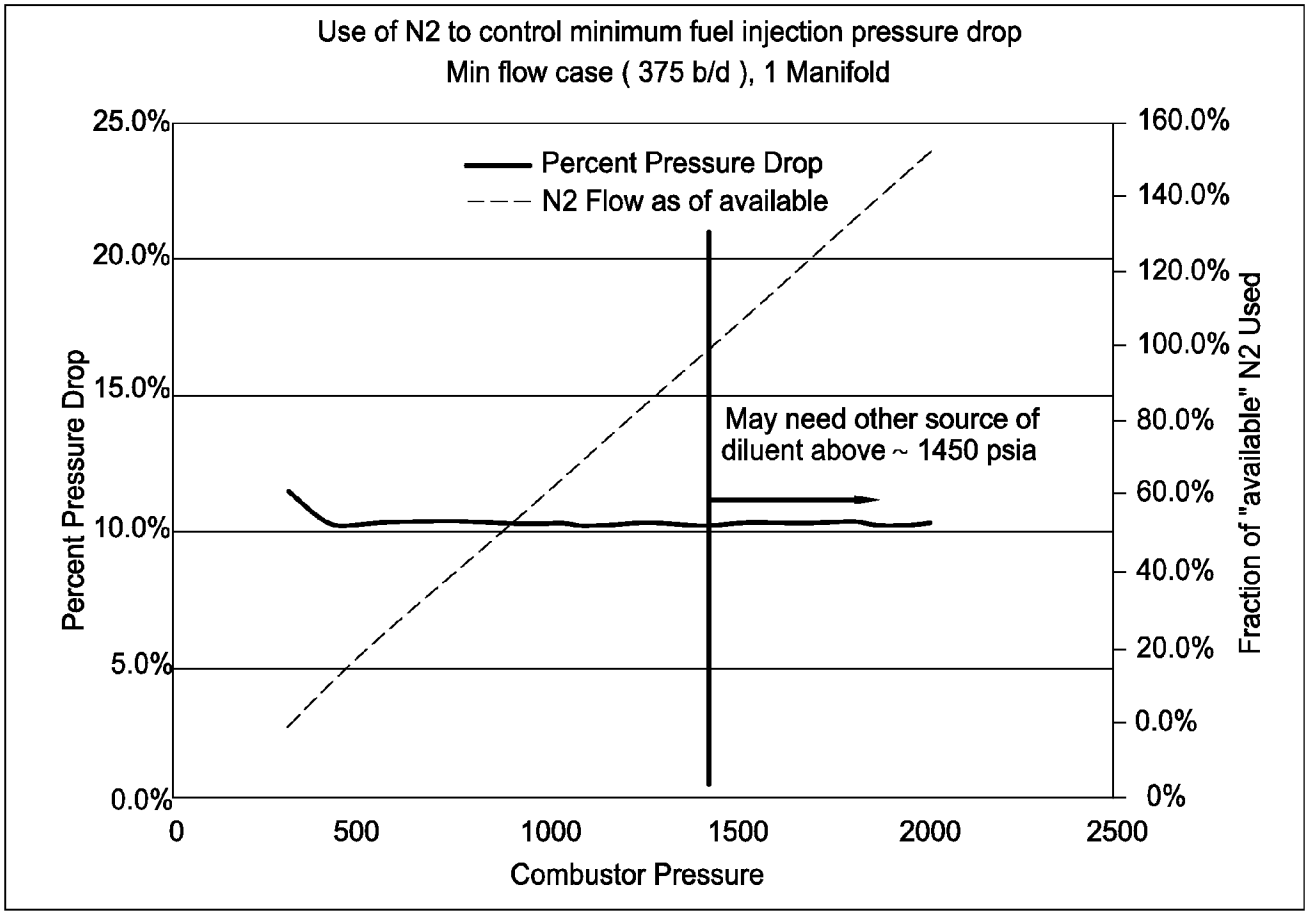
Figure 29:
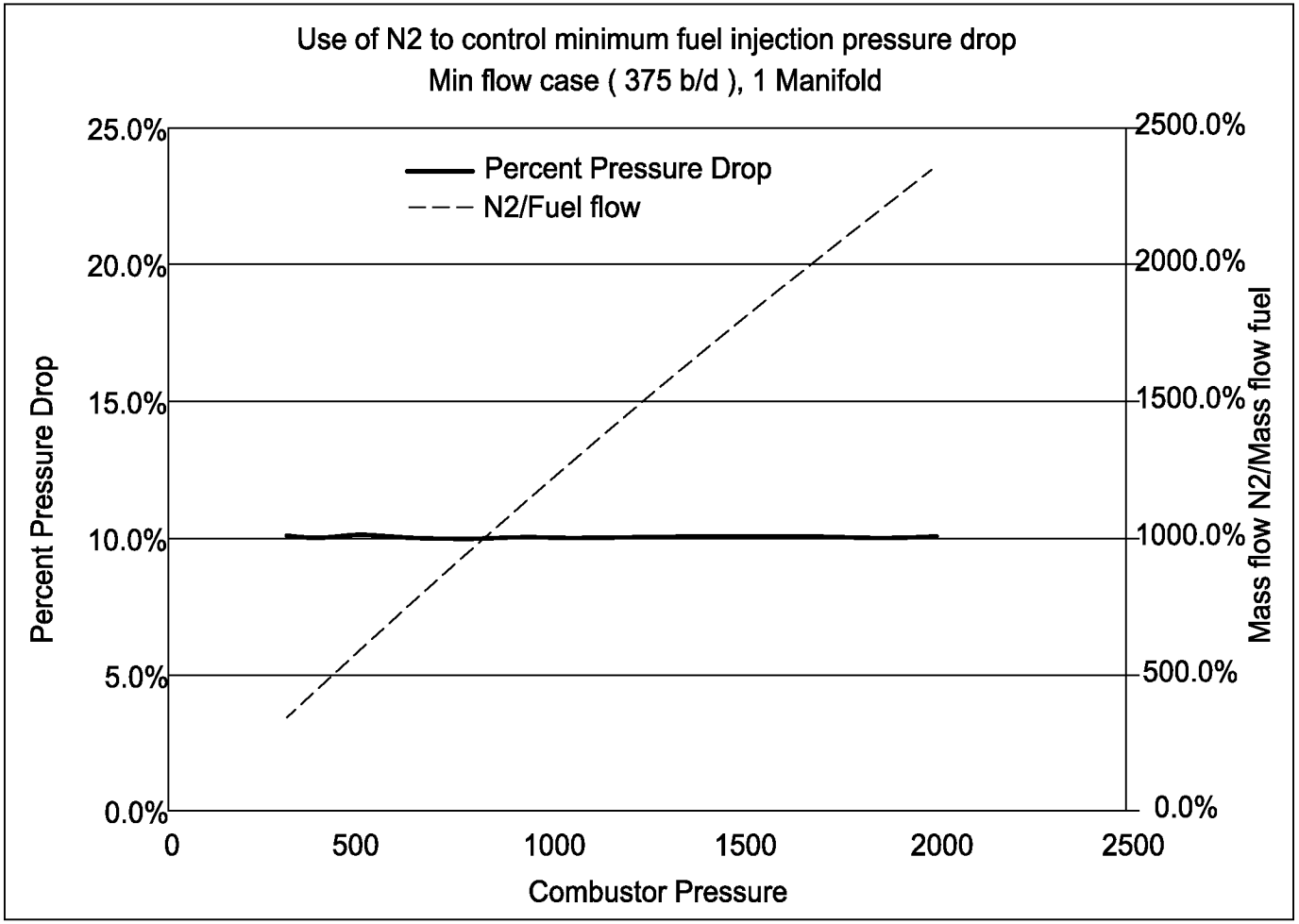

FIGS. 28 and 29 shows graphs that illustrate a percentage of pressure drop across the injections (such as injectors 118, 119) versus pressure (psi) in the burner head assembly 100 and/or combustion chamber 210 during operation of the system 1000 at a minimum fuel injection flow rate (e.g. corresponding to that required to generate 375 bpd of steam) and using one injection manifold (e.g. first and/or second injection step 107, 108). As illustrated, the injector pressure drop is maintained at or above about 10 percent as the pressure increases from about 300 psi to above about 2000 psi. Also illustrated is that the percentage of the available nitrogen used, as well as the mass flow of nitrogen relative to the mass flow of the fuel, increase as the pressure increases. As noted in the graph, an additional source of diluent may be needed when the percentage of the available nitrogen used is at 100 percent.

Figure 30:
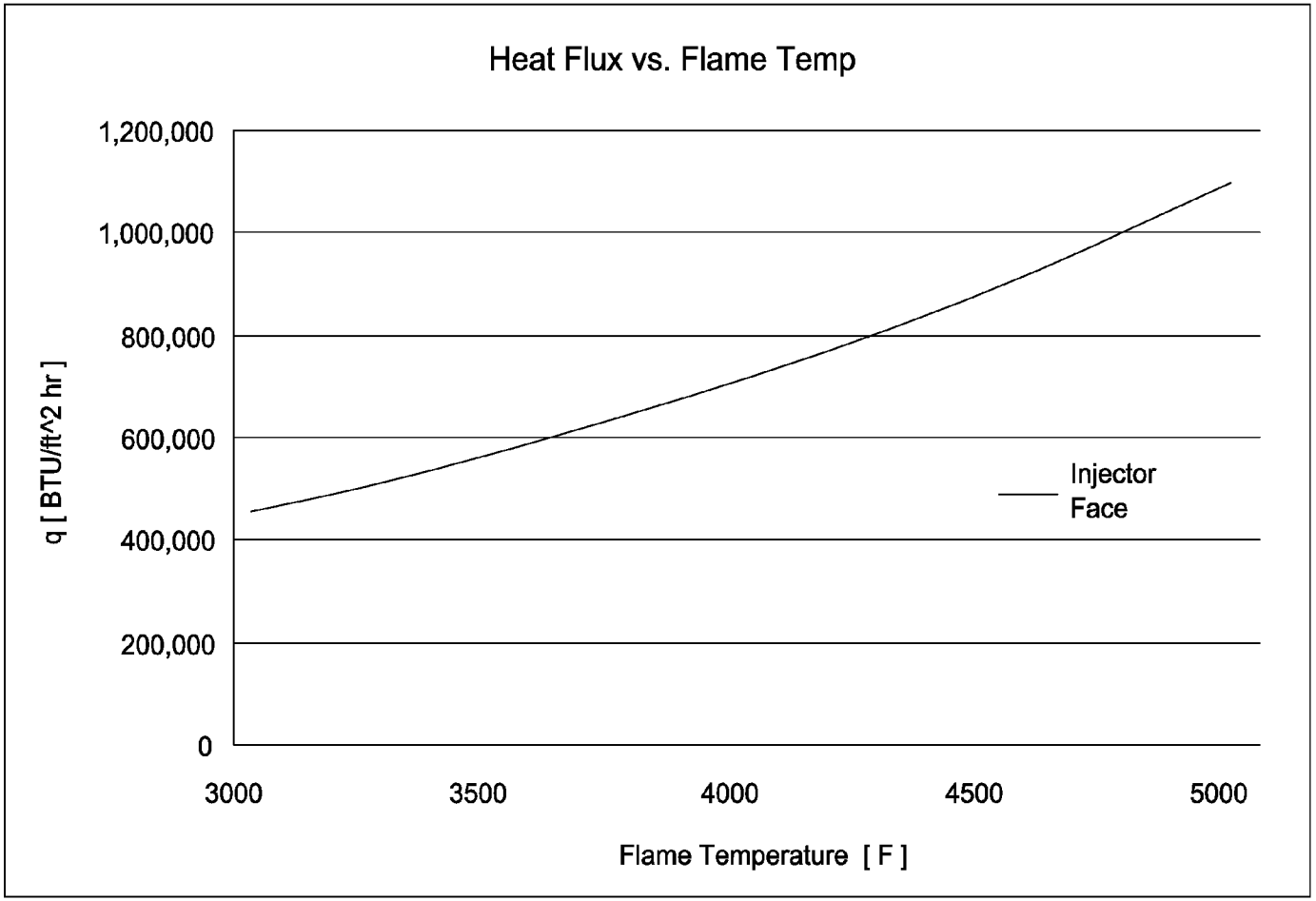

FIG. 30 shows a graph that illustrates an operating range of heat flux (q) versus adiabatic flame temperature (degrees Fahrenheit) at the face of the injector steps (e.g. first and/or second injection step 107, 108) during operation of the burner head assembly 100. As illustrated, as the flame temperature increases from about 3000 degrees Fahrenheit to about 5000 degrees Fahrenheit, the heat flux increases from about 400,000 BTU/ft$^2$ per hour to about 1,100,000 BTU/ft$^2$ per hour.

Figure 31:
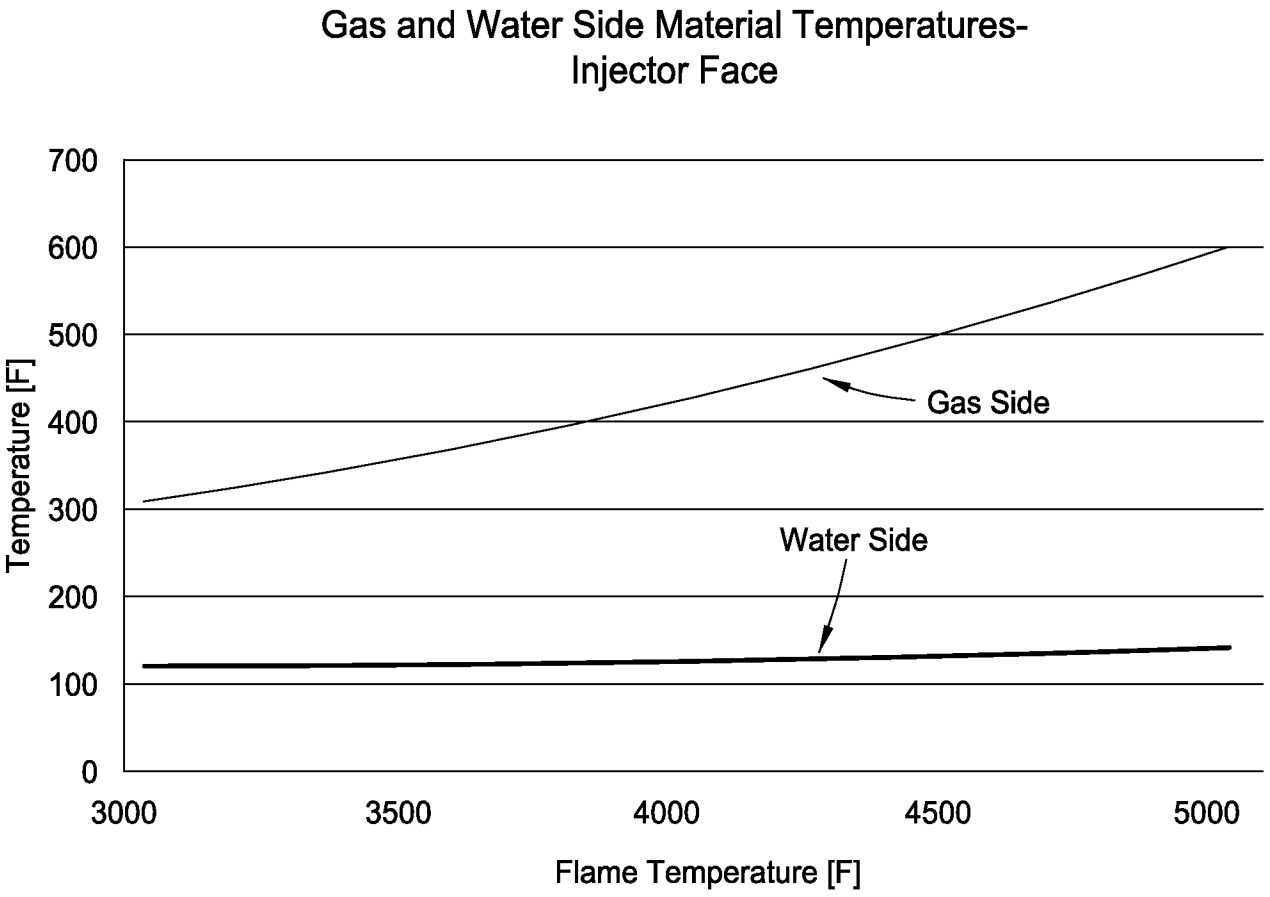
Figure 32:
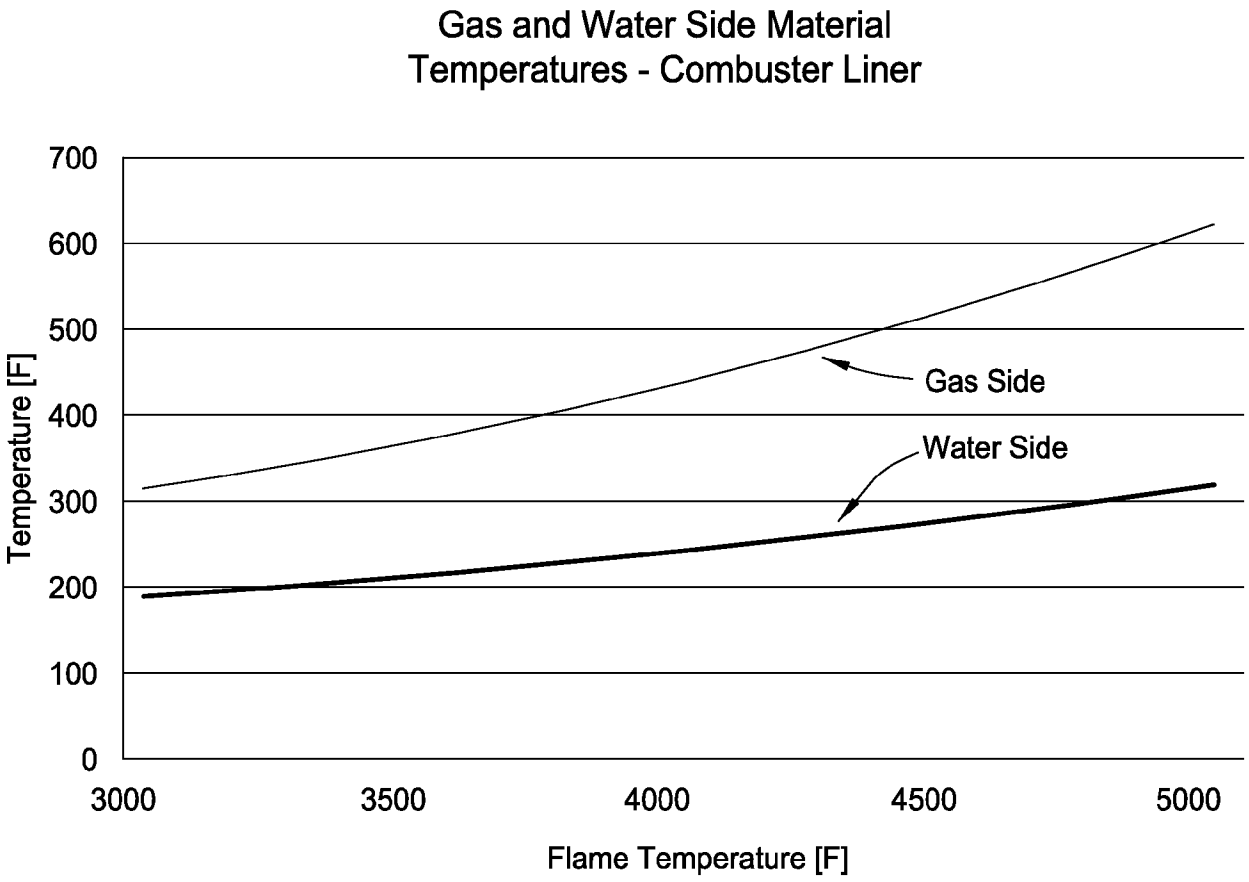
Figure 33:
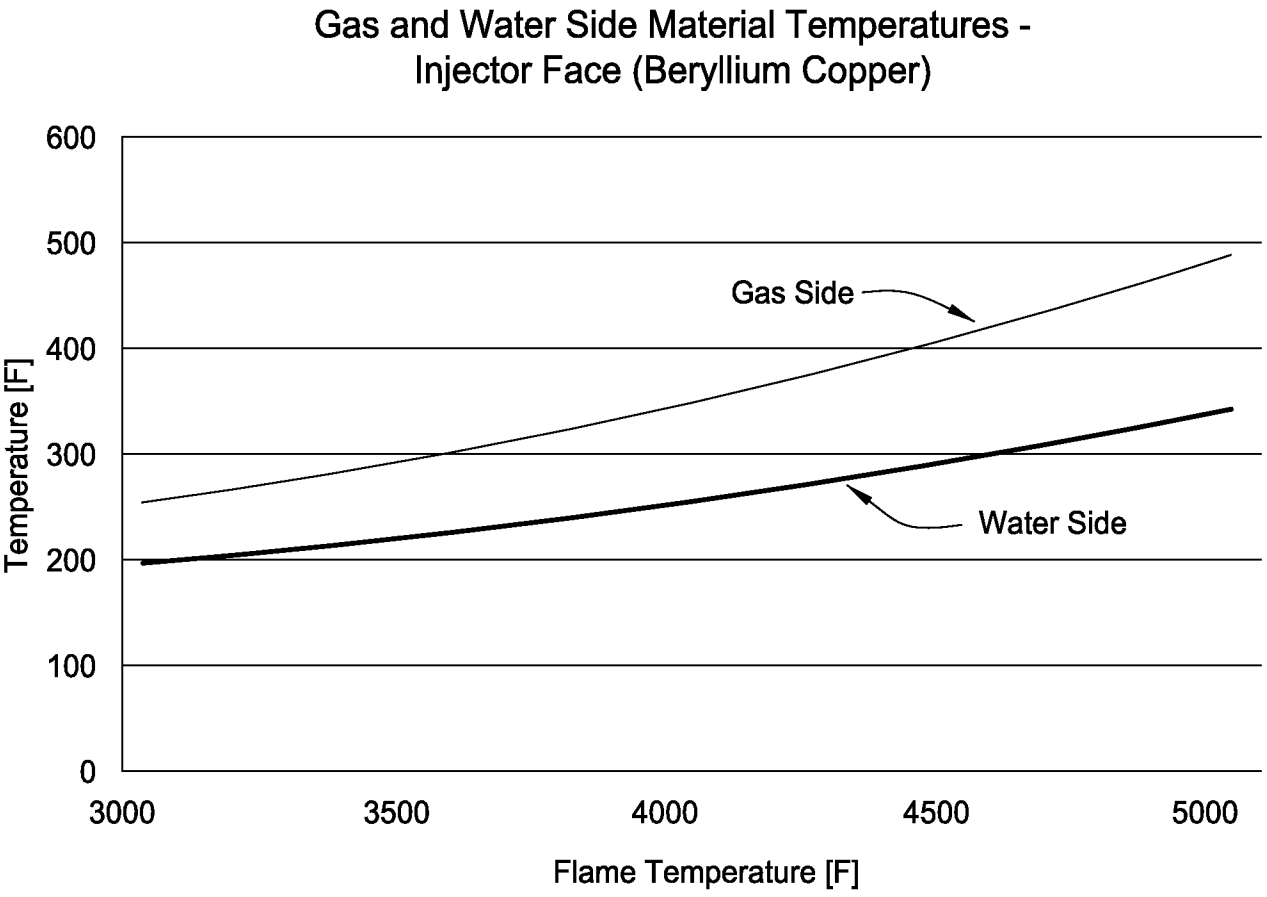

FIGS. 31-33 show graphs that illustrates the gas side and the water side temperatures (degrees Fahrenheit) of the burner head assembly 100 material (including beryllium copper) and the liner assembly 200 material versus adiabatic flame temperature (degrees Fahrenheit) during operation of the system 1000. As illustrated, the temperatures of the materials on the gas side are higher as compared to the water side, and generally increase in temperature as the flame temperature increases. Also illustrated is the temperature of the material on the water side generally remains the same or increases as the adiabatic flame temperature increases based on the material used.

Figure 34:
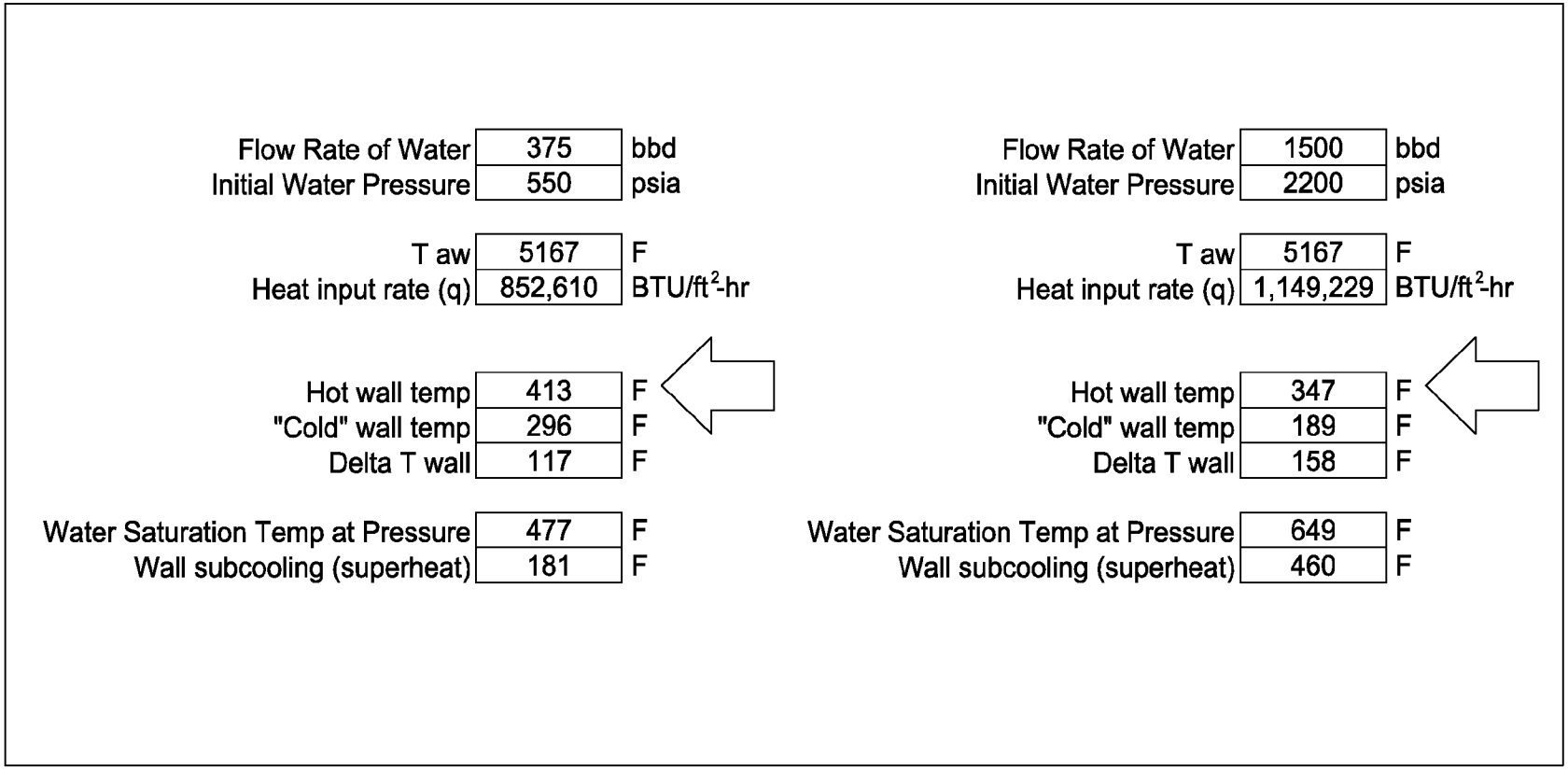

FIG. 34 illustrates a graph comparing the gas (hot) side and water (cold) side wall temperatures of a beryllium copper formed burner head assembly 100 and/or liner assembly 200 under a 375 bpd water flow rate (550 psi initial water pressure) and a 1500 bpd water flow rate (2200 psi initial water pressure). As illustrated, the gas side wall temperature is greater under the 375 bpd water flow rate operating parameter than when operating under the 1500 bpd water flow rate due to the reduced water cooling velocity. Also illustrated is that a high degree of wall sub-cooling is maintained to prevent the possibility of boiling in the fluid paths. The burner head assembly 100 may be formed from a monel 400 based material, may include about a 1/16 inch wall thickness between the gas side and the water side, and may be configured to maintain a gas side wall temperature of about 555 degrees Fahrenheit, a water side wall temperature of about 175 degrees Fahrenheit, a water saturation temperature of about 649 degrees Fahrenheit, and a wall sub-cooling temperature of about 475 degrees Fahrenheit.

Figure 35:
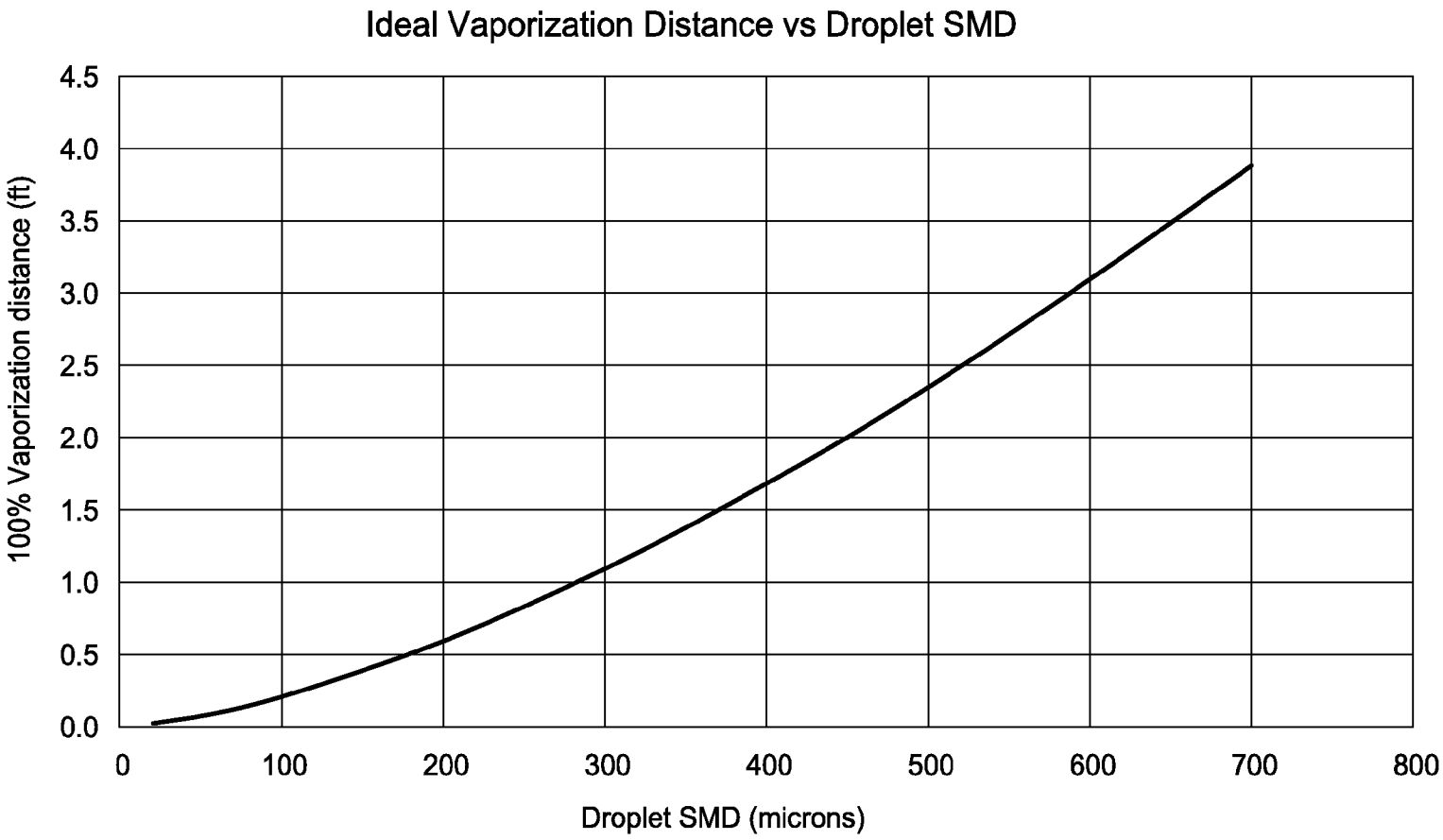

FIG. 35 shows a graph that illustrates the ideal 100 percent vaporization distance (feet) of a fluid droplet versus the fluid droplet size (mean diameter in microns) (degrees Fahrenheit) during operation of the system 1000. As illustrated, as the fluid droplet size increases from about 0.0 microns to about 700 microns, the distance to achieve 100 percent vaporization increases from about 0.0 feet to about 4 feet.

FIG. 36 illustrates an example of the operating characteristics of the system 1000 during start up, including the residence times of fluid flow of the fuel (methane), the oxidant (air), and the cooling fluid (water). As illustrated the resident time of the fuel is about 3.87 minutes at maximum flow and about 15.26 minutes at ¼ of the maximum flow; the resident time of the cooling fluid is about 5.94 minutes at maximum flow and about 23.78 minutes at ¼ of the maximum flow; and the resident time of the oxidant is about 2.37 minutes at maximum flow and about 9.18 minutes at ¼ of the maximum flow.

Figure 37:
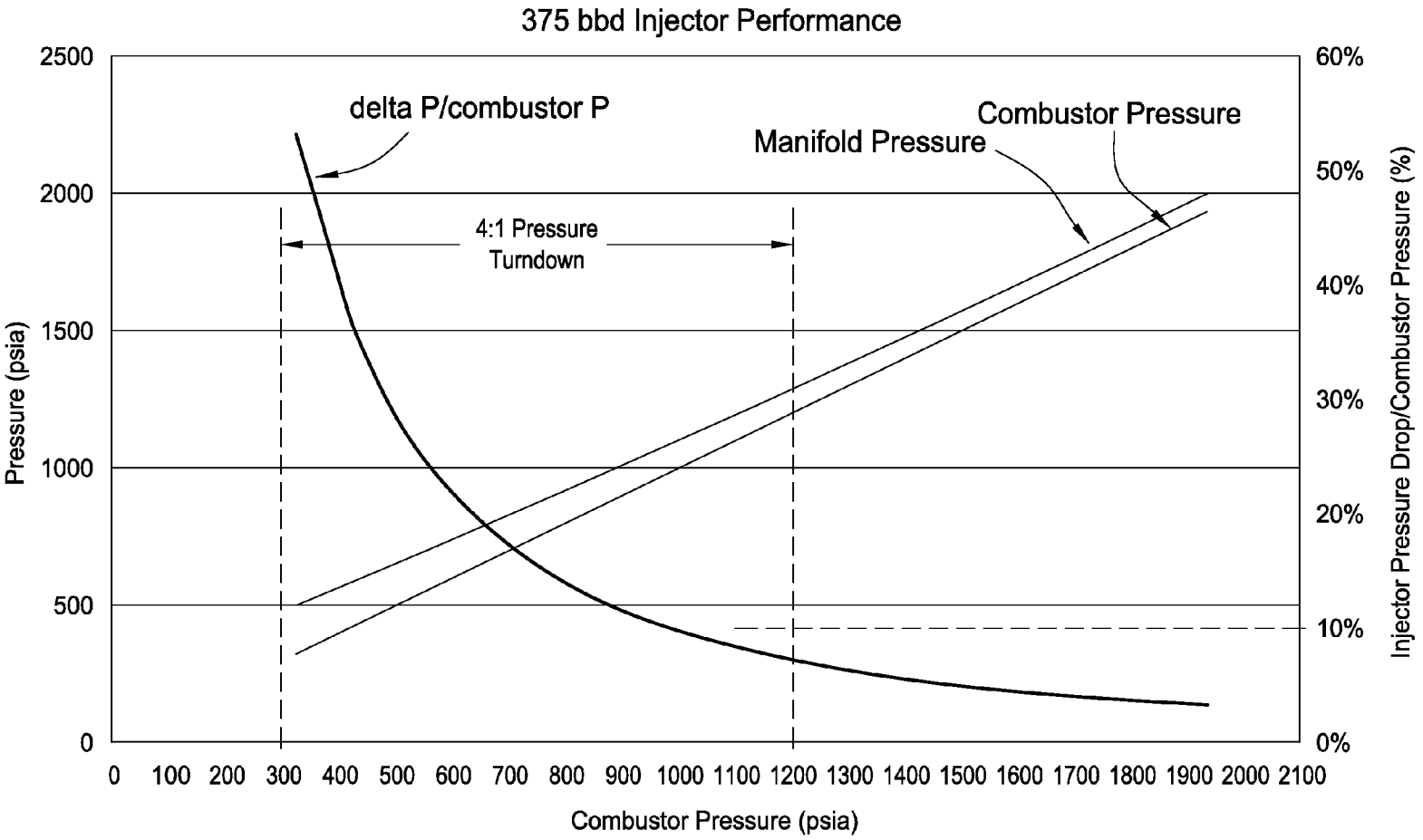
Figure 38:
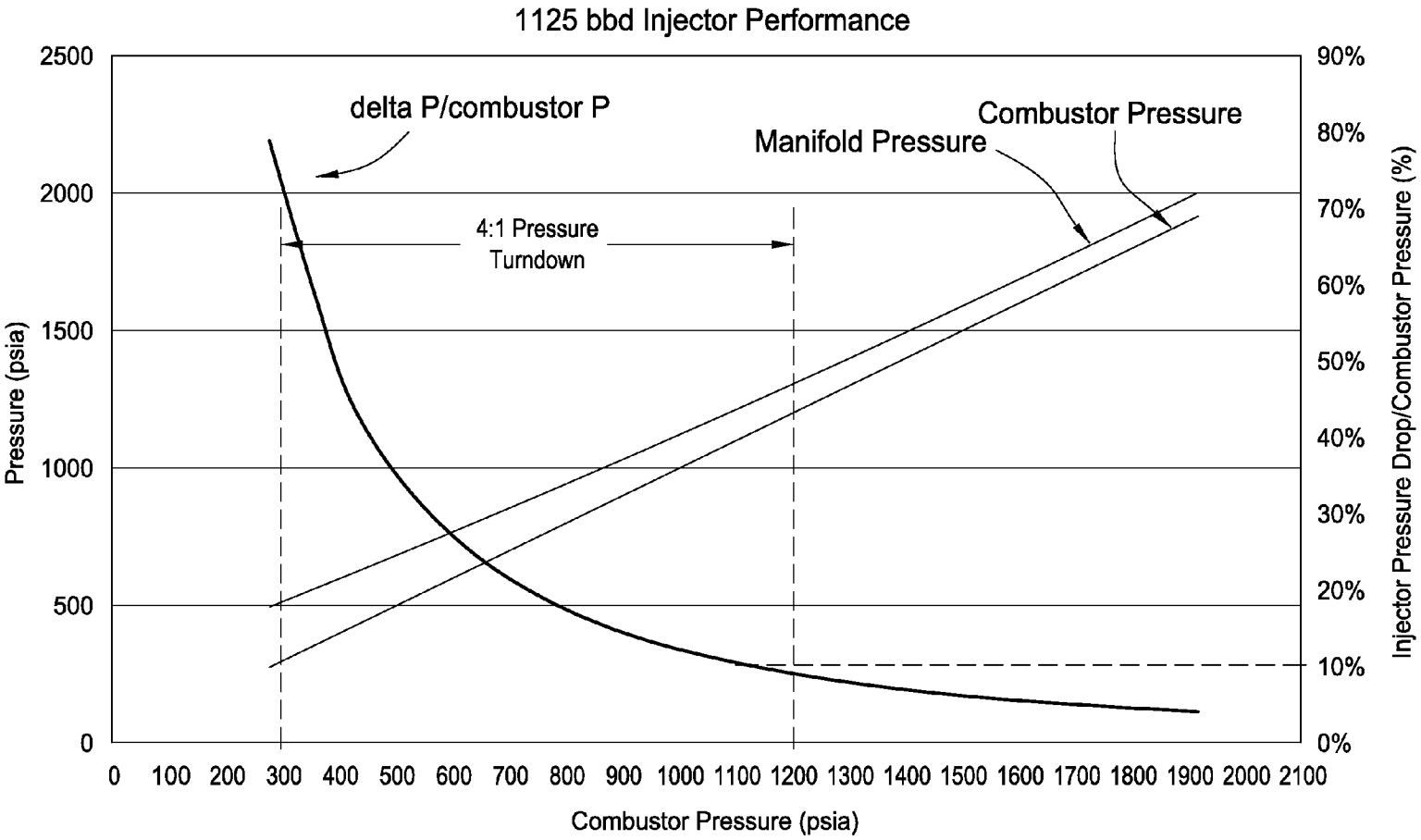
Figure 39:
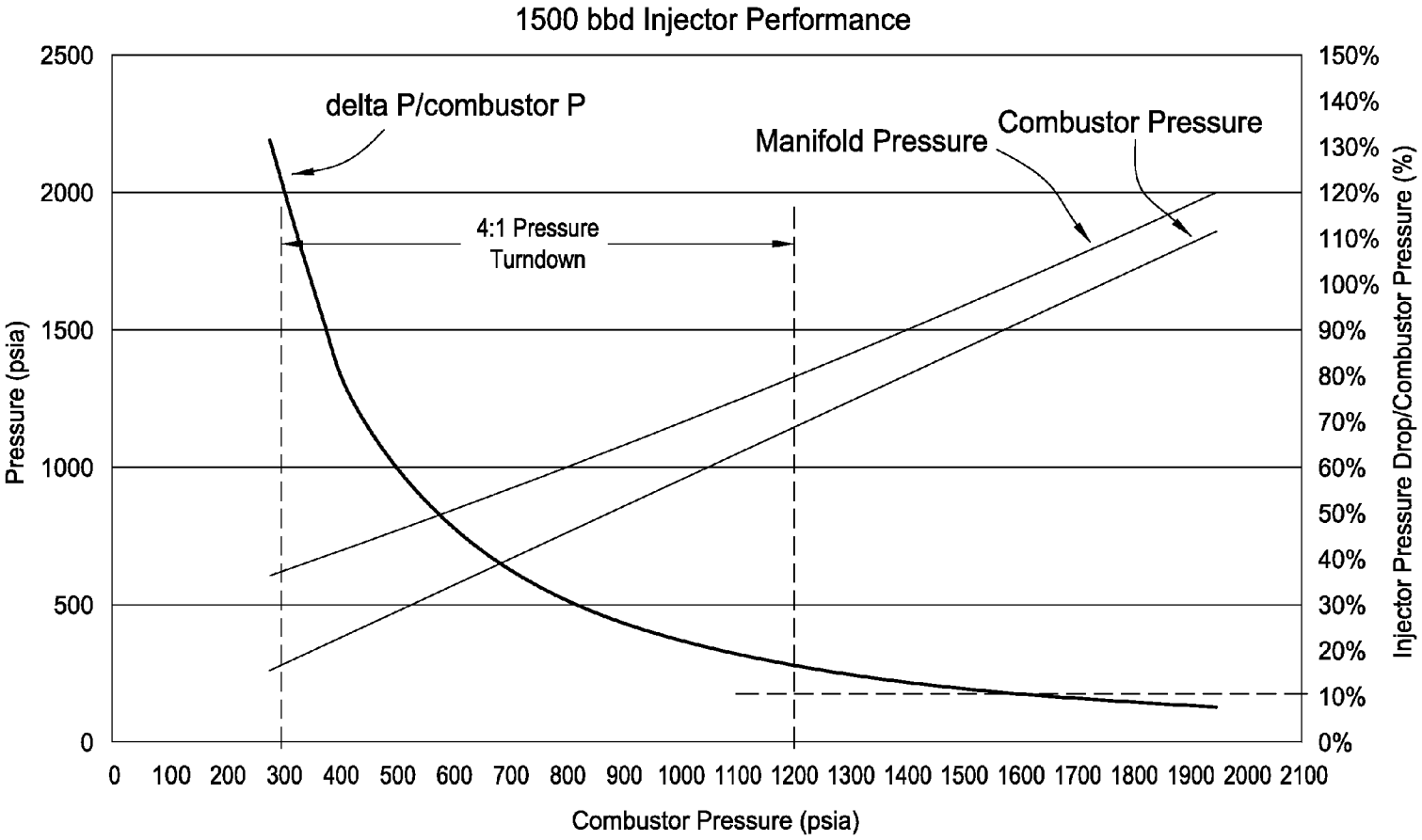

FIGS. 37-39 illustrate graphs of the injector (e.g. burner head assembly 100) performance when operating at a 375 bpd flow rate with only one injection step (e.g. the first injection step 107), a 1125 bpd flow rate with only one injection step (e.g. the second injection step 108), and a 1500 bpd flow rate with two injection steps (e.g. both the first and second injection steps 107, 108), respectively.

Figure 40:
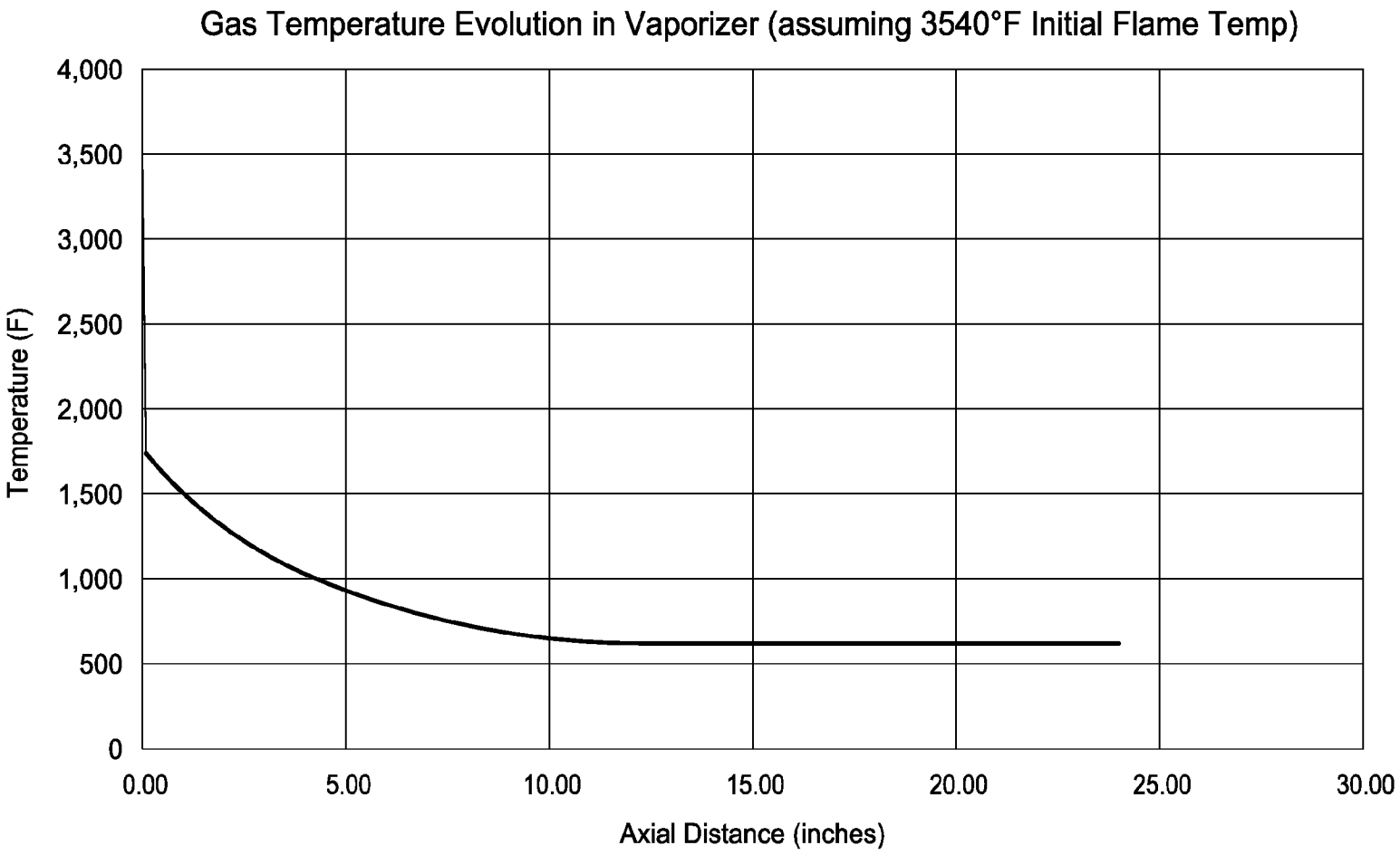

FIG. 40 illustrates gas temperature in the vaporization sleeve 300 versus axial distance from water injection (such as by fluid injection strut 207 and/or fluid injection system 220). As illustrated, the gas temperature drops from about 3,500 degrees Fahrenheit to about 1,750 degrees Fahrenheit instantaneously upon initial injection of fluid droplets into the heated gas. As further illustrated, the gas temperature gradually decreases and eventually is maintained above about 500 degrees Fahrenheit within the vaporization sleeve 300 up to about 25 inches from the initial fluid injection point.

The system 1000 is operable under a range of higher pressure regimes, as opposed to a conventional low-pressure regime, for example, which is managed in part to increase transfer of latent heat to the reservoir. Low pressure regimes are generally used to obtain the highest latent heat of condensation from the steam, however, most reservoirs are either shallow or have been depleted before steam is injected. A secondary purpose of low pressure regimes is to reduce heat losses to the cap rock and base rock of the reservoir because the steam is at lower temperature. However, because this heat loss takes place over many years, in some cases heat losses may actually be increased by low injection rates and longer project lengths.

The system 1000 may be operable in both low pressure regimes and high pressure regimes, and/or in onshore reservoirs at about 2,500 feet deep or greater, near-shore reservoirs, permafrost laden reservoirs, and/or reservoirs in which surface generated steam is generally uneconomic, or not viable. The system 1000 can be used in many different well configurations, including multilateral, horizontal, and vertical wells. The system 1000 is configured for the generation of high quality steam delivered at depth, injection of flue gas, N2 and C02 for example, and higher pressure reservoir management, about 100 psig to about 1,000 psig. In one example, a reservoir which would normally operate at a low pressure regime (e.g. over 40 years) may need to be produced for only 20 years using the system 1000 to produce the same percentage of original oil in place (OOIP). Heat losses to the cap rock and base rock in the reservoir using the system 1000 are therefore also reduced by about 20 years and are far less of an issue.

The system 1000 may also play a beneficial role in low permeability formations where the gravity drainage mechanism may otherwise be impaired. Many formations have a disparity between the vertical permeability and the horizontal permeability to fluid flow. In some situations, the horizontal permeability can be orders of magnitude more than the vertical permeability. In this case, gravity drainage may be hindered and horizontal sweep by steam becomes a much more effective way of producing the oil. The system 1000 can provide the high pressure steam and enhanced oil recovery (EOR) gases that will enable this production scheme.

A summary the potential advantages between high pressure and low pressure regimes using the system 1000 are summarized in Table 1 below.

TABLE 1

Examples of the Advantages of Using the System 1000 with a High Pressure Regime

| Problem | Low Pressure Regime | High Pressure Regime |
|---|---|---|
| Heat Losses to Base rock & Cap rock of the Reservoir | One of the reasons behind using a low pressure regime is to use steam more efficiently due to the higher latent heat of steam at low pressure. | The system 1000 produces equivalent or larger volumes of oil in substantially less time. A reservoir operated in low pressure regimes, say over 40 years, may need to be produced only 20 years to produce the same percentage of OOIP using the system 1000. The amount of heat lost per barrel of oil |

TABLE 1-continued

Examples of the Advantages of Using the System 1000 with a High Pressure Regime

| Problem | Low Pressure Regime | High Pressure Regime |
|---|---|---|
| | | produced is lower in a higher-pressure regime due to a shorter project life, and the projected steam-oil ratio is lower. |
| Gas Override, Break-through | Lower pressure regimes have higher reservoir volumes of gas which will at some stage override the steam bank and break through. | Higher pressure & smaller gas volumes used with the system 1000 reduce or delay override/breakthrough. The system 1000 high pressure regime will have a low reservoir volume of gas initially, and, as the gas cools, it will further decrease its volume, reducing the likelihood or extending the time frame to override or breakthrough. |
| Gas Miscibility | Dissolved gas decreases oil viscosity. | High pressure increases gas dissolution into the oil, therefore further decreasing viscosity. A Gas-Oil-Ratio (GOR) as low as 20 can reduce of high viscosity oils by greater than 90 percent using the system 1000. |
| In-situ Combustion | Low pressure in-situ combustion may pose some risk of oxygen breakthrough to the production wells. | High pressure insures quicker combustion rates, reducing likelihood of oxygen breakthrough. High pressure also increases gas phase compression, thereby reducing its saturation and mobility. |
| BTU's/lb of condensation and in-situ steam condensation | A benefit of low pressure non-condensable gas-free steam is that there are more BTU's/lb of heat condensed at low pressure. However, at low pressure the condensation temperature is also lower, thus reducing or delaying latent heat transfer to the oil. | While pure high pressure steam has fewer BTU's/lb of latent heat and a higher temperature, the actual heat content and condensation temperature are determined by the steam's partial pressure. Flue (exhaust) gas allows the steam to condense at a lower temperature, deeper in the reservoir, and accelerates oil production. |
| Well Spacing and primary production mechanisms | Low pressure regimes generate a larger volume steam chest that works primarily through gravity drainage. The slower drainage mechanism means that tight to moderate well spacing may be required to achieve production goals. As the oil drains over a more extended timeframe, the gas bank has a larger opportunity to override. | High pressure drives fluids to the production wells, which allows for wider well spacing for equivalent or greater oil production rates and lower well capex. In high pressure regimes the drive mechanism plays a stronger role than gravity drainage. In addition, the high pressure steam - when diluted with flue gas - begins condensing at a about the same temperature as low pressure, resulting in a more effective production means with delayed breakthrough. |

The system 1000 may be operable to inject heated N2 and/or C02 into the reservoirs. N2 and CO2, both non-condensable gas (NCG), have relatively low specific heats and heat retention and will not stay hot very long once injected into the reservoir. At about 150 degrees Celsius, CO2 has a modest but beneficial effect on the oil properties important to production, such as specific volume and oil viscosity. Early on, the hot gasses will transfer their heat to the reservoir, which aids in oil viscosity reduction. As the gases cool, their volume will decrease, reducing likelihood of override or breakthrough. The cooled gases will become more soluble, dissolving into and swelling the oil for decreased viscosity, providing the advantages of a "cold" NCG EOR regime. NCG's reduce the partial pressure of both steam and oil, allowing for increased evaporation of both. This accelerated evaporation of water delays condensation of steam, so it condenses and transfers heat deeper in the reservoir. This results in improved heat transfer and accelerated oil production using the system 1000.

The volume of exhaust gas from the system 1000 may be less than 3 Mcf/bbl of steam, which may have enough benefit to accelerate oil production in a reservoir. When the hot gas moves ahead of the oil it will quickly cool to reservoir temperature. As it cools, the heat is transferred to the reservoir, and the gas volume decreases. As opposed to a conventional low pressure regime, the gas volume as it approaches the production well is considerably smaller, which in turn reduces the likelihood of and delays gas breakthrough. N2 and C02 may breakthrough ahead of the steam, but at that time the gasses will be at reservoir temperature. The hot steam from the system 1000 will follow but will condense as it reaches the cool areas, transferring its heat to the reservoir, with the resultant condensate acting as a further drive mechanism for the oil. In addition, gas volume and specific gravity decrease at higher pressure (V is proportional to 1/P). Since the propensity of gas to override is limited at low gas saturation by low gas relative permeability, fingering is controlled and production of oil is accelerated.

The system 1000 may be operable with as many as 100 injection wells and/or production wells, in which oil production may be accelerated and increased. The system 1000 may be configured to optimize the experience of dozens of world-wide, high-pressure, light- and heavy-oil air-injection projects which produce very little free oxygen, less than about 0.3 percent for example. The preferential directionality of fluid flow through reservoirs may be achieved by restricting production at the production wells that are in the highest permeability regions. Gas production may be limited at each well to help sweep a wider area of the reservoir. Reservoir development planning may use gravity as an advantage where ever possible since hot gases rise and horizontal wells can be used to reduce coning and cusping of fluids in the reservoir.

The system 1000 can produce pure high quality steam with or without carbon dioxide (CO2), and with the addition of hydrogen (H2) to the fuel (methane for example) mixture (CH4+H2), which may materially increase combustion heat. The burner head assembly 100 of the system 1000 can produce high quality steam using methane/hydrogen mixtures with ratios from 100/0 percent to 0/100 percent and everything in between. The system 1000 may be adjusted as necessary to control the effect of any increased combustion heat. The reaction of hydrogen with air (or enriched air) may be about 400 degrees Fahrenheit hotter than the equivalent natural gas reaction. At stoichiometric conditions with air, the combustion products are 34 percent steam and 66 percent nitrogen (by volume) at 4000 degrees Fahrenheit. Water may be added to the operation, or without added water, superheated steam could be generated, unless a large amount of excess N2 is added as a diluent or the system 100 is operated very fuel-lean and with excess oxygen (O2). Other embodiments may include modified fuel injection parameters, and design modifications (ratios and staging of air, water and hydrogen) to mitigate the hotter flame temperatures and associated heat transfer. Corrosion could also be reduced when using hydrogen as a fuel, as essentially the only acidic product (assuming relatively pure H2 and water) would be nitric acid. Corrosion may be reduced further when using oxygen as the oxidizer. The high flame temperature may produce more NOx, but that could be reduced with staged combustion and a different water injection scheme. The reservoir production may be enhanced from strategic use of these co-injected EOR gasses together with (low or high) pressure management regimes.

The system 1000 may use CO2 or N2 as coolants or diluents for the burner head assembly 100 and/or the liner assembly 200. The combination of high quality steam at depth, the ability to manage pressure to the reservoir as a drive mechanism, and improved solubility of the introduced gas (due to the pressurized reservoir) for improved oil viscosity results in substantially accelerated oil production. In high pressure regimes enabled using the system 1000, CO2 is also beneficial even for heavy oils.

The system 1000 can be used in different well configurations, including multilateral, horizontal, and vertical wells and at reservoir depths ranging from as shallow as 0 feet to 1,000 feet, to greater than 5,000 feet. The system 1000 may provide a better economic return or internal rate of return (IRR) for a given reservoir, including permafrost-laden heavy oil resources or areas where surface steam emissions are prohibited. The system 1000 may achieve a better IRR than surface generated steam (using bare tubing or vacuum insulated tubing) due to a number of factors, including: significant reduction of steam losses otherwise incurred in surface steam generation, surface infrastructure, and in the wellbore (increasing with reservoir depth, etc.); higher production rates from higher quality, higher pressure steam injected together with reservoir-specific EOR gasses (and optionally in-situ combustion) to generate more oil, faster; and associated savings in energy costs/bbl, water usage and treatment/bbl, lower emissions, etc. The system 1000 may be operable to inject steam having a steam quality of 80% or greater at depths ranging from 0 feet to about 5000 feet and greater.

One advantage of the system 1000 is the maintenance of high pressure in the reservoir, as well as the ability to keep all gases in solution. The system 1000 can inject as much as 25 percent CO2 into the exhaust stream. With the combination of high pressure and low reservoir temperatures, the CO2 can enter into miscible conditions with the in-situ oil, thereby reducing the viscosity ahead of the steam front. Recovery factors as high as 80 percent have been seen after ten years in modeling of 330 foot spacing steam assisted gravity drainage (SAGD) wells plus drive wells in reservoirs containing 126,000 centipoise oil. Increasing the spacing to 660 feet may yield recovery factors of 75 percent after 22 years.

The system 1000 may work with geothermal wells, fireflooding, flue gas injection, H2S and chloride stress corrosion cracking, etc. The system 1000 may include a combination of specialized equipment features together with suitable metallurgies and where necessary use of corrosion inhibitors. Corrosion at the production wells can be controlled in high-pressure-air injection projects by the addition of corrosion inhibitors at the producers.

The system 1000 may be operable at relatively high pressures, greater than 1,200 psi in relatively shallow reservoirs, assuming standard operating considerations such as fracture gradients, etc. To achieve the high pressure in shallow reservoirs, throttling the production well outlet may be required to obtain the desired backpressure.

The system 1000 may be operable using clean water (drinking water standards or above) and/or brine as a feedwater source, while avoiding potential issues from scaling, heavy metals, etc. within the system 1000 and in the reservoir.

The system 1000 may be operable to maintain higher reservoir pressures that offset the lower temperature of steam mixed with NCGs. The addition of NCG to steam will lower the temperature at which the steam condenses at higher pressures by 50-60 degrees Fahrenheit because the partial pressure of water is lower. Therefore, the steam temperature in the system 1000 is approximately the same as the steam temperature in a lower pressure regime without NCG. The temperature is lowered, but the steam does not condense as easily. Additionally the partial pressure of oil is lowered and more oil evaporates as well. Both of these help increase oil recovery. Additionally, the presence of gases helps to swell the oil, forcing some oil out from the pore spaces and again increasing recovery. By operating the system 1000 and the reservoir at a high pressure you can combine the benefits of miscible flooding in the cooler parts of the reservoir with steam flood following after. Also, by operating at a high pressure there are two mechanisms to reduce the viscosity of heavy oil. The first, which accelerates oil production, is higher Gas-Oil-Ratios and lower oil viscosity at temperatures up to approximately 150 degrees Celsius. The second is the traditional reduction in oil viscosity at higher temperature.

FIGS. 41A, 41B, and 41C illustrate examples of the composition and flow rate of exhaust gases that can be generated using the system 1000.

FIG. 42 illustrates an example of the operational metrics of the system 1000 compared to that of surface steam in a reservoir at a depth of about 3500 feet.

FIGS. 43A, 43B, and 43C illustrate examples of the BTU contribution from the delivered steam and exhaust gases using the system 1000 compared to delivery of steam from the surface.

A method of recovering hydrocarbons from a reservoir comprises supplying a fuel, an oxidant, and a fluid to a downhole system; flowing water to the system at a flow rate within a range of about 375 barrels per day to about 1500 barrels per day; combusting the fuel, oxidant, and water to form steam having about an 80 percent water vapor fraction; maintaining a combustion temperature within a range of about 3000 degrees Fahrenheit to about 5000 degrees Fahrenheit; maintaining a combustion pressure within a range of about 300 PSI to about 2000 PSI; and maintaining a fuel injection pressure drop in the system above 10 percent.

The embodiments of the system 1000 described herein regarding the dimensions, number and arrangement of components, flow rates, etc., may be scaled as necessary (e.g. increased or decreased) to achieve an overall system 1000 steam generation output within a range of 0-10,000 bpd or more of steam. While the foregoing is directed to embodiments of the invention, other and further embodiments of the invention may be implemented without departing from the scope of the invention, and the scope thereof is determined by the claims that follow.

The invention claimed is:

1. A downhole steam generator, comprising:

a body with a bore disposed therethrough operable to inject a first oxidant stream into a combustion chamber;

one or more fuel injectors coupled to the body, the fuel injectors operable to inject a first fuel stream into the combustion chamber; and an igniter coupled to the body in a position offset from a longitudinal axis of the bore, the igniter operable to inject a second fuel stream and a second oxidant stream into the combustion chamber.

2. The generator of claim 1, wherein the igniter comprises a power source operable to initiate combustion of the fuel and oxidant.

3. The generator of claim 1, further comprising a fuel line configured to supply the second fuel stream to the igniter and an oxidizer line configured to supply the second oxidant stream to the igniter.

4. The generator of claim 1, wherein the fuel injectors are coupled to the body to form a first fuel injection step and a second fuel injection step, wherein the first fuel injection step includes an inner diameter greater than an inner diameter of the bore, and wherein the second fuel injection step includes an inner diameter greater than the inner diameter of the first fuel injection step, the second fuel injection step being positioned downstream of the first fuel injection step.

5. The generator of claim 1, further comprising a liner coupled to the body and forming the combustion chamber, the liner having one or more fluid paths disposed through the liner.

6. The generator of claim 5, wherein the fluid paths are in fluid communication with the combustion chamber.

7. A method of operating the downhole steam generator of claim 1 to recover hydrocarbons from a reservoir, comprising:

supplying fuel and oxidant into the combustion chamber, wherein at least one of the fuel and oxidant flows through the igniter;

initiating combustion of the fuel and oxidant using the igniter to combust the fuel and oxidant;

injecting water into combustion products from combustion of the fuel and oxidant to generate steam; and injecting the steam into the reservoir.

8. The method of claim 7, further comprising flowing the fuel through the igniter at a first flow rate, and flowing fuel through the fuel injectors at a second flow rate to generate 375-1500 barrels per day of steam, wherein the first flow rate is less than the second flow rate.

9. The method of claim 7, further comprising flowing the fuel through the igniter at a first flow rate, and flowing fuel through the fuel injectors at a second flow rate to generate up to at least 1500 barrels per day of steam, wherein the first flow rate is within a range of above 0% to 25% of the second flow rate.

10. The method of claim 7, further comprising flowing the fuel through the igniter at a first flow rate, and flowing fuel through the fuel injectors at a second flow rate to generate up to at least 1500 barrels per day of steam, wherein the first flow rate is within a range of 10% to 25% of the second flow rate.

11. The method of claim 7, further comprising flowing the oxidant through the igniter at a first flow rate, and flowing oxidant through the bore at a second flow rate to generate 375-1500 barrels per day of steam, wherein the first flow rate is less than the second flow rate.

12. The method of claim 7, further comprising flowing the oxidant through the igniter at a first flow rate, and flowing oxidant through the bore at a second flow rate to generate up to at least 1500 barrels per day of steam, wherein the first flow rate is within a range of above 0% to 25% of the second flow rate.

13. The method of claim 7, further comprising flowing the oxidant through the igniter at a first flow rate, and flowing oxidant through the bore at a second flow rate to generate up to at least 1500 barrels per day of steam, wherein the first flow rate is within a range of 10% to 25% of the second flow rate.

14. The method of claim 7, further comprising flowing both fuel and oxidant through the igniter.

15. The method of claim 7, further comprising flowing both fuel and oxidant through the igniter while flowing at least one of oxidant through the bore and fuel through the fuel injectors.

16. A method of operating a downhole steam generator to recover hydrocarbons from a reservoir, comprising:

supplying fuel and oxidant into a combustion chamber, wherein at least one of the fuel and oxidant flows through an igniter, the igniter being in a position offset from a longitudinal axis of the combustion chamber;

initiating combustion of the fuel and oxidant using the igniter to combust the fuel and oxidant;

injecting water into combustion products from combustion of the fuel and oxidant to generate steam; and injecting the steam into the reservoir.

17. The method of claim 16, further comprising generating greater than 0 to about 150 barrels per day of steam while flowing the at least one of the fuel and oxidant through the igniter.

18. The method of claim 16, further comprising generating 150-375 barrels per day of steam while flowing the at least one of the fuel and oxidant through the igniter.

19. The method of claim 16, further comprising flowing both the fuel and the oxidant through the igniter.

* * * * *